US010047981B2

(12) United States Patent
Parish et al.

(10) Patent No.: US 10,047,981 B2
(45) Date of Patent: Aug. 14, 2018

(54) SYSTEM AND METHOD FOR THERMOELECTRIC PERSONAL COMFORT CONTROLLED BEDDING

(71) Applicant: Marlow Industries, Inc., Dallas, TX (US)

(72) Inventors: Overton Parish, Frisco, TX (US); Leonard Recine, Plano, TX (US); Kevin Garrett, Richardson, TX (US); Anthony Tran, Plano, TX (US)

(73) Assignee: MARLOW INDUSTRIES, INC., Dallas, TX (US)

( * ) Notice: Subject to any disclaimer, the term of this patent is extended or adjusted under 35 U.S.C. 154(b) by 777 days.

(21) Appl. No.: 13/954,762

(22) Filed: Jul. 30, 2013

(65) Prior Publication Data

US 2014/0137569 A1 May 22, 2014

Related U.S. Application Data

(60) Provisional application No. 61/677,391, filed on Jul. 30, 2012, provisional application No. 61/779,741, filed on Mar. 13, 2013.

(51) Int. Cl.
*F25B 21/00* (2006.01)
*F25B 21/02* (2006.01)
(Continued)

(52) U.S. Cl.
CPC ..... *F25B 21/02* (2013.01); *A47C 21/044* (2013.01); *A47C 21/048* (2013.01);
(Continued)

(58) Field of Classification Search
CPC ..... A47C 21/04; A47C 21/044; F25B 21/02; F25B 21/04
See application file for complete search history.

(56) References Cited

U.S. PATENT DOCUMENTS 96,989 A 11/1869 Somes
2,461,432 A 2/1949 Mitchell
(Continued)

FOREIGN PATENT DOCUMENTS

CN 2660366 Y 12/2004
EP 0 862 901 A1 9/1998
(Continued)

OTHER PUBLICATIONS

Supplementary European Search Report dated Aug. 4, 2014 in connection with European Patent Application No. EP 11 78 7565.
(Continued)

*Primary Examiner* — Ljiljana Ciric
*Assistant Examiner* — Alexis Cox

(57) ABSTRACT

A system and method provides for controlling condensation generation in an air conditioning system for use in a bed (mattress). During active operation of the air conditioning system to generate conditioned air, the relative humidity of ambient air is measured and operation of one or more thermoelectric devices (TEDs) within the air conditioning system in response to the measured relative humidity is adjusted to control condensate buildup. During a subsequent drying operation, the relative humidity of the ambient air is measured and the drying operation is adjusted or otherwise controlled based on the measurement.

20 Claims, 57 Drawing Sheets

(51) Int. Cl.

| | |
|---|---|
| ***A47C 21/04*** | (2006.01) |
| ***F24F 5/00*** | (2006.01) |
| *F25B 21/04* | (2006.01) |
| *F24F 13/22* | (2006.01) |

(52) U.S. Cl.
CPC ..... *F24F 5/0042* (2013.01); *F24F 2013/221* (2013.01); *F25B 21/04* (2013.01)

(56) References Cited

U.S. PATENT DOCUMENTS

| | | | | |
|---|---|---|---|---|
| 2,512,559 | A | 6/1950 | Williams | |
| 4,459,468 | A | 7/1984 | Bailey | |
| 4,602,486 | A | 7/1986 | Weinstein | |
| 4,858,519 | A * | 8/1989 | Meckler | F24F 1/01 454/263 |
| 4,867,230 | A | 9/1989 | Voss | |
| 4,884,304 | A | 12/1989 | Elkins | |
| 5,097,829 | A | 3/1992 | Quisenberry | |
| 5,117,638 | A | 6/1992 | Feher | |
| 5,243,706 | A | 9/1993 | Frim et al. | |
| 5,299,428 | A | 4/1994 | Kawaguri et al. | |
| 5,332,028 | A * | 7/1994 | Marris | F24D 15/04 165/233 |
| 5,448,788 | A | 9/1995 | Wu | |
| 5,661,978 | A | 9/1997 | Holmes et al. | |
| 5,884,486 | A | 3/1999 | Hughes et al. | |
| 6,006,524 | A | 12/1999 | Park | |
| 6,085,369 | A | 7/2000 | Feher | |
| 6,119,463 | A | 9/2000 | Bell | |
| 6,223,543 | B1 * | 5/2001 | Sandelman | F24F 11/0008 62/176.6 |
| 6,263,530 | B1 | 7/2001 | Feher | |
| 6,453,679 | B1 | 9/2002 | Aoyagi et al. | |
| 6,546,576 | B1 | 4/2003 | Lin | |
| 6,764,502 | B2 | 7/2004 | Bieberich | |
| 7,152,412 | B2 | 12/2006 | Harvie | |
| 7,272,936 | B2 | 9/2007 | Feher | |
| 7,308,796 | B1 | 12/2007 | Eager | |
| 7,469,432 | B2 | 12/2008 | Chambers | |
| 7,480,950 | B2 | 1/2009 | Feher | |
| 7,588,288 | B2 | 9/2009 | Bajic et al. | |
| 7,877,827 | B2 | 2/2011 | Marquette et al. | |
| 7,908,687 | B2 | 3/2011 | Ward et al. | |
| 7,963,594 | B2 | 6/2011 | Wolas | |
| 7,996,936 | B2 | 8/2011 | Marquette et al. | |
| 8,065,763 | B2 | 11/2011 | Brykalski et al. | |
| 2002/0005043 | A1 * | 1/2002 | Rudick | F25B 9/14 62/6 |
| 2003/0037914 | A1 | 2/2003 | Inbe et al. | |
| 2003/0230104 | A1 * | 12/2003 | Morse | F25D 19/00 62/277 |
| 2005/0210884 | A1 * | 9/2005 | Tuskiewicz | A47F 3/0408 62/3.6 |
| 2006/0130490 | A1 | 6/2006 | Petrovski | |
| 2006/0137099 | A1 | 6/2006 | Feher | |
| 2006/0207278 | A1 * | 9/2006 | Mead | A47F 3/0408 62/246 |
| 2007/0032908 | A1 * | 2/2007 | Hyland | H05K 7/20836 700/275 |
| 2007/0095088 | A1 | 5/2007 | Drobot Isherwood et al. | |
| 2007/0251016 | A1 | 11/2007 | Feher | |
| 2007/0261548 | A1 | 11/2007 | Vrzalik et al. | |
| 2008/0028517 | A1 | 2/2008 | Schmidt | |
| 2008/0148481 | A1 | 6/2008 | Brykalski et al. | |
| 2008/0264614 | A1 | 10/2008 | Szolyga | |
| 2009/0000031 | A1 | 1/2009 | Feher | |
| 2009/0044338 | A1 | 2/2009 | Rock et al. | |
| 2009/0056030 | A1 | 3/2009 | Bolden | |
| 2009/0064411 | A1 * | 3/2009 | Marquette | A47C 21/044 5/423 |
| 2009/0126110 | A1 | 5/2009 | Feher | |
| 2009/0193814 | A1 | 8/2009 | Lofy | |
| 2010/0011502 | A1 * | 1/2010 | Brykalski | A47C 21/044 5/423 |
| 2010/0107675 | A1 | 5/2010 | Lifson et al. | |
| 2010/0199687 | A1 | 8/2010 | Woods et al. | |
| 2011/0029661 | A1 | 2/2011 | Jackowski et al. | |
| 2011/0107514 | A1 | 5/2011 | Brykalski et al. | |
| 2011/0258778 | A1 | 10/2011 | Brykalski et al. | |
| 2011/0289684 | A1 | 12/2011 | Parish et al. | |
| 2012/0000207 | A1 | 1/2012 | Parish et al. | |
| 2014/0137569 | A1 † | 5/2014 | Parish | |

FOREIGN PATENT DOCUMENTS

| | | | |
|---|---|---|---|
| JP | 2002090084 | A | 3/2002 |
| KR | 10-2009-0115987 | | 11/2009 |
| WO | WO 2007/060371 | A2 | 5/2007 |
| WO | WO 2007/093783 | A2 | 8/2007 |
| WO | WO 2008/098945 | A2 | 8/2008 |
| WO | WO 2008/143467 | A2 | 11/2008 |
| WO | WO 2009/122123 | A1 | 10/2009 |
| WO | WO 2010/039482 | A2 | 4/2010 |

OTHER PUBLICATIONS

Office Action dated Sep. 22, 2014 in connection with Chinese Patent Application No. 201180037054.X.
International Search Report dated Dec. 6, 2013 in connection with International Patent Application No. PCT/US13/52761.
Written Opinion of the International Searching Authority dated Dec. 6, 2013 in connection with International Patent Application No. PCT/US13/52761.
Description of Relevance for Submission Under 35 U.S.C. 122(e) dated Sep. 16, 2014 filed in connection with U.S. Appl. No. 13/954,762.
International Search Report dated Nov. 23, 2011 in connection with International Patent Application No. PCT/US2011/038639.
Written Opinion of the International Searching Authority dated Nov. 23, 2011 in connection with International Patent Application No. PCT/US2011/038639.
Examination Report dated Jul. 16, 2013 in connection with New Zealand Patent Application No. 603889.
International Search Report dated Dec. 6, 2013 in connection with International Patent Application No. PCT/US2013/52761.
Written Opinion of the International Searching Authority dated Dec. 6, 2013 in connection with International Patent Application No. PCT/US2013/52761.
Office Action dated Apr. 7, 2014 in connection with U.S. Appl. No. 13/149,685.
Partial European Search Report dated Jul. 10, 2015 in connection with European Patent Application No. EP 15 15 8290.
Office Action dated Jun. 9, 2015 in connection with Chinese Patent Application No. 201180037054.X.
Supplementary European Search Report dated Jul. 5, 2016 in connection with European Patent Application No. 13825564.1, 6 pages.
Supplementary European Search Report dated Nov. 8, 2016 in connection with European Patent Application No. EP 13 82 5564.

* cited by examiner
† cited by third party

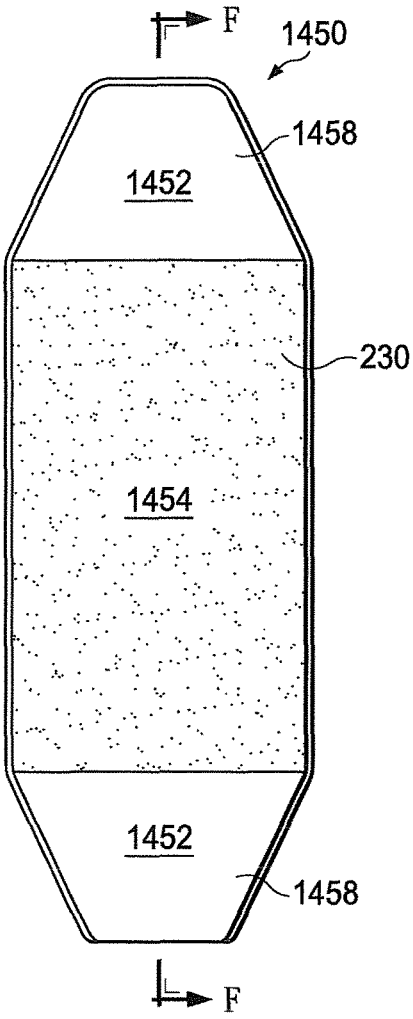
FIG. 14C
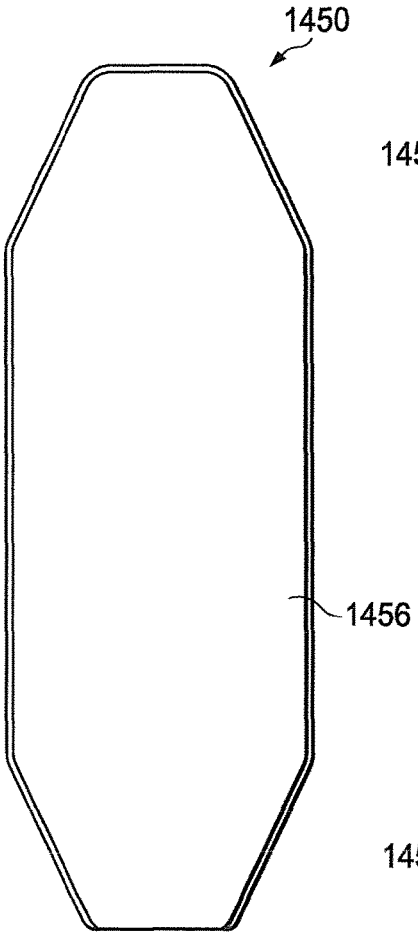
FIG. 14D
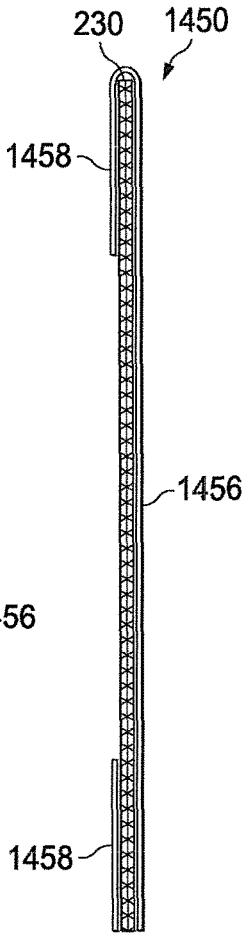
FIG. 14F
FIG. 14E
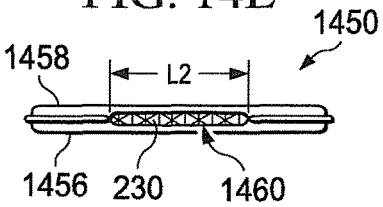

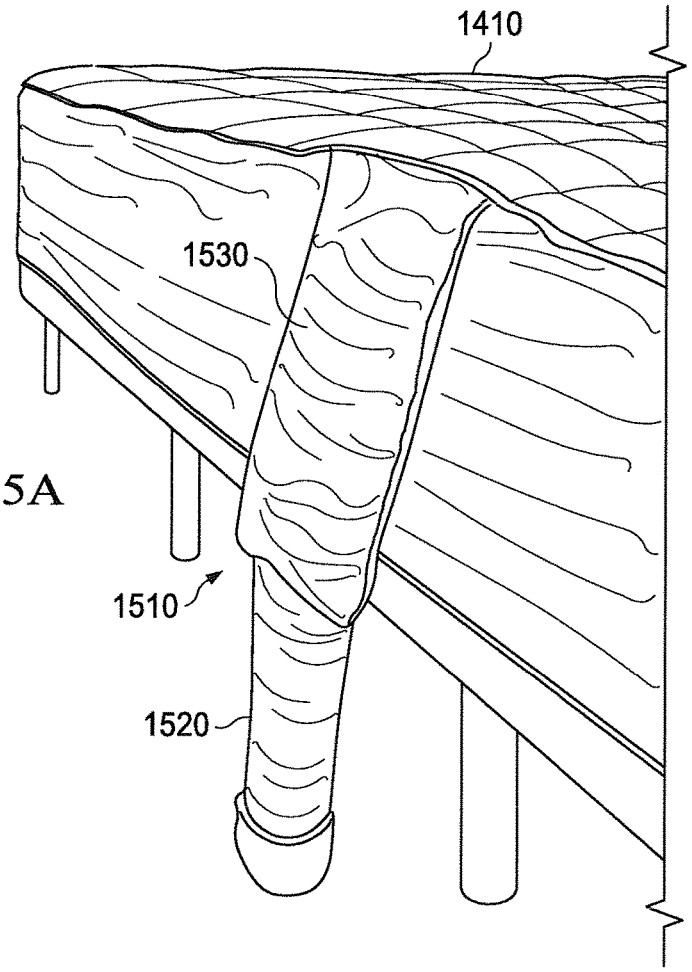
FIG. 15A
FIG. 15B
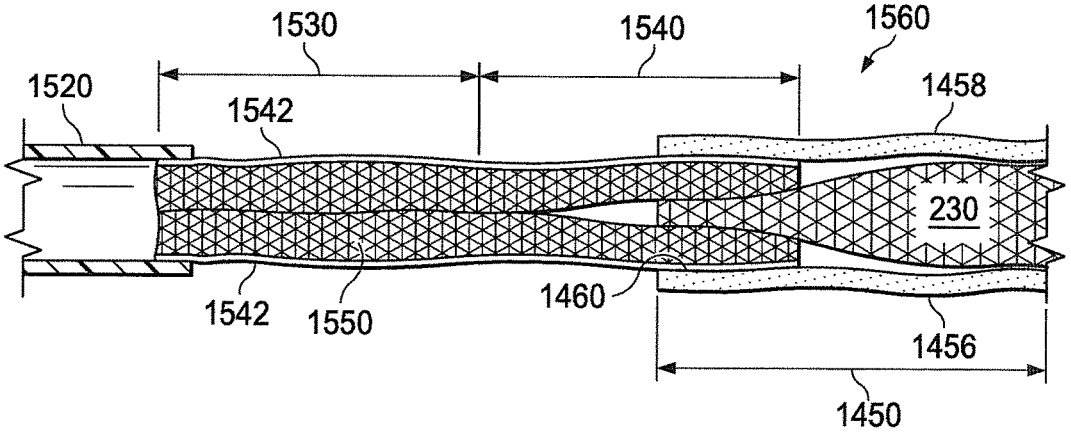

TABLE 1.0

| RH | SET TEC PWM (CONDITION) | ADJUSTED TEC PWM (HIGHEST OPERATING PWM) DURING OPERATING MODE |
|---|---|---|
| RH<45% | | 100% |
| 45%<RH<55% | PWM > 95% | 95% |
| 55%<RH<60% | PWM > 95% | 90% |
| 60%<RH<65% | PWM > 95% | 85% |
| 65%<RH<70% | PWM > 85% | 80% |
| 70%<RH<80% | PWM > 80% | 70% |
| 80%<RH<85% | PWM > 50% | 50% |
| 85%<RH<90% | PWM > 25% | 25% |
| 90%<RH<95% | PWM > 10% | 10% |
| RH>95% | - | 0% |

TABLE 1.1

| RH | ADJUSTED PWM FOR AXIAL FANS IN DRY MODE |
|---|---|
| RH < 30% | 25% |
| 30%<RH<35% | 40% |
| 35%<RH<38% | 50% |
| 38%<RH<45% | 65% |
| 45%<RH<50% | 75% |
| 50%<RH<55% | 80% |
| 55%<RH<60% | 90% |
| RH > 60% | 100% |

FIG. 18B

SYSTEM AND METHOD FOR THERMOELECTRIC PERSONAL COMFORT CONTROLLED BEDDING

CROSS-REFERENCE TO RELATED APPLICATIONS AND CLAIM FOR PRIORITY

The present application present application claims priority to U.S. provisional patent application Ser. No. 61/677,391 filed on Jul. 30, 2012 and U.S. provisional patent application Ser. No. 61/779,741 filed on Mar. 13, 2013, which are both incorporated herein by reference.

TECHNICAL FIELD

The present application relates generally to a user controlled personal comfort system and, more specifically, to a system and distribution method for providing ambient ventilation or using a thermoelectric heat pump to provide warm/cool conditioned air to products and devices enhancing an individual's personal comfort environment.

BACKGROUND

Many individuals can have trouble sleeping when the ambient temperature is too high or too low. For example, when it is very hot, the individual may be unable to achieve the comfort required to fall asleep. Additional tossing and turning by the individual may result in an increased body temperature, further exasperating the problem. The use of a conventional air conditioning system may be impractical due to the cost of operating the air conditioner, a noise associated with the air conditioner, or the lack of an air conditioner altogether. A fan may also be impractical due to noise or mere re-circulation of hot air. Of the above mentioned alternatives, all fail in their ability to directly remove or eliminate excess body heat from the bedding surface to body interface or, as conditions may require, add supplemental heating. Also, research indicates that varying an individual's temperature during the sleep process can facilitate and/or improve the quality of sleep.

SUMMARY

In accordance with one embodiment, there is provided a method for operating an air conditioning system configured to deliver conditioned air to a supporting apparatus. The method includes receiving user input and operating the air conditioning system according to an operation cycle, wherein during the operation cycle the air conditioning system generates conditioned air. During the operation cycle, relative humidity of the ambient air in which the air conditioning system is disposed is measured. Operation of one or more thermoelectric devices (TEDs) within the air conditioning system is adjusted in response to the measured relative humidity to control condensation generation within the air conditioning system.

In accordance with another embodiment, there is provided a thermoelectric-based air conditioning system for use with a bed or mattress. The system includes one or more fans for generating an air flow for delivery to the bed or mattress and one or more thermoelectric devices (TEDs) configured for conditioning the air flow. An ambient air humidity sensor is configured for sensing humidity of ambient air. A controller is coupled to the one or more fans and the one or more TEDs and configured to: receive a user input, control operation of the air conditioning system in accordance with an operation cycle in response to the user input, receive an ambient air humidity measurement from the humidity sensor during the operation cycle, and adjust operation of the one or more TEDs in response to the received ambient air humidity measurement to control condensate generated by operation of the one or more TEDs.

In yet another embodiment, there is provides an air conditioning system for conditioning air for use with a seat or bed. The system includes a housing having a heat transfer device disposed therein, one or more supply side fans for moving air through one or more air inlets within the housing into a supply side chamber where the air is conditioned by the heat transfer device and for moving the conditioned air through an air supply outlet within the housing, and one or more exhaust side fans for moving air through the one or more air inlets and into an exhaust side chamber where the air is conditioned by the heat transfer device and moving the conditioned air through one or more exhaust vents within the housing. The system further includes a removable air filter assembly coupled to the housing and configured for filtering air flowing into the one or more air inlets. The removable air filter assembly includes an air filter housing and air filter material. The air filter housing/assembly is removably attached to the housing an attachment structure.

Before undertaking the DETAILED DESCRIPTION OF THE INVENTION below, it may be advantageous to set forth definitions of certain words and phrases used throughout this patent document. The terms "application," "program," and "routine" refer to one or more computer programs, sets of instructions, procedures, functions, objects, classes, instances, or related data adapted for implementation in a suitable computer language. The term "couple" and its derivatives refer to any direct or indirect communication between two or more elements, whether or not those elements are in physical contact with one another. The terms "transmit," "receive," and "communicate," as well as derivatives thereof, encompass both direct and indirect communication. The terms "include" and "comprise," as well as derivatives thereof, mean inclusion without limitation. The term "or" is inclusive, meaning and/or. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like. The term "controller" means any device, system, or part thereof that controls at least one operation. A controller may be implemented in hardware, firmware, software, or some combination of at least two of the same. The functionality associated with any particular controller may be centralized or distributed, whether locally or remotely.

BRIEF DESCRIPTION OF THE DRAWINGS

For a more complete understanding of the present disclosure and its advantages, reference is now made to the following description taken in conjunction with the accompanying drawings, in which like reference numerals represent like parts:

FIGS. 14A through 14F illustrate a distribution system in accordance with one embodiment of the present disclosure;

FIGS. 15A through 15B illustrate an inlet duct structure for use in delivering an air flow to the distribution layer of FIGS. 2A-2H or the distribution system of shown in FIGS. 14A-14F;

FIG. 18A-1-18A-2 illustrates a flow diagram of an operational flow or process in accordance with the present disclosure; and FIG. 18B include two tables with various trigger or threshold points for adjusting TEC device operation during an operating mode and adjusting axial fan(s) operation during a drying mode.

DETAILED DESCRIPTION

FIGS. 1 through 18B, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged personal cooling (including heating) system. As will be appreciated, though the term "cooling" is used throughout, this term also encompasses "heating" unless the use of the term cooling is expressly and specifically described to only mean cooling.

The personal air conditioning control system and the significant features are discussed in the preferred embodiments. With regard to the present disclosure, the term "distribution" refers to the conveyance of thermal energy via a defined path by conduction, natural or forced convection. The personal air conditioning control system can provide or generate unconditioned (ambient air) or conditioned air flow (hereinafter both referred to as "air flow" or "air stream"). The air flow may be conditioned to a predetermined temperature or proportional input power control, such as an air flow dispersed at a lower or higher than ambient temperature, and/or at a controlled humidity. In addition, heat sinks/sources that are attached, or otherwise coupled, to a thermoelectric engine/heat pump core (TEC) surface that provide conditioned air stream(s) to the distribution layer will be referred to as "supply sink/source". Heat sinks/sources that are attached, or otherwise coupled, to a TEC surface that is absorbing the waste energy will be referred to as "exhaust sink/source". In other words, the terms "sink" and "source" can be used interchangeably herein. Passive cooling refers to ambient air (forced) only cooling systems without inclusion of an active heating/cooling device.

Figure 1:
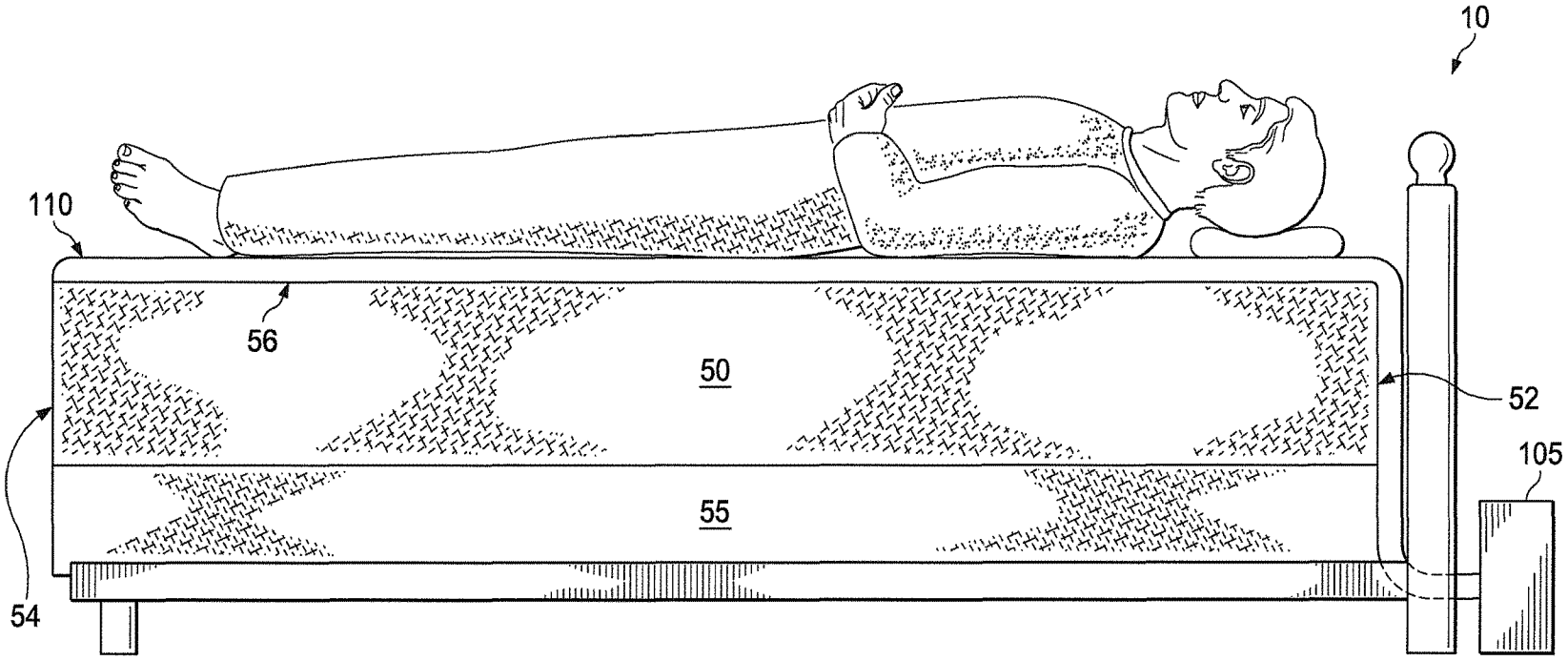
FIG. 1 illustrates a bed that includes a personal comfort system according to embodiments of the present disclosure.

FIG. 1 illustrates a bed 10 that includes a personal comfort system 110 according to embodiments of the present disclosure. The embodiment of the bed 10 having the personal comfort system 100 shown in FIG. 1 is for illustration only and other embodiments could be used without departing from the scope of this disclosure. In addition, the bed 10 is shown for example and illustration; however, the following embodiments can be applied equally to other systems, such as, chairs, sleeping bags or pads, couches, futons, other furniture, apparel, blankets, and the like. In general, the embodiments of the personal comfort system are intended to be positioned adjacent a body to apply an environmental change on the body.

In the examples shown in FIG. 1, the bed 10 includes a mattress 50, a box-spring/platform 55 and the personal comfort system 100. The personal comfort system 100 is shown including a personal air conditioning control system 105 and a distribution structure or layer 110. The personal air conditioning control system 105 includes one or more axial fans or centrifugal blowers, or any other suitable air moving device(s) for providing air flow. In other embodiments, the personal air conditioning system 105 may include a resistive heater element or a thermal exchanger (thermoelectric engine/heat pump) coupled with the axial fan or centrifugal blower to provide higher/lower than ambient temperature air flow.

Hereinafter, the system(s) will be described with reference to "conditioned air," but it will be understood that when no active heating/cooling device(s) are utilized, the conditioned air flow is actually unconditioned (e.g., ambient air without increase/decrease in temperature).

As shown, the personal comfort system 100 includes a distribution layer 110 coupled to the personal air conditioning control system 105. The distribution layer 110 is adapted to attach and secure to the mattress 50 (such as a fitted top sheet), and may also be disposed on the surface of the mattress 50 and configured to enable a bed sheet or other fabric to be placed over and/or around the distribution layer 110 and the mattress 50. Therefore, when an individual (the user) is resting on the bed 10, the distribution layer 110 is disposed between the individual and the mattress 50.

The personal air conditioning control system 105 delivers conditioned air to the distribution layer 110 which, in turn, carries the conditioned air in channels therein (discussed in further detail below with respect to FIGS. 2A-3C). The distribution layer 110 enables and carries substantially all of the conditioned air from a first end 52 of the mattress 50 to a second end 54 of the mattress 50. The distribution layer 110 may also be configured or adapted to allow a portion of the conditioned air to be vented, or otherwise percolate, towards the individual in an area substantially adjacent to a surface 56 of the mattress 50.

Figure 14A:
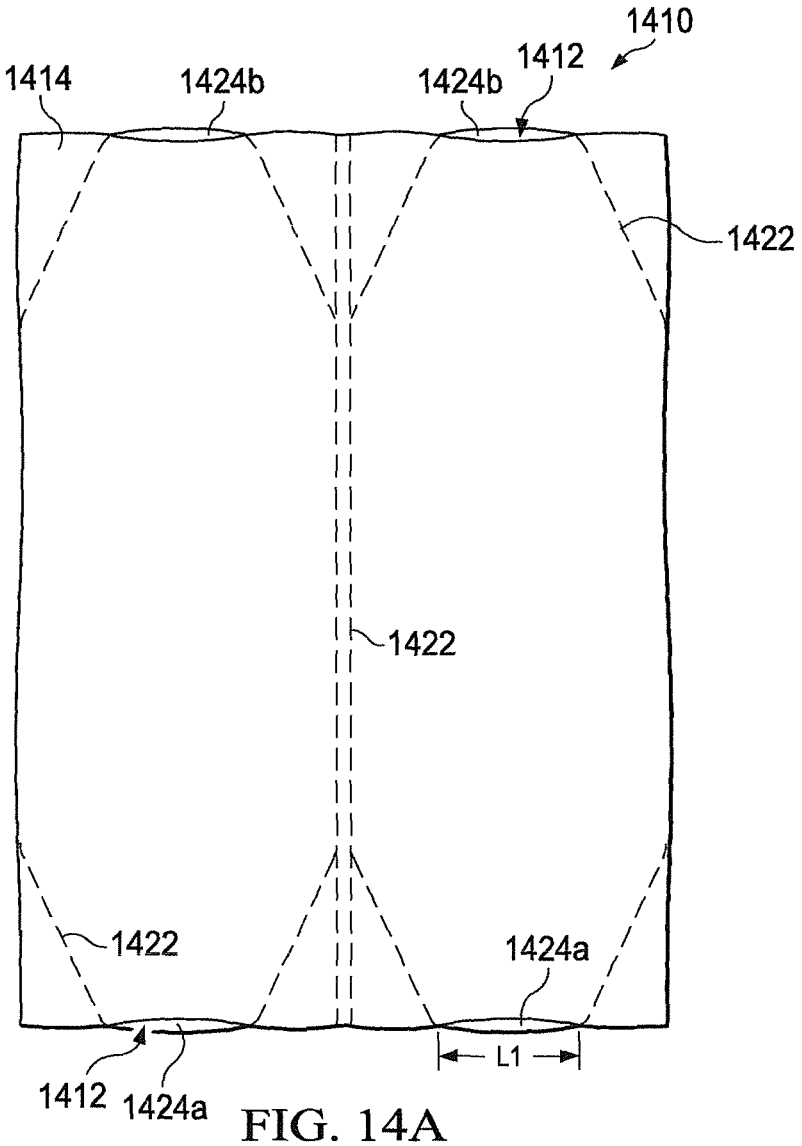
Figure 14B:
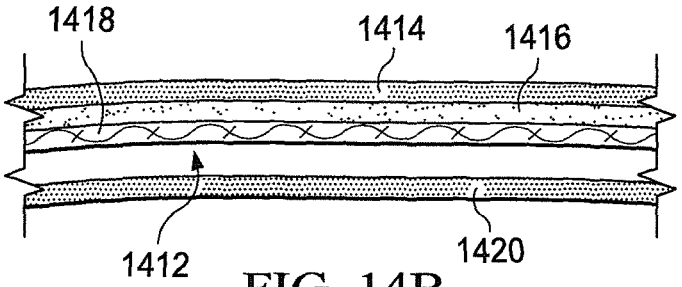

It will be understood that the geometry of the distribution layer 110 coincides with all or substantially all of the geometry (or a portion of the geometry) the mattress 50. The distribution layer 110 may include two (or more) substantially identical portions enabling two sides of the mattress to be user-controlled separately and independently. In other embodiments, the system 100 may include two (or more) distinct distribution layers 110 similarly enabling control of each separately and independently. For example, on a queen or king size bed, two distribution layers 110 (as shown in FIGS. 2A-3C, below) or two spacer fabric panels 1450 (as shown in FIGS. 14A-14C, below) may be provided for each half of the bed. Each may be controlled with separate control units or with a single control unit, and in another embodiment, may be remotely controlled using one or two handheld remote control devices (as described more fully below).

FIGS. 2A through 2E illustrate an example distribution layer 110 according to embodiments of the present disclosure. The embodiments of the distribution layer 110 shown in FIGS. 2A through 2E are for illustration only and other embodiments may be used without departing from the scope of this disclosure.

The distribution layer 110, when utilized in conjunction with the personal air conditioning control system 105, is designed to provide a personal comfort/temperature controlled environment. With respect to bedding applications, the distribution layer 110 may also be formed as a mattress topper or a mattress blanket, and may even be integrated within other components to form the mattress. In another embodiment described further below, the distribution layer 110 (or a differently constructed distribution layer) may be a separate stand-alone component that is inserted or placed within a mattress topper or mattress quilt (similar to a fitted sheet). In other applications, the system may be a personal body cooling/warming apparatus, such as a vest, undergarment, leggings, cap or helmet, or may be included in any type of furniture upon which an individual (or a body) would sit, rest or lie.

Distribution layer 110 is adapted for coupling to the personal air conditioning control system 105 to provide an ambient temperature, warm temperature or cool temperature conditioned air stream that creates an environment for the individual resulting in reduced blower/fan noise by controlling back pressure exerted on the blower/fan by the air stream while maximizing the amount of temperature uniformity across the exposed surface area(s). The distribution layer 110 is able to provide warming and cooling conductively (when a surface of the distribution layer 110 is in physical contact with the body) and convectively (when the air circulates near the body). In either manner, a thermal transfer or exchange occurs from/to the conditioned air within the distribution layer 110. The distribution layer 110 operates to conduct a stream of conditioned air down a center of the mattress 50, along the sides of the mattress 50, at any of the corners of the mattress 50, or any combination thereof. The conditioned air is pushed, pulled or re-circulated (or combination thereof) by the personal air conditioning control system 105.

The distribution layer 110 may be utilized in different heating/cooling modes. In a passive mode, the distribution layer 110 includes an air space between the user and the top of the mattress which facilitates some thermal transfer. No active devices are utilized. In a passive cooling mode, one or more fans and/or other air movement means cause ambient air flow through the distribution layer 110. In an active cooling/heating mode, one or more thermoelectric devices are utilized in conjunction with the fan(s) and/or air movement devices. One example of a thermoelectric device is a thermoelectric engine or cooler. In an active cooling with resistive heating mode, one or more thermoelectric devices are utilized for cooling in conjunction with the fan(s) and/or air movement devices. In this same mode, a resistive heating device is introduced to work with fan(s) and/or air movement devices to enable higher temperatures. This mode may also utilize a thermoelectric device. The resistive heating device may be a printed circuit trace on a thermoelectric device, a PTC (positive temperature coefficient) type device, or some other suitable device that generates heat.

As will be understood by those skilled in the art, each of the personal air conditioning control systems described herein may be utilized in any of the different heating/cooling modes: passive (the system 105 would be inactive), passive cooling, active cooling/heating, and active cooling with resistive heating.

In one embodiment, the distribution layer 110 is adapted to be washable or sanitizable, or both. The distribution layer 110 may also be adapted or structured to provide support to the individual, resistance to crushing and/or resistance to blocking of the air flow.

Figure 2A:
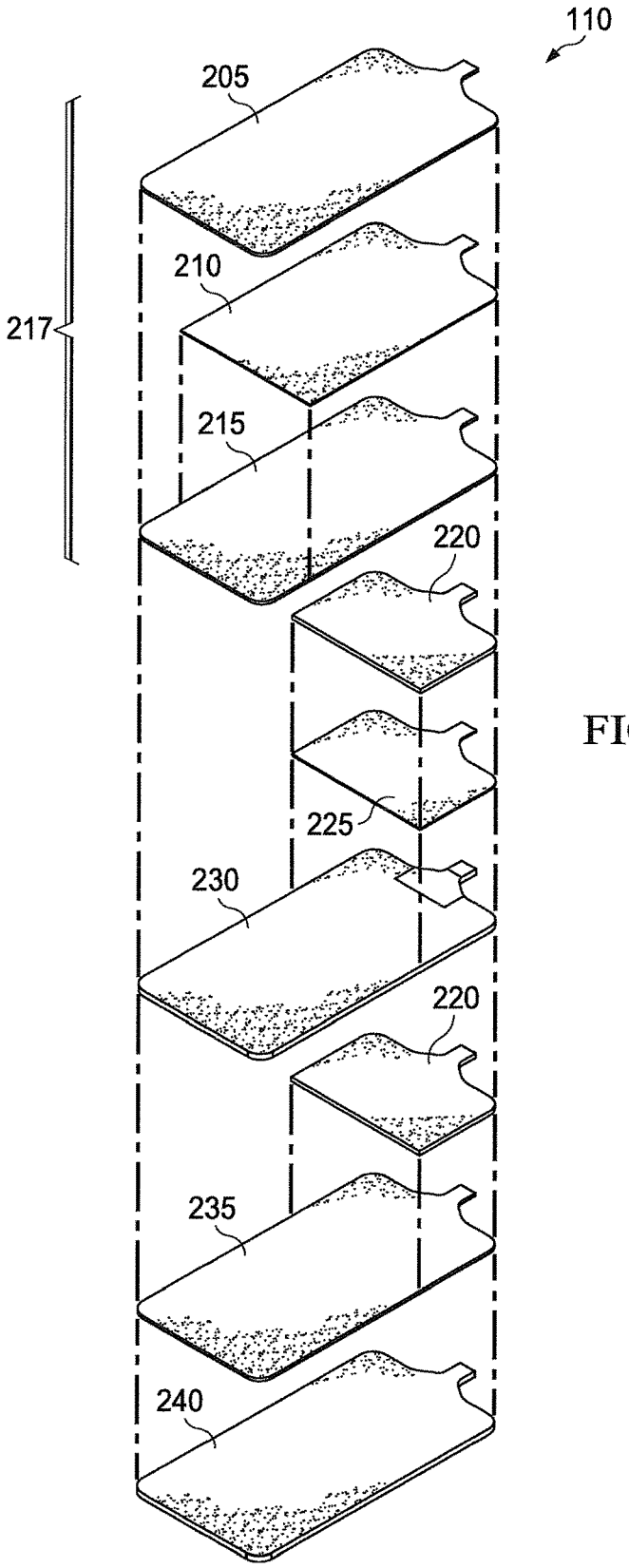
FIGS. 2A through 2H illustrate examples of an air distribution layer according to embodiments of the present disclosure.

In the embodiment shown in FIG. 2A, the distribution layer 110 is formed of a number of layers, including a comfort layer 205, a semi-permeable layer 210 and an insulation layer 215. Since the comfort layer 205 is disposed closest to a body, it generally includes any suitable fabric as known or developed and selected based on softness, appearance, odor retention or moisture control. The comfort layer 205 is beneficially constructed to provide high air permeability and adequate comfort which increases the effects of the conditioned air. In one embodiment, the permeability of the semi-permeable layer 210 includes an overall air permeability in a range of 1-20 cfm (measured in $ft^3/ft^2/min$ by ASTM D737 with vacuum settings mathematically equivalent to a 30 mile per hour wind). In another embodiment, the semi-permeable layer 210 includes a preferred air permeability in a range of 1-12 cfm. The insulation layer 215 can be highly air permeable and helps to provide increased temperature uniformity across the distribution layer 110.

As will be appreciated, the comfort layer 205, the semi-permeable layer 210 and the insulation layer 215 (and in other embodiments, an insulation layer 220 and/or impermeable layer 225) can be combined to form an integrated permeability layer denoted by reference numeral 217. This integrated semi-permeability layer 217 (formed of layers 205, 210, 215) functions to provide insulation from ambient thermal load and may have a defined or measurable overall air permeability and moisture vapor permeability. In one embodiment, the integrated semi-permeability layer 217 includes an overall air permeability in a range of 1-20 cfm (measured in $ft^3/ft^2/min$ by ASTM D737 with vacuum settings mathematically equivalent to a 30 mile per hour wind). In another embodiment, this integrated semi-permeability layer 217 includes a preferred air permeability in a range of 1-12 cfm.

The distribution layer 110 may optionally include an additional insulation layer 220 (similar in function to the layer 215) adjacent the semi-permeability layer 217 and an impermeable layer 225. These layers (insulation layer 220 and impermeable layer 225) shown in FIG. 2A are smaller and are utilized due to this area's exposure to ambient conditions at the head of the bed, sheets and covers. These may also be utilized at the foot of the bed, if desired.

A spacer structure (or layer) 230 is located adjacent to the insulation layer 215 (and the impermeable layer 225, if provided). The spacer structure 230 functions to perform a spacing function and creates a volume for fluid to flow through. In one embodiment, the spacer structure 230 includes a crushed fabric or a three dimensional (3D) mesh material. Other suitable materials that are capable of performing spacing/volume/fluid flow function(s) may be utilized. As will be appreciated, various "fluids" may be utilized in thermal transfers, and the term "fluid" may include air, liquid, or gas. Though the teachings and systems of the present disclosure are described with respect to air as the fluid, other fluids might be utilized. Thus, references herein to "air" are non-limiting, and "air" may be substituted with other fluids.

Positioned adjacent to the spacer structure 230 are a second insulation layer 235 and another impermeable layer 240. The insulation layer 235 can be highly air permeable and helps to provide increased temperature uniformity across the distribution layer 110. The impermeable layer 240 may include material(s) having a relatively low permeability (e.g., less than 2 cfm) or a permeability of zero cfm. The impermeable layer 240 can include material(s) having characteristics or functions such including a soft hand feel, moisture vapor impermeability and/or water resistance.

Figure 2B:
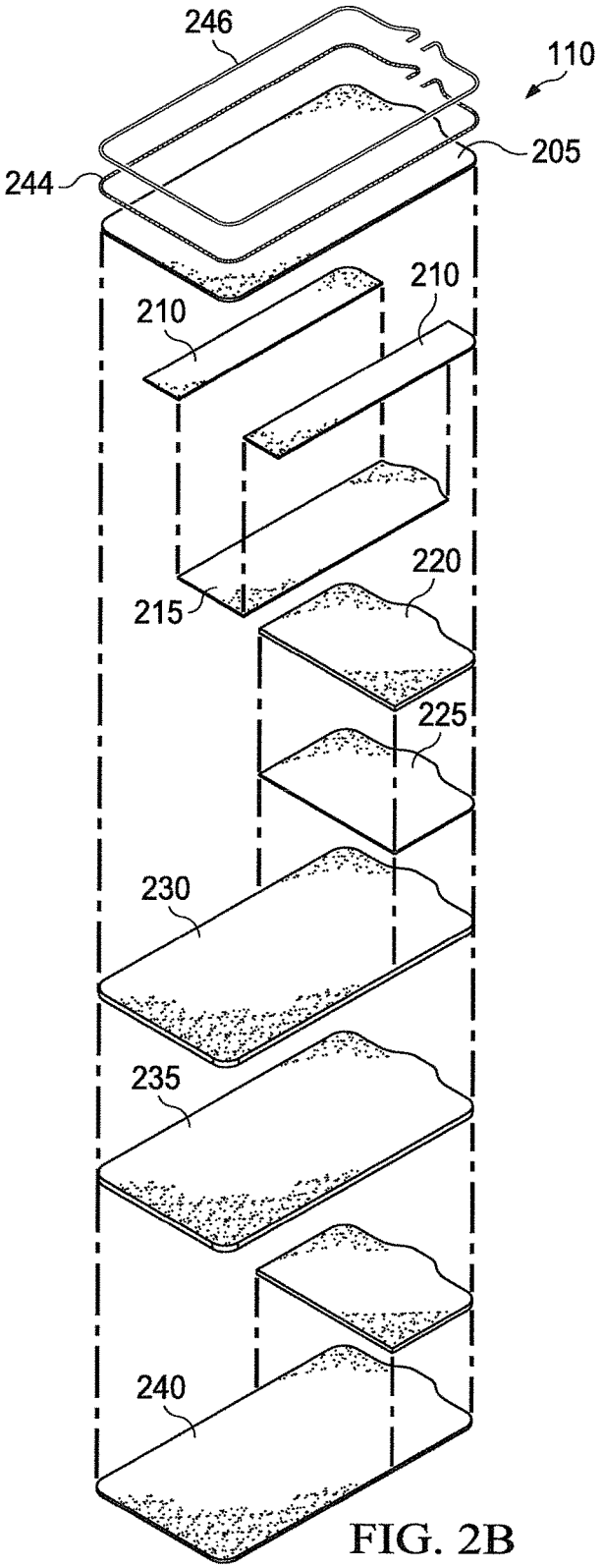

The spacer structure 230 is disposed between a set (one or more) of the top layers (formed by layers 205-225) and a set (one or more) of the bottom layers (formed by layers 235-240). Turning to FIG. 2B, the top layers 205-225 and the bottom layers 235-240 are bound together so as to capture the top layers, bottom layers and the spacer structure 230 to form an overall structure—distribution layer 110. The multiple layers can be bound by a surged edge 244, a tapered edge 246 or a combination thereof. Other suitable binding means may be utilized. The binding of the top layers 205-225 and the bottom layers 235-240 enables the conditioned air to move through the spacer structure 230 from one end to the other end without escaping through the lateral (bounded) sides.

In some embodiments, the top layers 205-225 include various air permeabilities with specific cut patterns (not shown) in the surface to maximize delivery of conditioned air to the individual. For example, the cut patterns (not shown) can be contoured to a shape corresponding to the individual lying on their back. In addition the cut pattern can be a triangular trapezoid with the larger end of the triangular shape at the individual's shoulders and extending from the individual's shoulders to their calves.

Figure 2C:
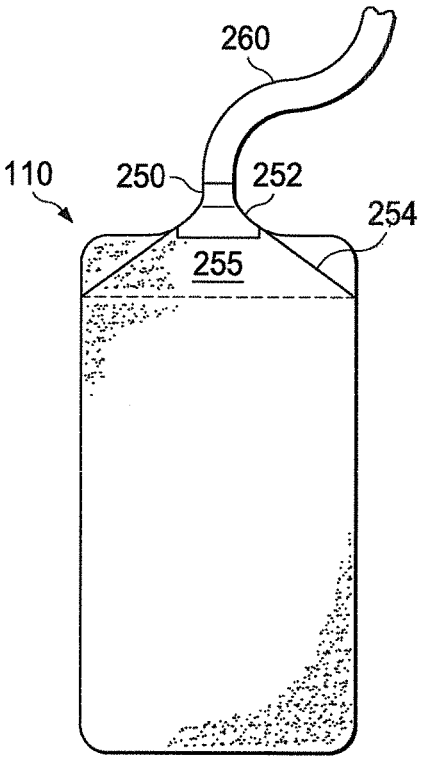

Turning to FIG. 2C, the distribution layer 110 includes an inlet 250, a first inlet region 252 and a second inlet region 255. The inlet 250 is adapted for coupling to the personal air conditioning control system 105 via an insulated hose 260. The inlet 250 may include a tube attachment (not shown), threading, or other coupling means, that can couple the distribution layer 110 to the hose 260. In other embodiments, the distribution layer 110 may include multiple inlets 250, while the hose 260 may include the inlet 250.

The inlet region 255 is adapted to enable conditioned air received through the inlet 250 to be directed and/or dispersed throughout the distribution layer 110. This may be accomplished through the use of stitches or other binding means positioned along lines 254. The inlet region 255 portion of the distribution layer 110 is positioned to extend along the top surface 56 at either the head or foot of the mattress 50. This extension may range from about six to about twenty inches. Alternatively, the inlet region 255 portion may extend downward from the surface 56 at the edge of the mattress 50.

As the conditioned air is received via the inlet 250, the conditioned air expands via the inlet regions 252 and 255 to move through the distribution layer 110. The inlet regions 252 and 255 help mitigate noise resulting from an air blower or air movement device (e.g., fan) in the personal air conditioning control system 105 by muffling and dispersing the conditioned air flow. In the embodiment shown, the inlet region 252 extends past the edge of the top surface 56 of the mattress 50 downward along a vertical side of the mattress 50 (see, FIG. 1). This extension can be triangular as shown in FIG. 2C or may be rectangular.

Figure 2D:
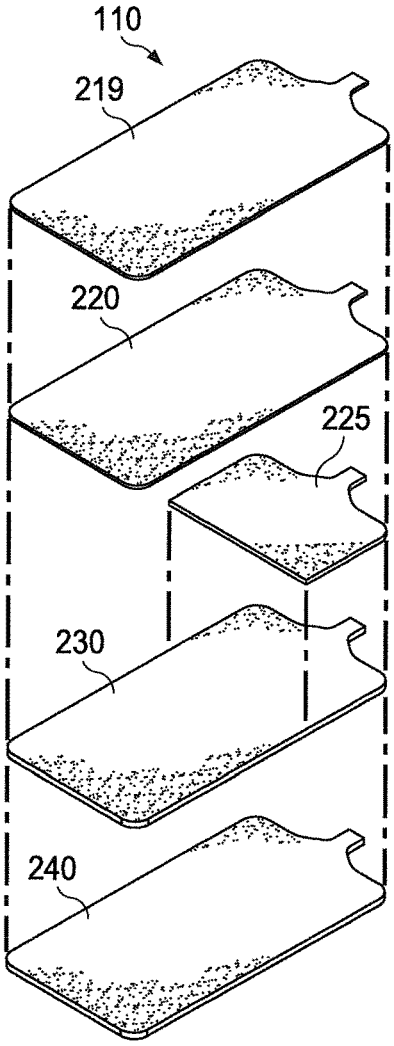

In the example shown in FIG. 2D, the distribution layer 110 includes a single semi-permeable layer 219, the insulation layer 220, the impermeable layer 225, the spacer structure 230 and a bottom impermeable layer 235. The single semi-permeable layer 219 is formed of material having a permeability in the range of about 1-20 cfm, with one embodiment having permeability of between about 1-12 cfm. The additional impermeable layer 225 prevents air flow up through the layers 220 and 219 until the air has passed the region defined by the inlet region 255 (the extension). Portions of the spacer structure 230 may or may not be included in the area at the head of the bed 50 (where a pillow would be located) which is defined generally by the area of the inlet region 255. The bottom impermeable layer 240 can have a relatively low permeability or a permeability of zero cfm.

Figure 2E:
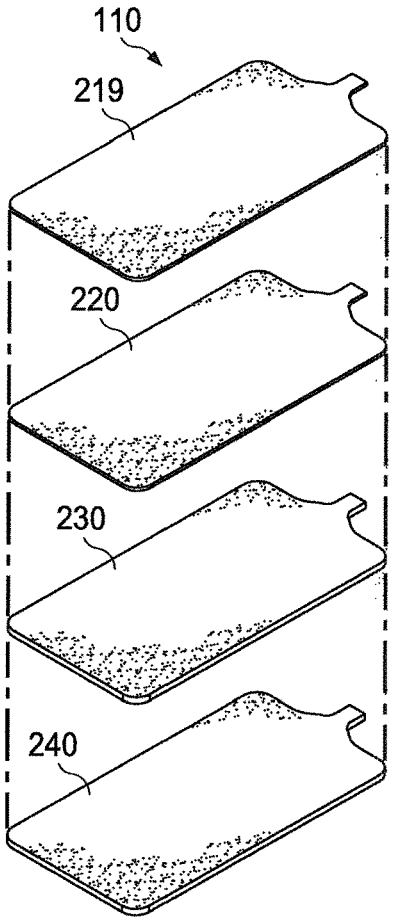

Now turning to the embodiment illustrated in FIG. 2E, the impermeable layer 225 is omitted. This results in the additional exposure of the insulation layer 220 to ambient air in a region where the individuals' pillow and head would likely be positioned; this region is defined by the inlet region 255.

In some embodiments, the distribution layer 110 may only include a top layer (impermeable to semi-permeable), the spacer structure 230 and a bottom impermeable layer 240.

Figure 2F:
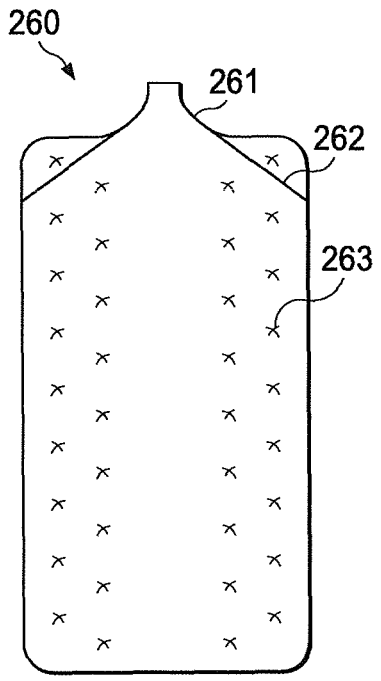
Figure 2G:
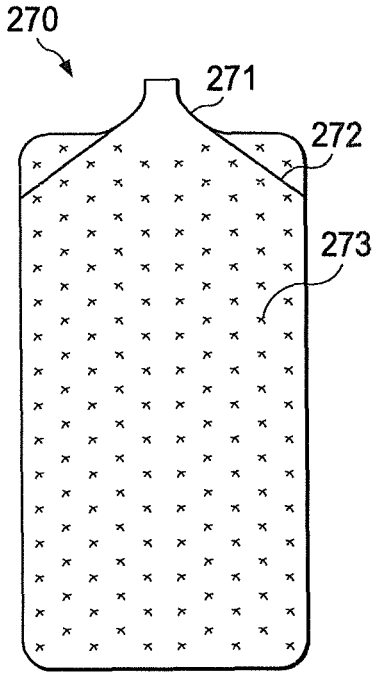
Figure 2H:
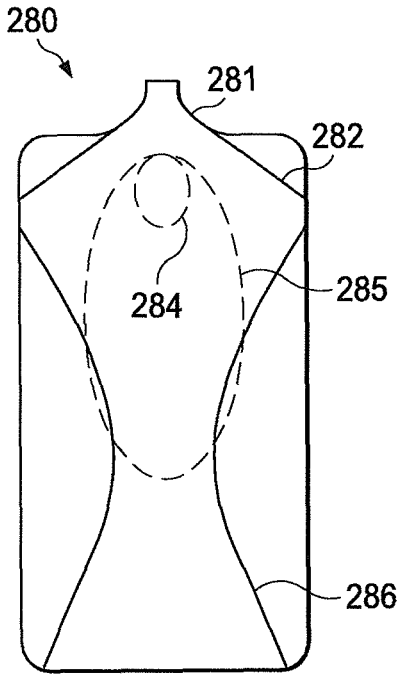

FIGS. 2F through 2H illustrate further example embodiments of the personal comfort system. As shown in FIG. 2F, for example, system 260 is similar in most respects to system 100 shown in FIG. 2C. Thus, system 100 includes inlet region 261 and stitch lines 262. Stitch lines 262, among other things, preferably prevent air from moving into the back corners of the apparatus. The back corners are those areas upward and to the left and right, respectively, from the inlet region as shown in FIG. 2F. As also shown, system 100 includes tack sewn nodes 263. In this particular embodiment, there are four rows of nodes that extend longitudinally along the apparatus. In two adjacent rows (e.g., the two rows to the left of the apparatus longitudinal centerline), the nodes 263 of one row are offset from the nodes of the adjacent row. The nodes 263 are preferably equally spaced apart. Preferably, the space between adjacent nodes (horizontally and/or diagonally) is not greater than about ten inches, and may range from about four to ten inches. It should be understood, however, that the spacing and layout of tack sewn nodes may be modified as desired, the illustrated arrangement is an example only, and any suitable spacing and/or layout may be utilized.

The centerline area is void of nodes 263, and this area may range from about four to about twenty inches wide.

The nodes 263 preferably bind all of the layers of the apparatus. That is, the tack connects all layers to one another at the respective tack location. It should be further understood, however, that this configuration may be modified. Thus, any particular tack sewn node 263 may connect fewer than all of the layers. Further, a node may connect two or more respective layers while providing any desirable spacing at the node location. Therefore, while a node may connect two layers, the spacing between those two layers may range from the layers contacting one another (no spacing) to some predetermined spacing depending on the desired result.

Figures 1, 18A:
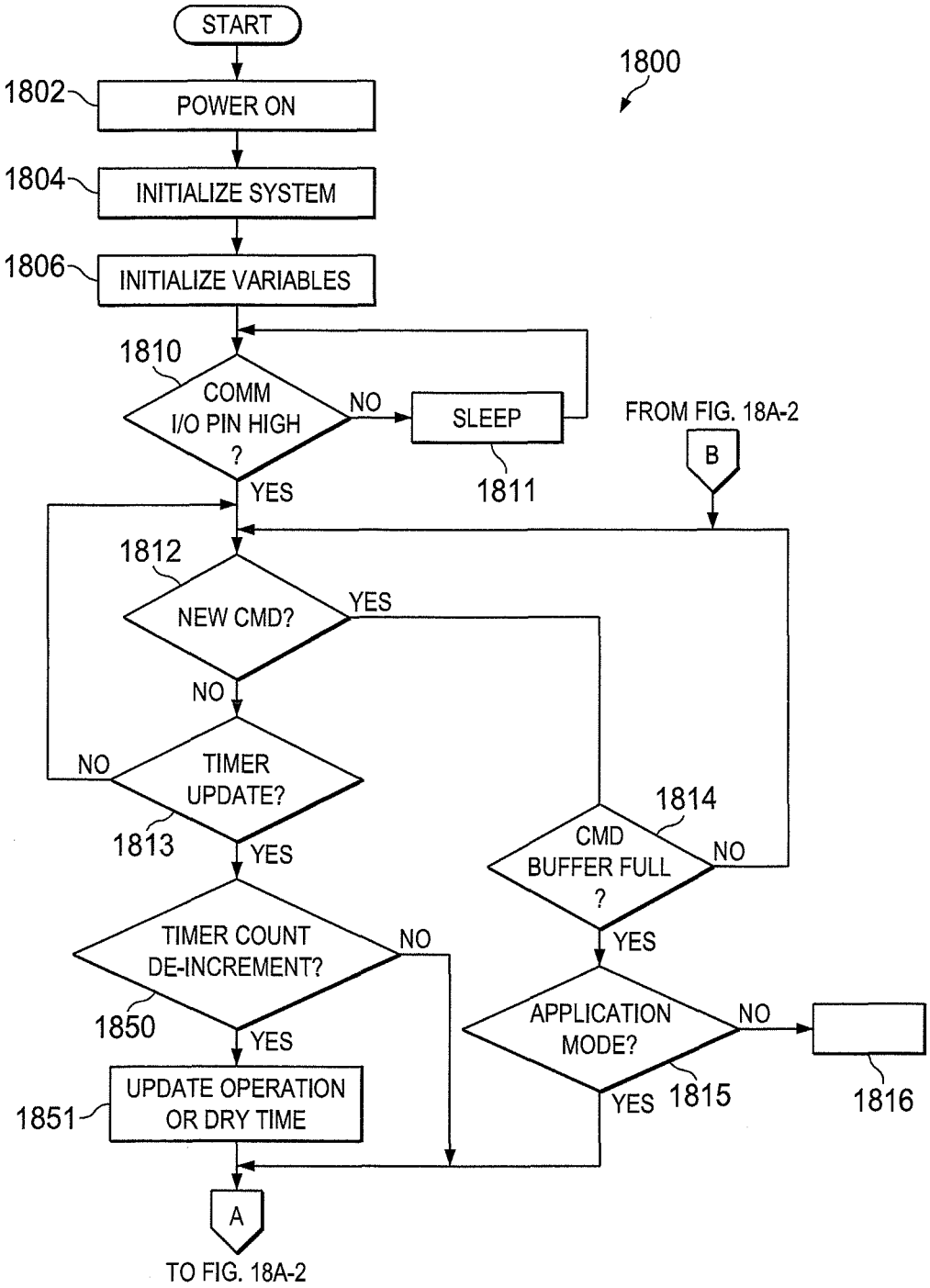
Figures 2, 18A:
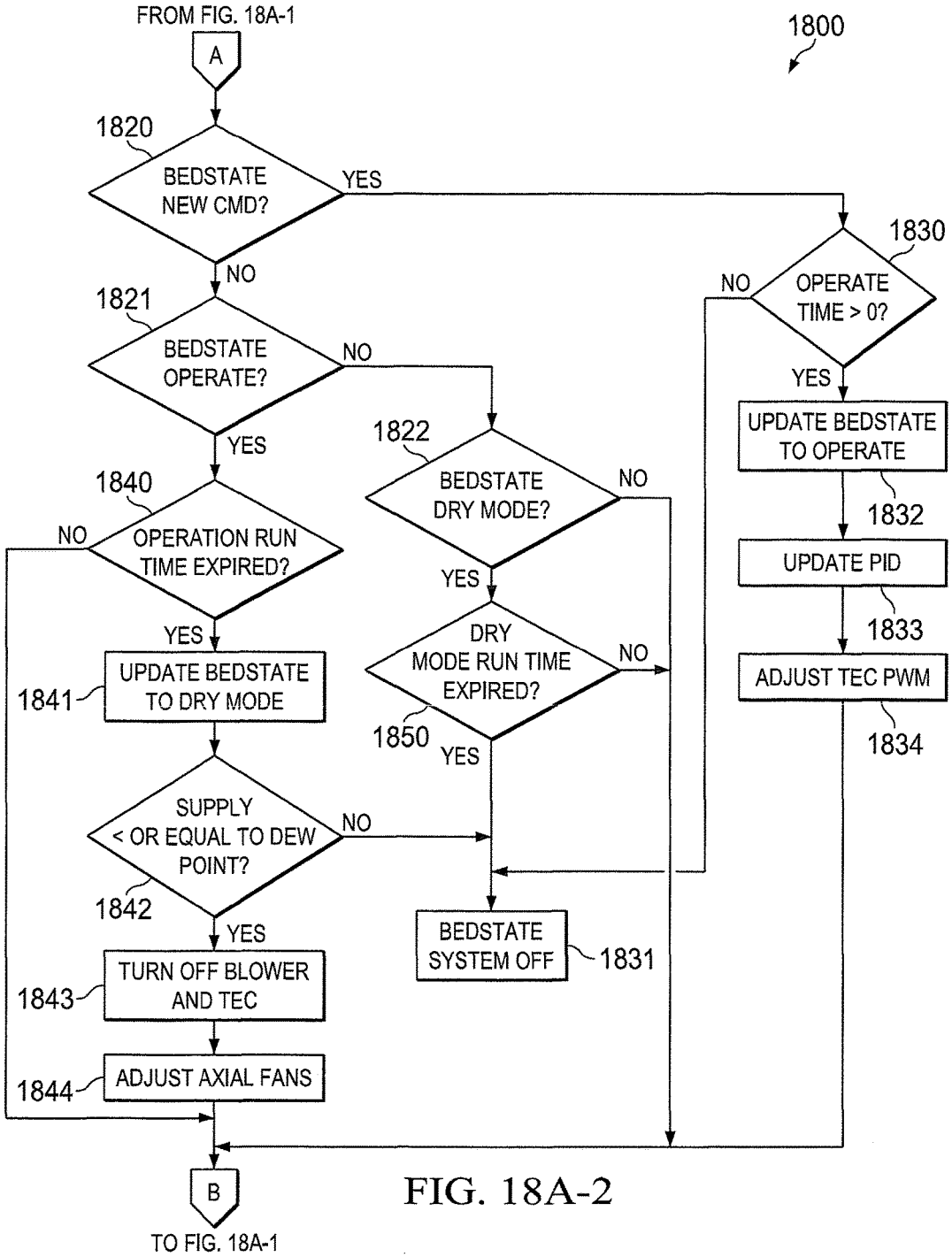

Further, the tack sewn quilting illustrated in FIG. 2 may be accomplished by any suitable technique. In one example, the tack sewn quilting is accomplished by using a single needle quilting machine. Accordingly, the tack sewn node pattern is created as the apparatus materials are fed through a continuous roll feed quilting machine. Of course, other techniques may be employed.

FIG. 2G illustrates a modified version of the apparatus. System 270 includes inlet region 271 and stitch lines 272. These features are similar to those described elsewhere in connection with other embodiments. System 270 also includes tack sewn nodes 273. These may be created as described elsewhere and may serve a similar purpose. As illustrated in FIG. 2G, nodes 273 are shown in a slightly different pattern. In this particular embodiment, the horizontal and vertical spacing between adjacent nodes 273 can range between about 2 inches to about 6 inches and the diagonal spacing between nodes 273 can range between about 3 inches to about 8 inches. Spacing between the adjacent nodes to the immediate left and right of the centerline may be slightly different than the spacing of the other adjacent nodes. Thus, in the illustrated example in FIG. 2G, the spacing between a node immediately left of the longitudinal centerline from a node immediately right of the longitudinal centerline can range from about 4 to about 15 inches, and may be about six inches in one embodiment. As indicated above, however, the relative spacing, number of rows and columns, overall pattern, etc. of the nodes may be varied as desired.

As shown in FIG. 2H, another example apparatus is illustrated. System 280 includes inlet region 281 and stitch lines 282. These features are similar to those described elsewhere. Dashed oval 284 is provided to illustrate an example head position of a user. Likewise, dashed oval 285 is provided to illustrate an example body position of a user. System 280 may include tack sewn nodes (not expressly shown) as described elsewhere. A pair of opposed stitch lines 286 may also be provided. Preferably, the stitch lines 286 are curved to each begin and end at points near or at the respective side edges of the apparatus, while the middle portions of the stitch lines extend toward the longitudinal centerline of the apparatus. Furthermore, the configuration of the stitch lines is such as to create a channel to allow air between the stitch lines and prohibit airflow outside of the channel. Thus, air flow is allowed primarily in a central region of the apparatus in an area corresponding to the location of the user's body. Similarly, air flow is not allowed in areas to the left and right of the user's body. Thus, air flow is not wasted in regions where flow is not needed to provide comfort. Of course, it will be understood that stitch lines may be used to create channels in any number of configurations based on a variety of factors such as mattress size, number of users, typical position of users, air flow capacities and requirements, etc. Also, the channels may be created by stitch lines that have any of a variety of configurations. Thus, while the stitch lines shown in FIG. 2H are opposing curves, the stitch lines may be straight, may form different geometric shapes, and/or may be positioned different from the stitch lines 286 shown in FIG. 2H.

Figure 3A:
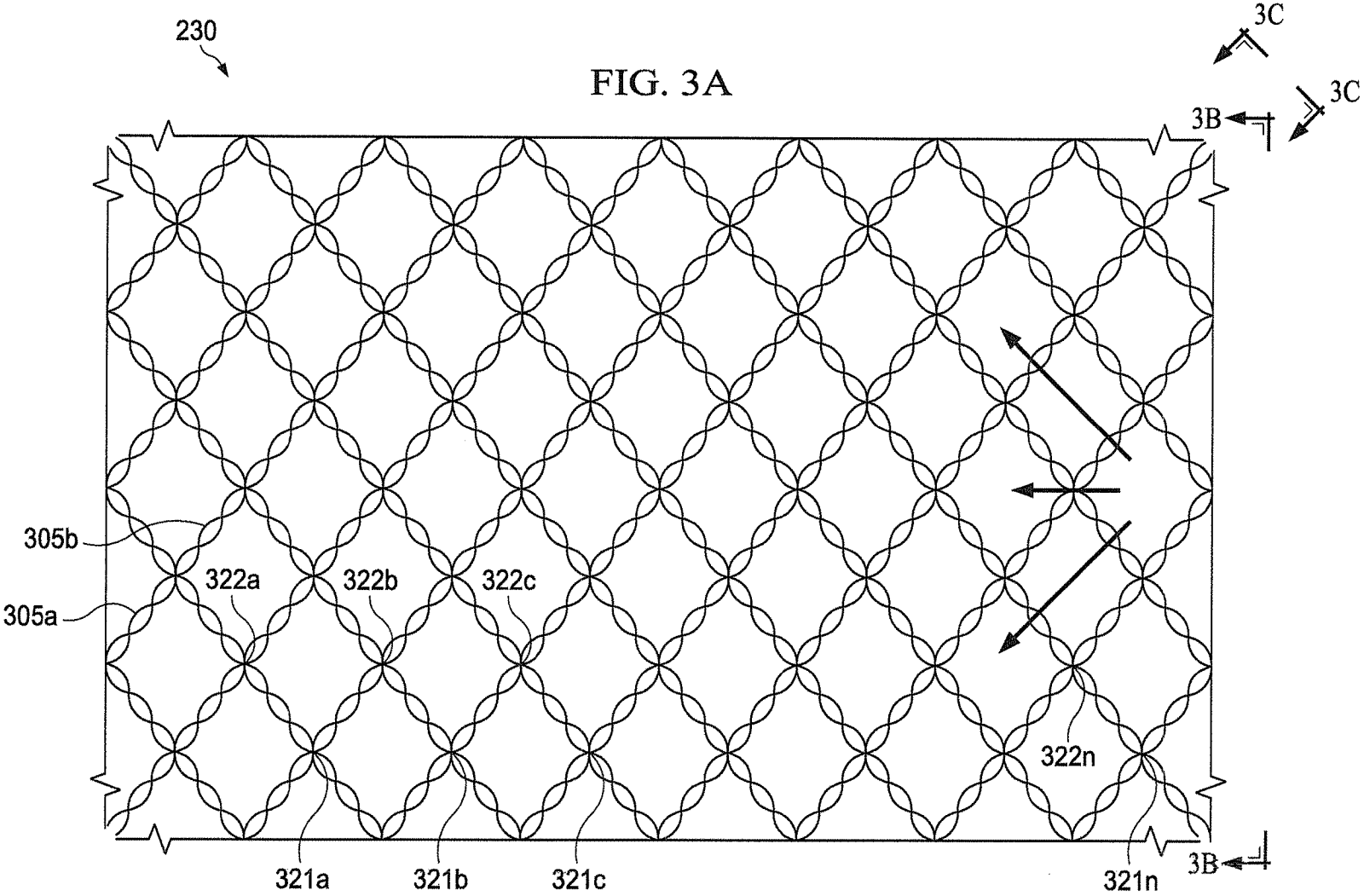
FIGS. 3A through 3C illustrate an example of a spacer structure according to embodiments of the present disclosure.
Figure 3B:
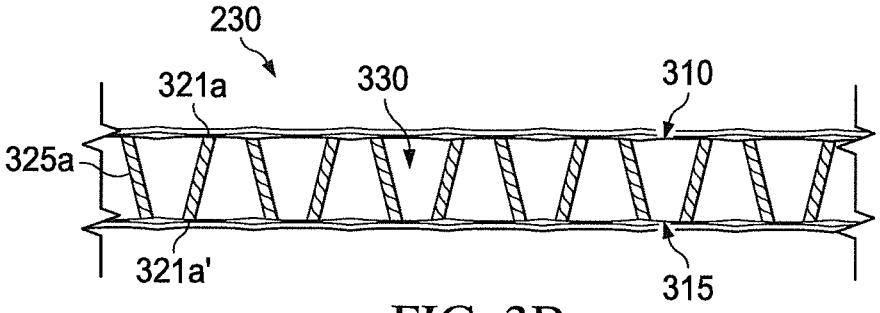
Figure 3C:
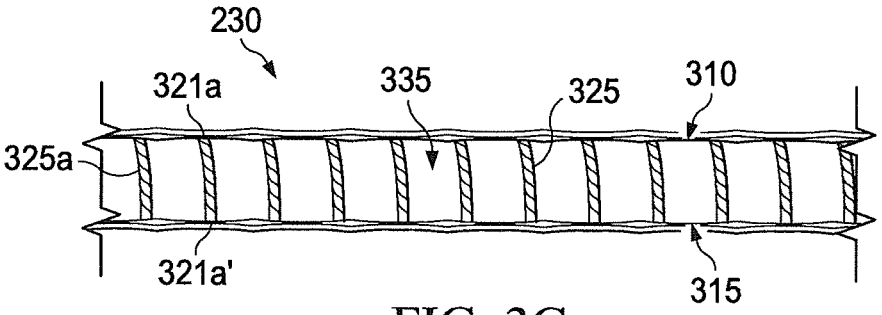

FIGS. 3A through 3C illustrate an example of the spacer structure 230 according to embodiments of the present disclosure. The embodiment of the spacer structure 230 shown in FIGS. 3A through 3C is for illustration only, and other embodiments could be used without departing from the scope of this disclosure.

The spacer structure 230 may be formed of a three-dimensional (3D) mesh fabric, such as Můller Textile article 5993, that is configured to provide reduced pressure drop and a number of discrete air flow paths down the length of the spacer structure 230.

The spacer structure 230 includes a number of strands 305*a*, 305*b* on the top surface (layer) 310 and the bottom surface (layer) 315. Each of the strands 305 can be composed of or otherwise include a plurality of fibers, such as a string, yarn or the like. The strands 305 traverse across a length of the spacer structure 230 in a crisscross pattern, as shown in the example illustrated in FIG. 3A. Each strand 305 is connected to an adjacent strand 305 at numerous points along the length of the spacer structure 230 where the strands are closest in proximity from a first apex 331*a* of a hexagon to a second apex 331*b* of the hexagon. For example, a first strand 305*a* is coupled to a second strand 305*b* at points 321*a*, 321*b*, 321*c*, . . . , and 321*n*. In addition, the second strand 305*b* is coupled to a third strand 305*c* at points 322*a*, 322*b*, 322*c*, . . . , and 322*n*. The strands 305 can be coupled by any coupling means such as by interleaving portions, or fibers, of one strand 305*a* with the portions from the adjacent strand 305*b*.

FIG. 3B illustrates a longitudinal cross-section view of the spacer structure 230 according to embodiments of the present disclosure. The spacer structure 230 includes a number of monofilaments (support fibers) 325 coupled between the top 310 and bottom 315 strands. The support fibers 325 can be a pile yarn, such as pole or distance yarn. The support fibers 325 can include a compression strength in the range of 7-9 kPA. The support fibers 325 are coupled in groups at the apexes of the hexagonal shapes in the top 310 and bottom 315 surfaces. That is, multiple strands 325, such as three strands, are disposed in close proximity and coupled at substantially the same points at the apexes of the hexagonal shapes. For example, a first group of support fibers 325*a* are coupled to strand 305*a* and strand 305*b* of the top 310 at point 321*a*. In addition, the first group of support fibers 325*a* is also coupled to strand 305*a* and 305*b* of the bottom 315 at point 321*a*'. The coupling of the groups of strands proximate at each respective connection point of the strands on the top 310 and bottom 315 creates a number channels 330 that traverse the length of the spacer structure 230. In addition, the coupling of the groups of strands 305 proximate to each respective connection point of the strands 305 on the top 310 and bottom 315 creates additional channels 335 that traverse diagonally across the spacer structure 230 at 45° from the longitudinal path, as shown in FIG. 3C. Although FIG. 3C illustrates a set of channels 335 in one cross-sectional view, additional channels 335 exist that traverse diagonally across the spacer structure 230 at −45° from the longitudinal path.

The spacer structure 230 can be dimensioned to range from about 6 mm to 24 mm thick (that is from top 310 to bottom 315). In some embodiments, the spacer structure 230 ranges from about 10 mm to 12 mm thick. The spacer structure 230 is constructed or formed of relatively soft material(s) such that it can be disposed at or near the surface of the mattress 50. In one embodiment, due to the construction of the support fibers 325 and the coupling to the top 310 and bottom 315 layers, the preferred thickness for the identified material from Müller Textile is in the range of about 10-12 mm range, otherwise any additional thickness may cause the spacer structure to collapse more easily when weight is applied.

The channels 330, 335 in the spacer structure 230 are configured to enable multiple flow paths of conditioned air in the same plane. The channels 330, 335 enable the conditioned air to flow along a path longitudinally down the length of the distribution layer 110 and diagonally along paths at 45° from the longitudinal path. The arrows, ←, ↖, and ↙ shown in the example in FIG. 3A illustrate conditioned air flow paths through the same plane provided by the channels 330 and 335. Thus, in one embodiment, the spacer includes channels at 0 degrees (extending longitudinally), 45 degrees, and −45 degrees.

Through the use of the multiple layers 205-240, inlet region 255 and spacer structure 230, the distribution layer 110 is configured to muffle and disperse the conditioned air in multiple directions. Noise and vibration transmission resulting from both the blower and air movement through the distribution layer 110 is reduced.

In some embodiments, the air flow through the spacer structure 230 can be customized by varying one or more of the density, patterning and size of the monofilaments (support fibers) 325. The patterning, size or composition of the support fibers 325 can be modified to increase or decrease density and/or for noise management (i.e., mitigation or cancellation) and to establish different channels 330, 335 for air flow. In addition, the width of the support fibers 325 can be varied to alter support, for noise management and to establish different channels 330, 335 for air flow.

Figure 4A:
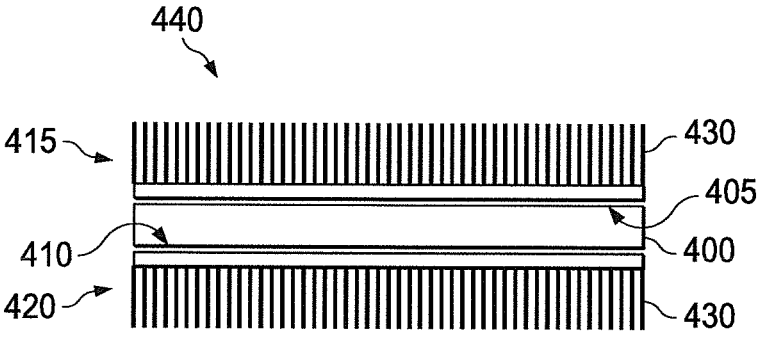
FIGS. 4A through 4D illustrates a thermoelectric thermal transfer device according to embodiments of the present disclosure.
Figure 4B:
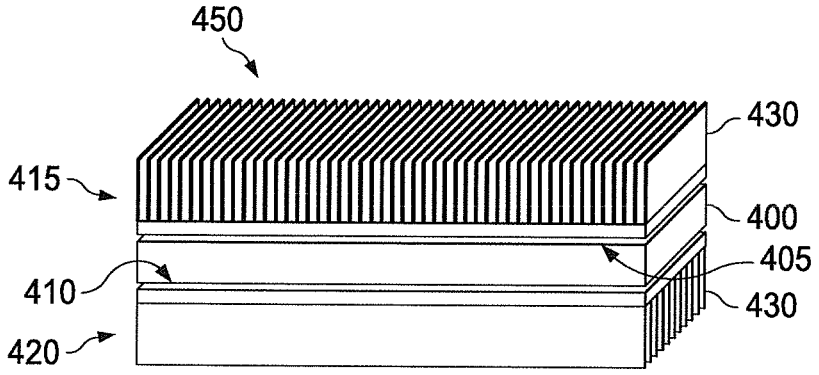
Figure 4C:
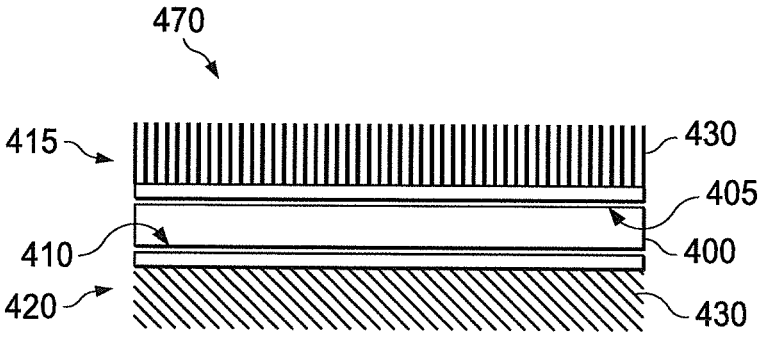

FIGS. 4A through 4C illustrate various thermoelectric heat transfer devices according to embodiments of the present disclosure. Other embodiments could be used without departing from the scope of this disclosure.

Referring to FIG. 4A, there is illustrated a thermoelectric thermal transfer device 440. The device 440 includes a thermoelectric engine/heat pump (TEC) 400. As is well known, the TEC 400 uses the Peltier effect to create a heat flux between the junctions of two different types of materials. When activated, heat is transferred from one side of the TEC 400 to the other such that a first side 405 of the TEC 400 becomes cold while a second side 410 becomes hot (or vice versa).

In another embodiment consistent with the previously described active cooling with resistive heating mode, the device 440 may include a resistive heating device/element (not shown). As described previously, the resistive heating device/element may include a printed circuit trace on the TEC 400, a PTC (positive temperature coefficient) type device, or some other suitable device capable of generating heat.

The thermal transfer device 440 includes a pair of heat exchangers 415, 425. Herein, the term hot sink (or source) is used interchangeably with a heat exchanger coupled to the hot side 410 of the TEC 400 and the term cold sink (or source) is used interchangeably with a heat exchanger coupled to the cold side 405 of the TEC 400.

A first heat exchanger 415 is coupled to the first side 405 and a second heat exchanger 420 is couple to the second side 410. Each heat exchanger 415, 420 includes material(s) that facilitates the transfer of heat. This may include material(s) with high thermal conductivity, including graphite or metals, such as copper (Cu) or aluminum, and may include a number of fins 430 to facilitate the transfer of heat. When air passes through and around the fins 430, a heat transfer occurs. For example, the fins 430 on the first heat exchanger 415 become cold as a result of thermal coupling to the cold side (the first side 405) of the TEC 400. As air passes through and around the fins 430, the air is cooled by a transfer of heat from the air (hot) into the fins 430 (cool). A similar operation occurs on the hot side where the air flow draws heat away from the fins 430 which have been heated as a result of the thermal coupling to the hot side (the second side 410) of the TEC 400; thus heating the air.

The heat exchangers 415, 420 can be configured for coupling to the TEC 400 such that the fins 430 of the first heat exchanger 415 are parallel with the fins 430 of the second heat exchanger 420 as shown in the example in FIG. 4A.

Now referring to FIG. 4B, there is illustrated a thermoelectric thermal transfer device 450 (cross-flow configuration). In this embodiment, the fins 430 of the heat exchangers are disposed perpendicular to each other, that is, in a cross-fin (i.e., cross-flow) orientation. For example, the fins 430 of the first heat exchanger 415 are disposed at a 90° angle from the fins 430 of the second heat exchanger 420 as shown in the example in FIG. 4B.

Now referring to FIG. 4C, there is illustrated a thermoelectric thermal transfer device 470 (oblique configuration). In this embodiment, the heat exchangers 415, 420 are coupled in an oblique manner. Either or both of the heat exchangers 415, 420 include fins 430 that are disposed at an oblique angle from the sides 405, 410 of the TEC 400 as shown in the example in FIG. 4C. The fins 430 can be slanted in multiple orientations to help manage condensate. For example, the heat exchangers 415 can include an angled fin configuration such that the fins 430 are non-perpendicular to the cold side 405 of the TEC 400, allowing for condensate management in multiple orientations of the overall engine.

Figure 4D:
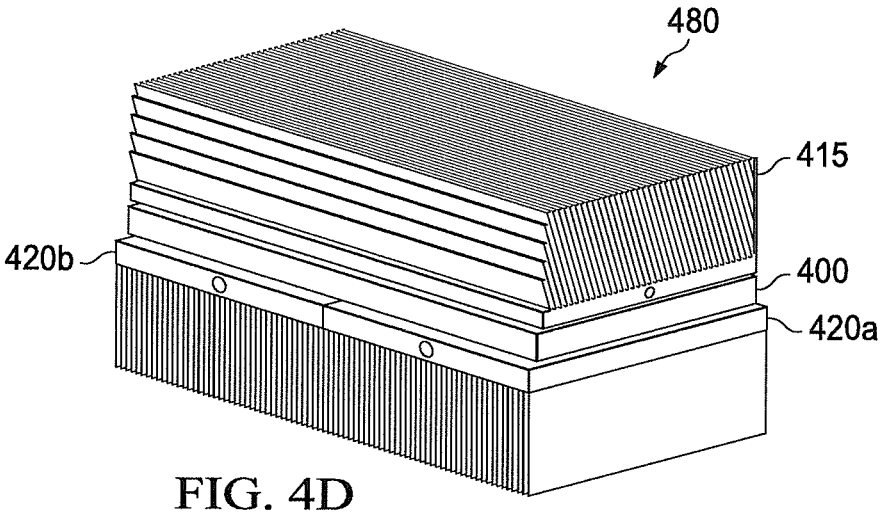
Figure 5A:
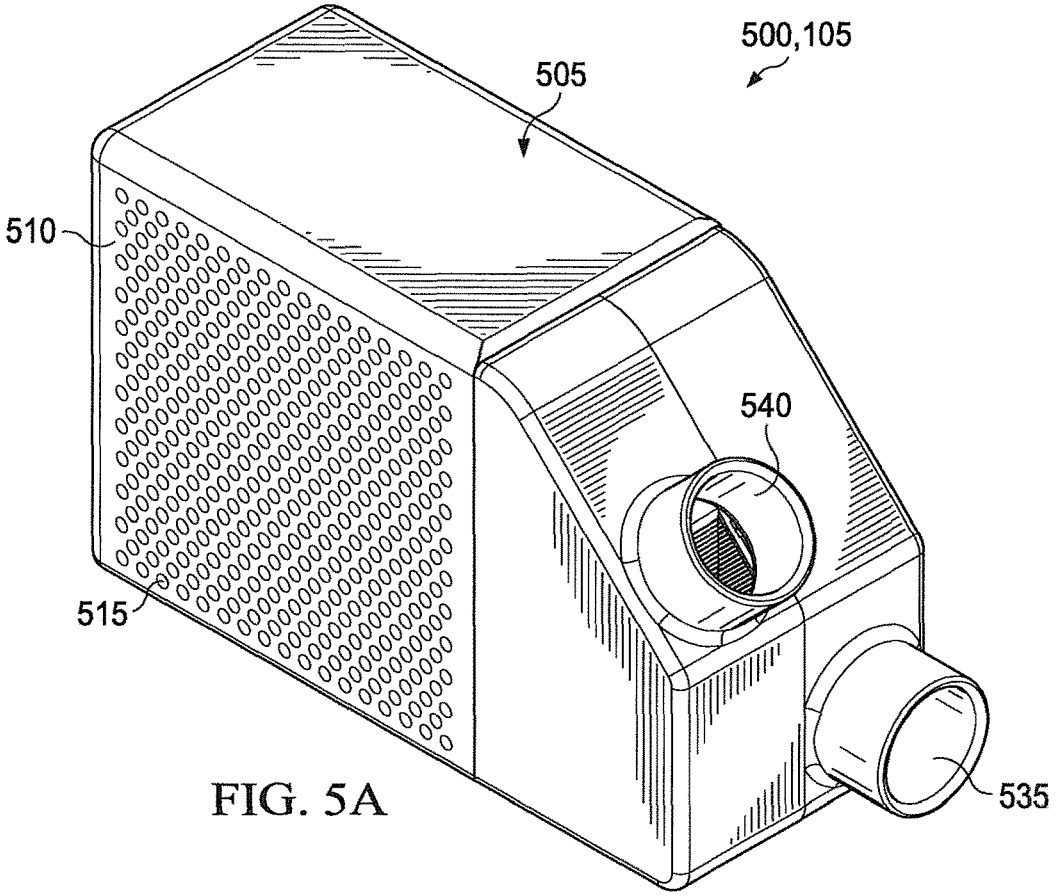
FIGS. 5A through 5G illustrate one embodiment a personal air conditioning control system of the present disclosure.
Figure 5B:
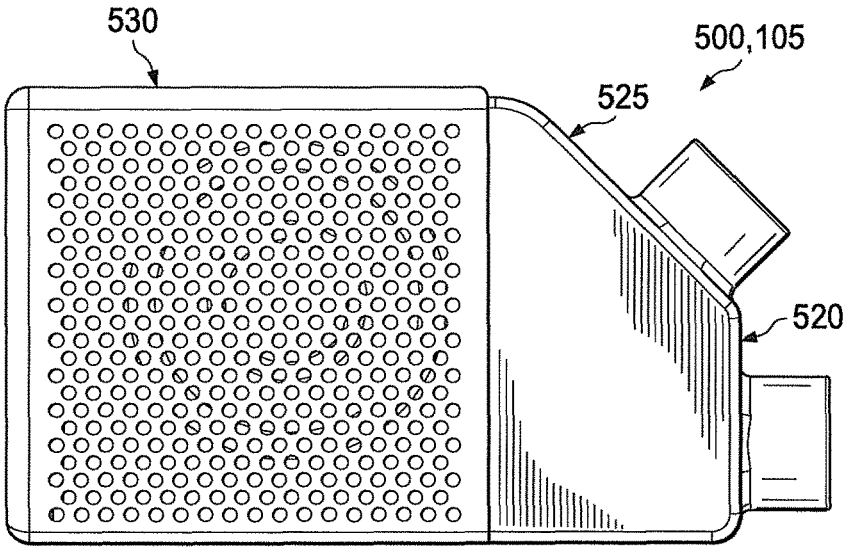
Figure 5C:
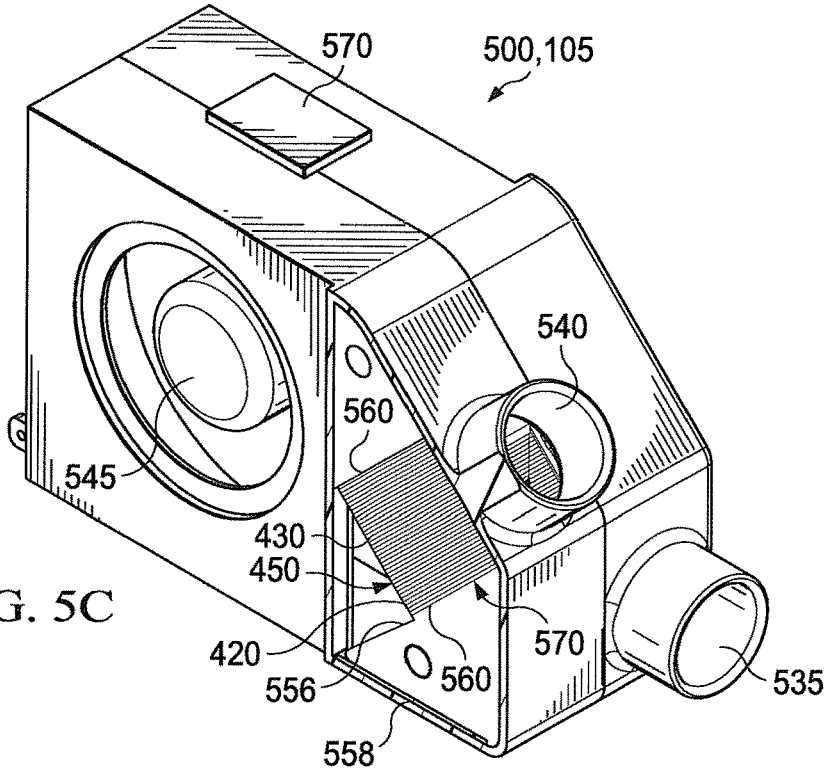
Figure 5D:
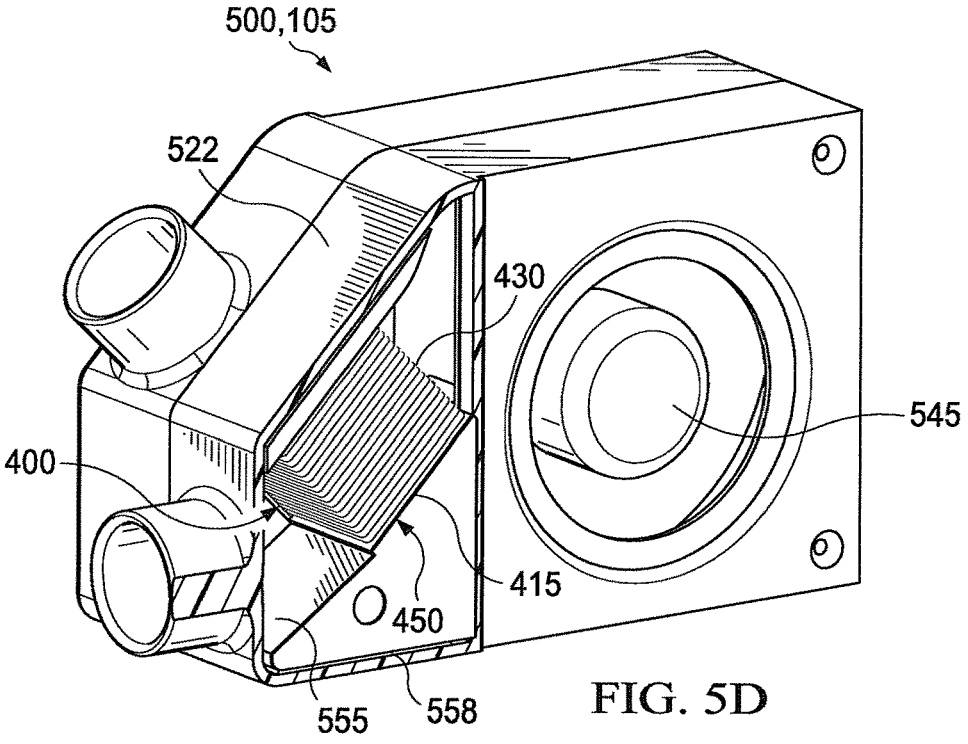
Figure 5E:
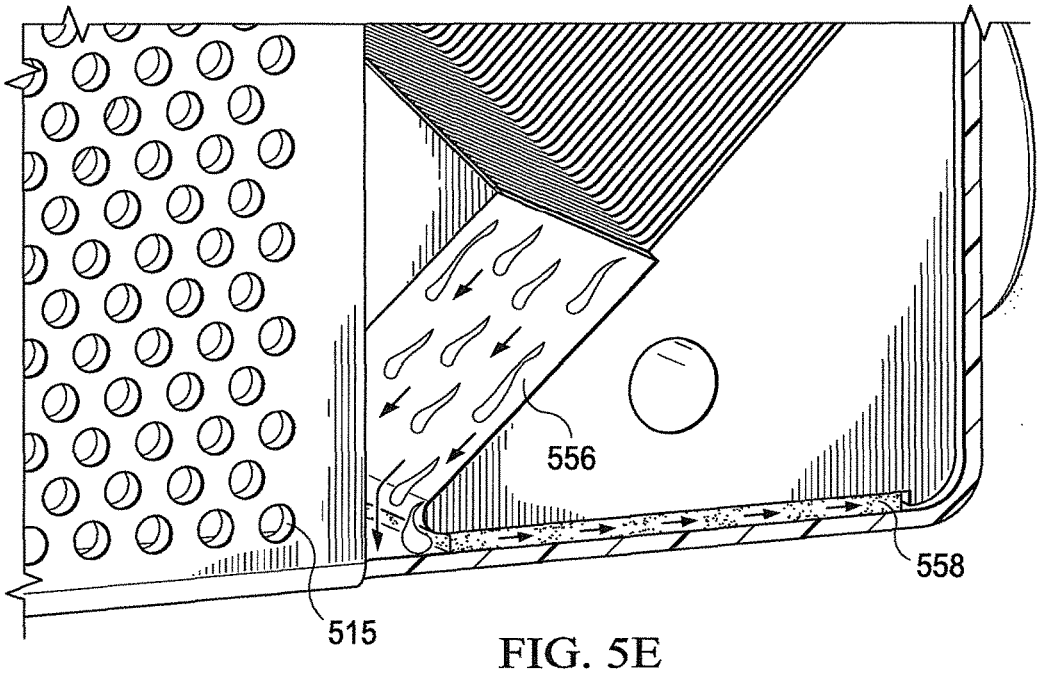
Figure 5F:
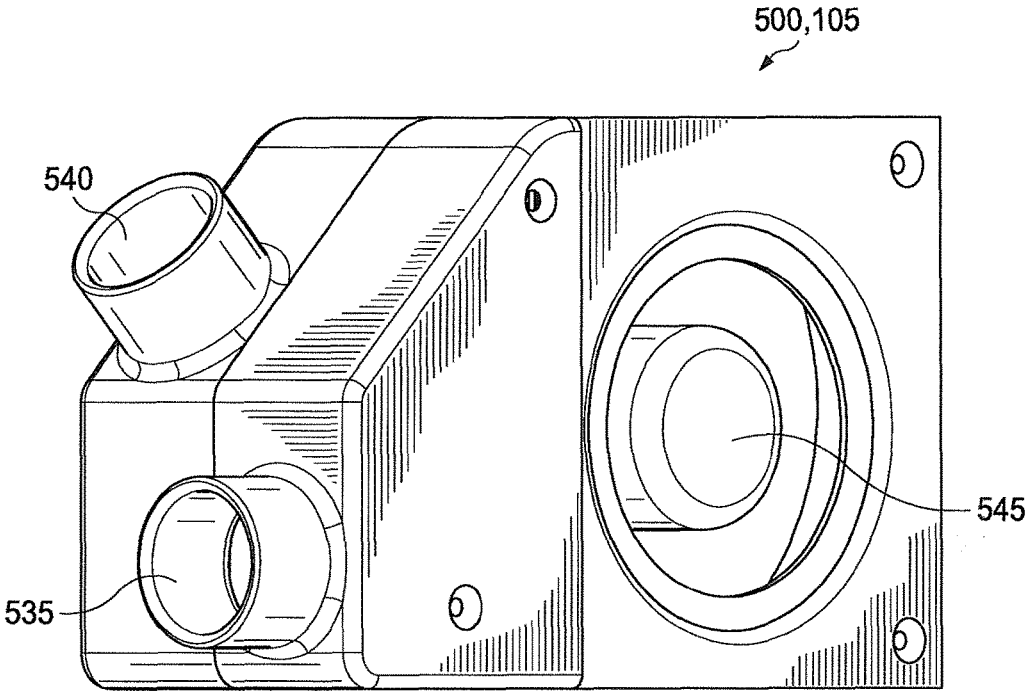
Figure 5G:
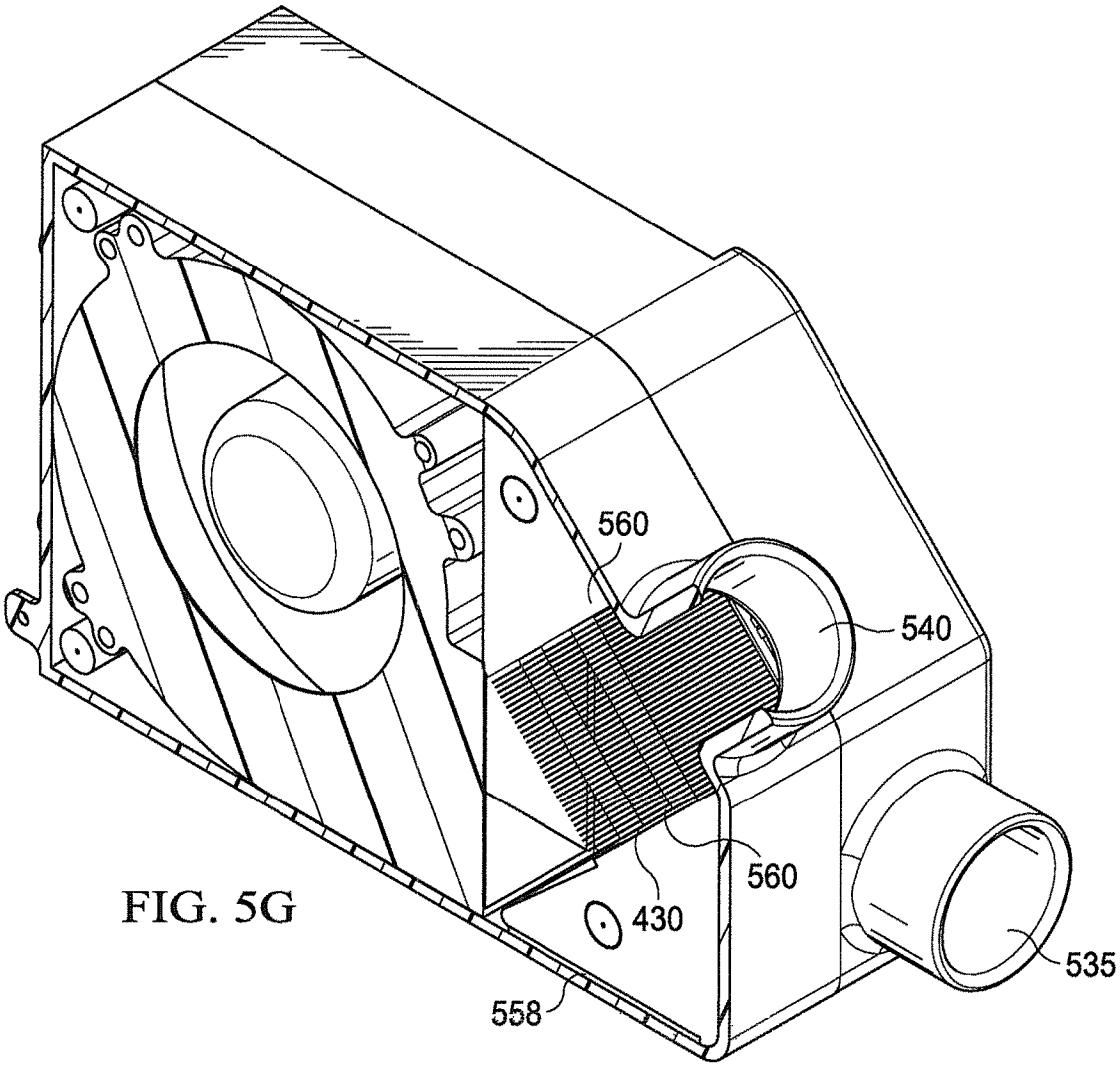

Now referring to FIG. 4D, there is illustrated a thermoelectric thermal transfer device 480 (multiple). In this embodiment, the thermal transfer device 480 includes multiple heat exchangers coupled to at least one side of the TEC 400. For example, the device 480 includes a heat exchanger 415 coupled to a first side of the TEC 400 and two heat exchangers 420*a*, 420*b* coupled to a second side of the TEC 400. It will be understood that illustration of the device 480 including a single heat exchanger 415 and two heat exchangers 420 is for illustration only and other numbers of heat exchangers 415 and heat exchangers 420 could be used without departing from the scope of this disclosure. In addition, the device 480 may include multiple TECs 400, each with single or multiple exchangers on each side.

In one embodiment, the heat exchangers 415 and 420 include a hydrophobic coating that reduces the tendency for water molecules to remain on the fins 430 due to surface tension. The water molecules bead-up and run off the heat exchanger 415, 420. The hydrophobic coating also reduces the heat load build up to the TEC 400.

In another embodiment, the heat exchangers 415 and 420 include a hydrophilic coating that also reduces the tendency for water molecules to remain on the fins 430 due to surface tension. The water molecules wet-out. The hydrophilic coating also reduces the heat load build up to the TEC 400.

FIGS. 5A through 5G illustrate one example of the personal air conditioning control system 105 according to embodiments of the present disclosure. In this embodiment, the personal air conditioning control system 105 is identified using reference numeral 500.

The system 500 includes a thermoelectric heat transfer device, such as devices 440, 450, 470 or 480. The system 500 is configured to deliver conditioned air to the distribution layer 110.

In another embodiment (not shown), the system 105 may includes multiple thermoelectric heat transfer devices (440, 450, 470, 480). In yet another embodiment (not shown), two or more systems 105 may be utilized to supply conditioned air to the distribution layer 110. It will be understood that these multiple devices/systems can operate cooperatively or independently to provide conditioned air to the distribution layer 110.

The system 500 includes a housing 505 that uses air blower geometry to minimize size and maximize performance of blowers/fans 545. The housing 505 includes a perforated cover 510 on each of two sides of the housing 505, and the perforated covers 510 may be transparent or solid. Each perforated cover 510 includes a plurality of vias or openings 515 for air flow. The housing 505 includes a front edge side 520 and a front oblique side 525. The front oblique side 525 is disposed at an approximately 45° angle between the front edge side 520 and a top side 530. The front edge side includes a conditioned air outlet 535, while the front oblique side 525 includes an exhaust outlet 540. In addition, the front edge side 520 and the front oblique side 525 may each include foam insulation 522 for noise reduction and thermal efficiency.

The system 500 includes a pair of independent blowers 545, each disposed behind a respective one of the perforated covers 510. These blowers 545 can operate independently to draw ambient air into the interior volume of the system 500 through the supply side vias 515. In some embodiments, either or both of the covers 510 include a filter such that particles or other impurities are filtered from the air as the air is drawn through the supply side vias 515.

As shown, the system 500 includes the thermal transfer device 450 (cross-flow configuration) including the TEC 400, though alternative configurations of the thermal transfer device (e.g., 440, 470, 480) may be used. As described previously, in the device 450, the fins 430 of the first heat exchanger 415 are disposed at a 90° angle from the fins 430 of the second heat exchanger 420 (as shown in FIG. 4B). The air drawn in by the blower(s) 545 is channeled along two paths to the thermal transfer device 450.

The device 450 is positioned at an angle corresponding to the front oblique side 525. The fins 430 of the second heat exchanger 420 (hot sink) are disposed at an angle in parallel with the exhaust outlet 540 and the fins 430 of the first heat exchanger 415 (cold sink) are disposed at an angle directed towards the conditioned air outlet 535. In this particular embodiment, fins 430 of the heat exchangers include a hydrophobic coating thereon.

The angles at which heat exchanger(s) are disposed, and the corresponding angles of the fins 430, are configured to enable condensate that forms on the heat exchangers to be wicked away via sloped surfaces 555, 556 towards a wicking material 558. The sloped surfaces 555, 556 and wicking material 558 are configured to provide condensation management. The wicking material 558 can be any material adapted to wick moisture without absorbing the moisture.

The housing 505 includes a number of dividing walls 560 configured to provide channels from the respective blowers 545 to guide air through the heat exchangers of the device 450. The dividing walls 560 also support the overall device 450 in the specified position and assist to seal the respective hot and cold sides of the TEC 400. The dividing walls 560 can be made of plastic or the like.

The system 500 further includes a power supply (not shown) and a control unit 570 operable for controlling the overall operation and functions of the system 500. The control unit 570 is described in further detail herein below with respect to FIG. 13. The control unit 570 can be configured to communicate with one or more external devices or remotes via a Universal Serial Bus (USB) or wireless communication medium (such as Bluetooth®) to transfer or download data to the external devices or to receive commands from the external device. The control unit 570 may include a power switch adapted to interrupt one or more functions of the system 500, such as interrupting a power supply to the blowers 545. The power supply is adapted to provide electrical energy to enable operation of the heat transfer device 450 (or others) (including the TEC 400), the blowers 545, and remaining electrical components in the system 500. The power supply can operate at an input power between 2 watts (W) and 200 W (or at 0 W in the passive mode). The control unit 570 may be configured to communicate with a second control unit 570 in a second system 500 operating in cooperation with each other.

FIGS. 6A through 6J illustrate a different embodiment of the personal air conditioning control system 105 according to embodiments of the present disclosure. In this embodiment, the personal air conditioning control system 105 is identified using reference numeral 600.

The system 600 includes two thermal transfer devices (440, 450, 470) or a thermal transfer device (480). In another embodiment, the system 600 includes a thermal transfer device 480 that includes any one or more of: (1) a single TEC 400 with multiple exhaust sinks, (2) a single TEC 400 with multiple supply sinks, (3) multiple TECs 400 with a single exhaust sink, (4) multiple TECs 400 with a single supply sink, or (5) any combination thereof. As with the system 500, the system 600 is configured to deliver conditioned air to the distribution layer 110. In another configuration, two or more of these systems 600 may be coupled to the distribution layer 110.

As shown, the system 600 includes a housing 605 (that is generally rectangular in shape) having a top cover 607, a supply side 608, a non-supply side 609, a bottom tray 610 and two end caps 611, 612. The housing 605 is dimensioned to fit under most standard beds. In one illustrative example, the housing 605 is dimensioned to be about 125 mm high, 115 mm wide and 336 mm long.

The supply side 608 and back side 609 are coupled together by a fastening means such as screw(s), latch(es), or clip(s) such that the two thermal transfer devices (e.g., 440, 450, 470) and internal blower 630 are tightly suspended, but not hard mounted. The supply side 608 and non-supply side 609 create, with ledges and ribbing, sealing surfaces to provide a seal between the supply and exhaust sides of the thermal transfer devices (440, 450, 470). The supply side 608 and non-supply side 609 also create, with ledges and ribbing, an air baffling required to supply conditioned air, manage condensate, and manage exhaust from the thermal transfer devices (440, 450, 470).

The system 600 includes a pair of axial fans 615 configured to draw exhaust from the thermal transfer devices (440, 450, 470). The axial fans 615 are mounted above the thermal transfer devices (440, 450, 470) and adjacent to (such as centered in relation to) the fins 430 of the exhaust heat exchanger 622 (exhaust sink 420). As shown in the example illustrated in FIG. 6F, the axial fans 615 are mounted to the sides 608 and 609 with rubber mounts 650 and a flat gasket 655 to reduce vibration.

Each of the axial fans 615 operates to drive exhaust from each of the two thermal transfer devices (440, 450, 470) through a first set of exhaust vias 620*a* and a second set of exhaust vias 620*b* in the top cover 607; each set of vias 620 is disposed above a respective one of the axial fans 615. The axial fans 615 draw ambient air in through ambient air intakes 625 and across exhaust heat exchanger 622 to draw the heat away from the thermal transfer devices (440, 450, 470) in a cooling operation.

A similar operation can be performed to draw the exhaust heat exchangers 622 towards an ambient temperature in a heating operation. For example, in a heating operation (e.g., the polarity of the input voltage to the thermal transfer devices is reversed such that the hot sides are coupled to the supply heat exchangers 624 (the supply heat exchanger) and the cold sides are coupled to the exhaust heat exchanger 622 (the exhaust heat exchanger). The axial fans 615 draw ambient air in through ambient air intakes 625 and across exhaust heat exchangers 622 to cool the exhaust air. The proximity and orientation of the axial fans 615 is configured to provide for a low pressure drop and high flow. This provides for low noise and improved performance density.

Figure 6A:
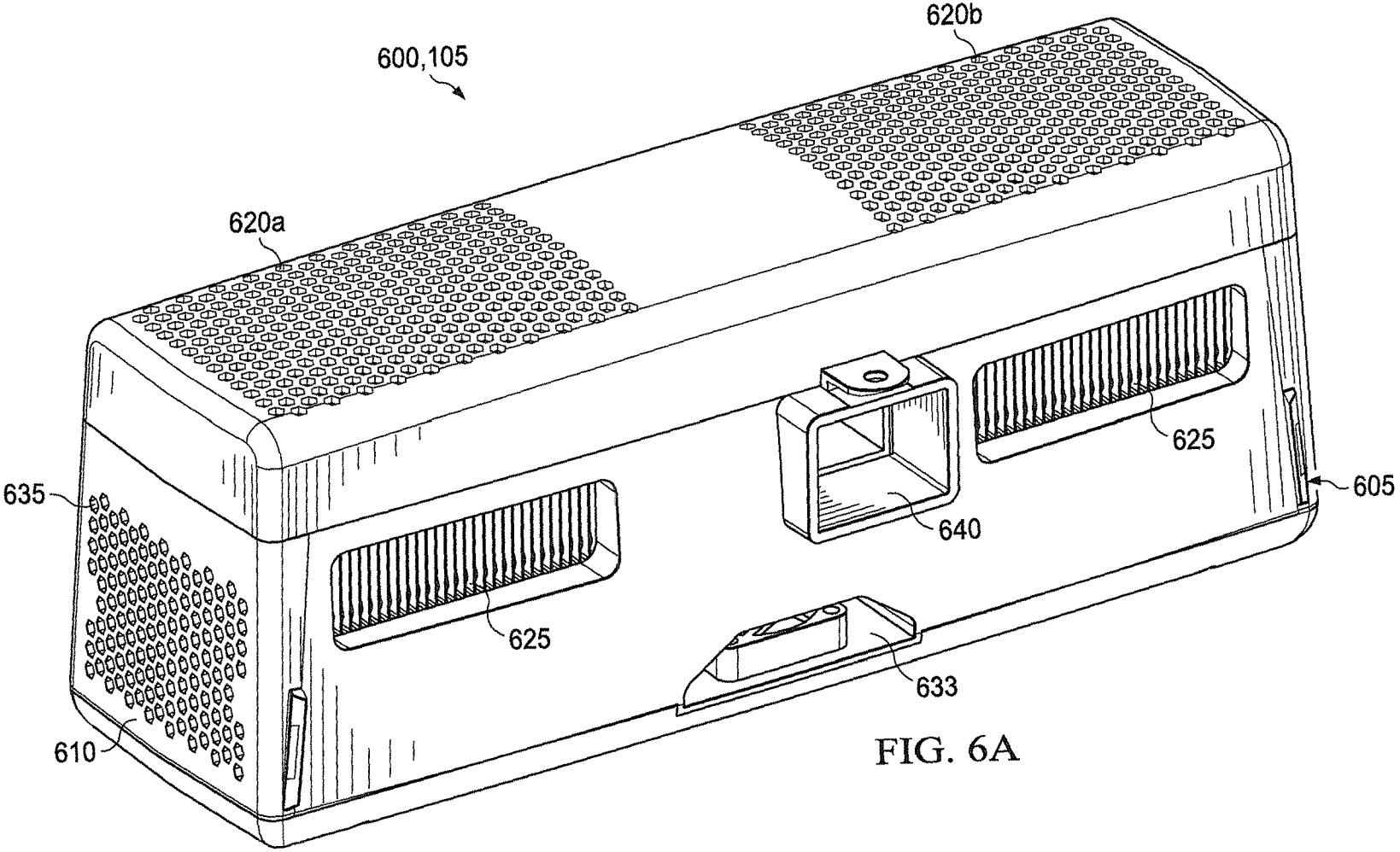
FIGS. 6A through 6J illustrate another embodiment of the personal air conditioning control system of the present disclosure.
Figure 6B:
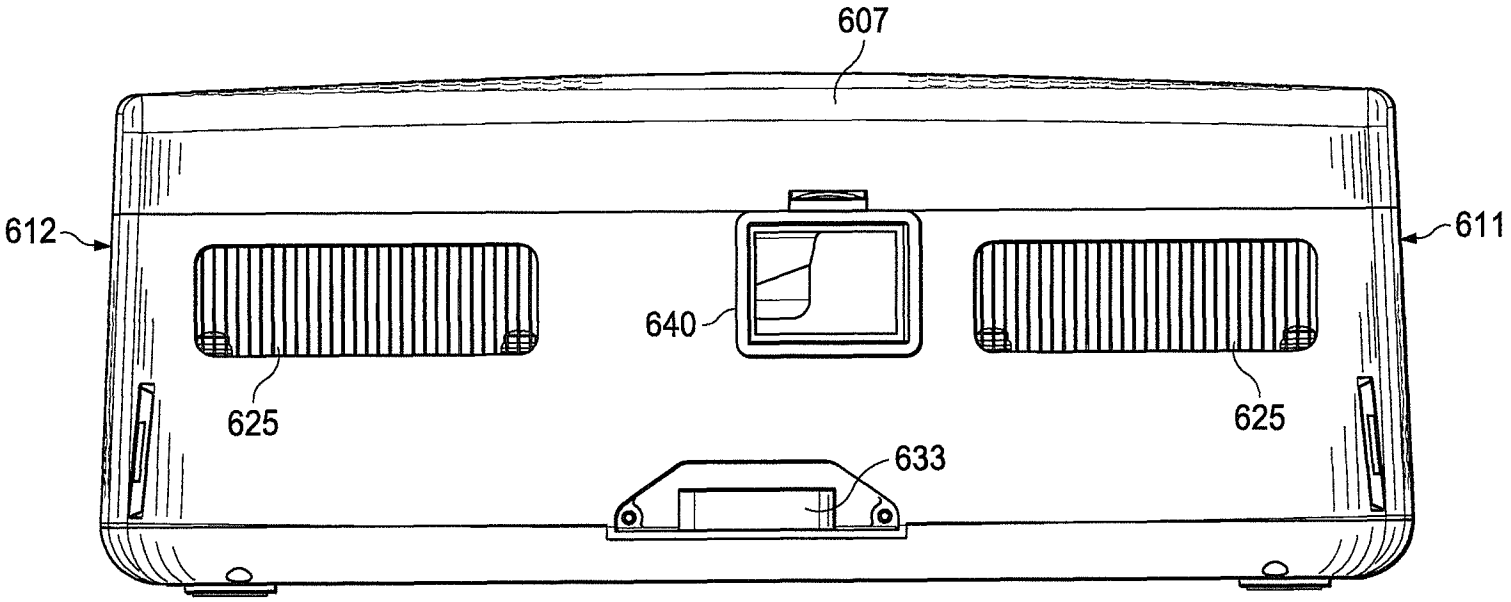
Figure 6C:
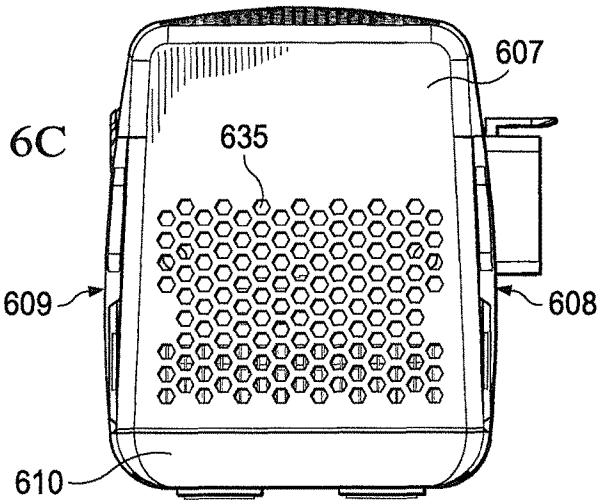
Figure 6D:
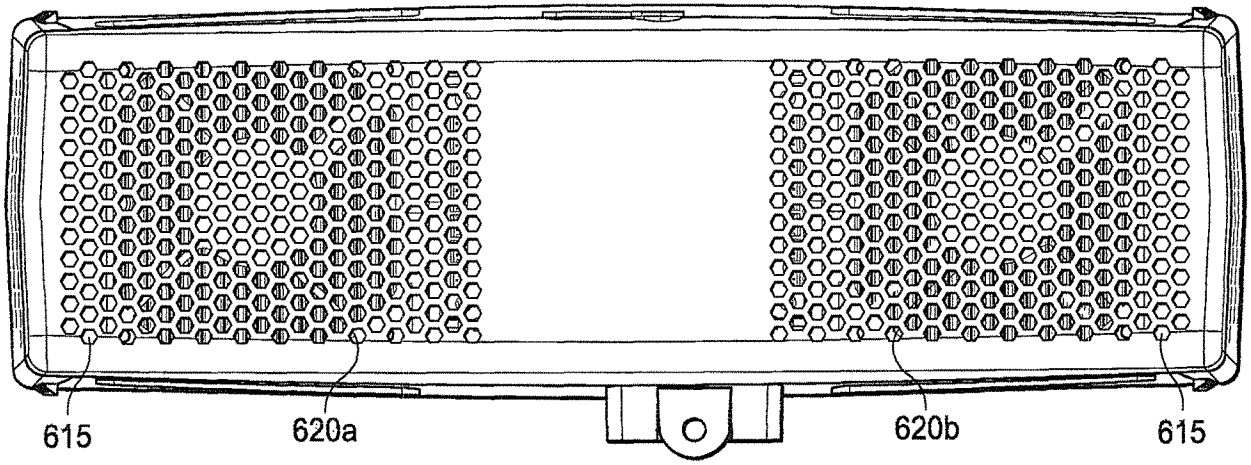
Figure 6E:
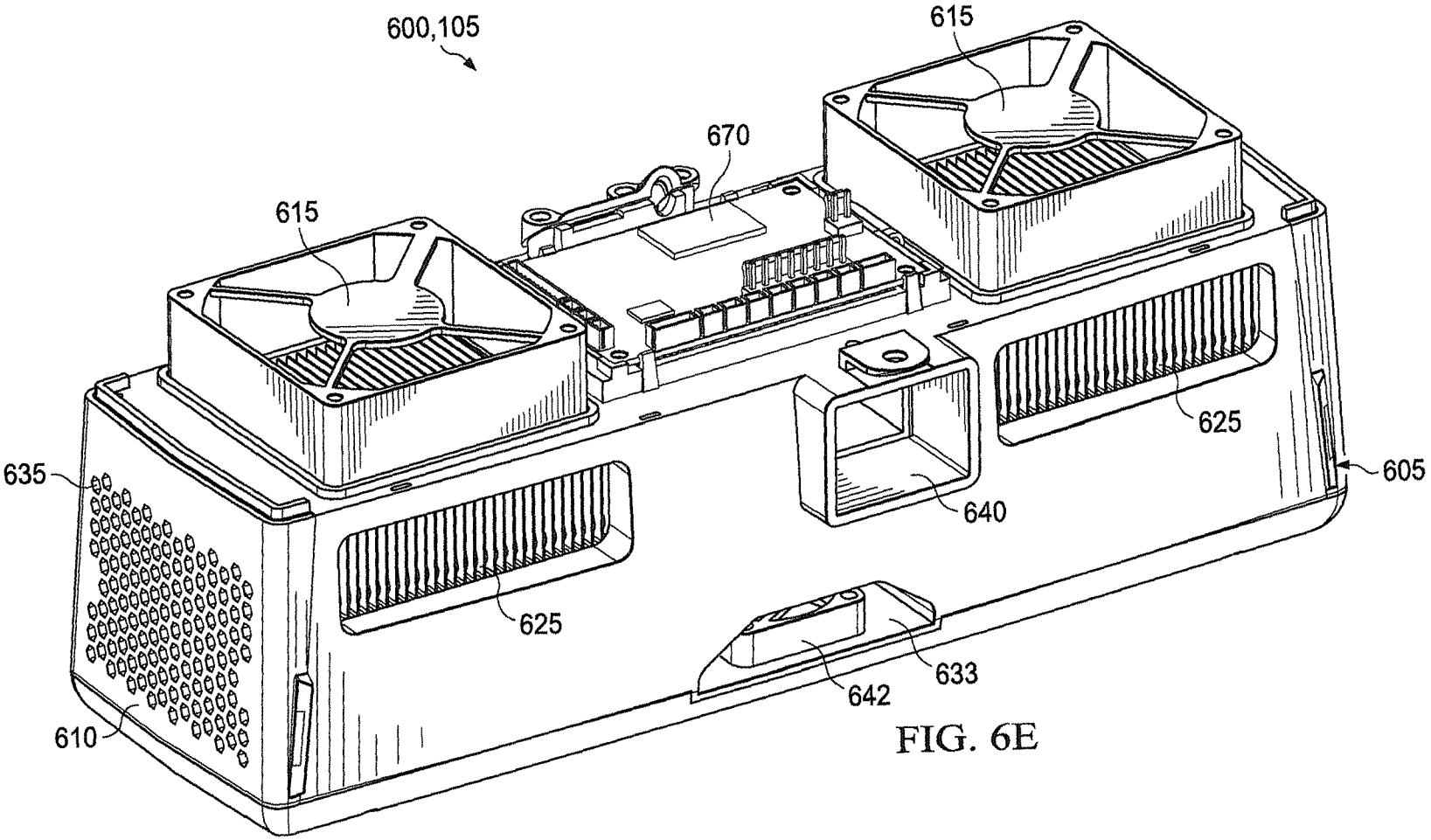
Figure 6F:
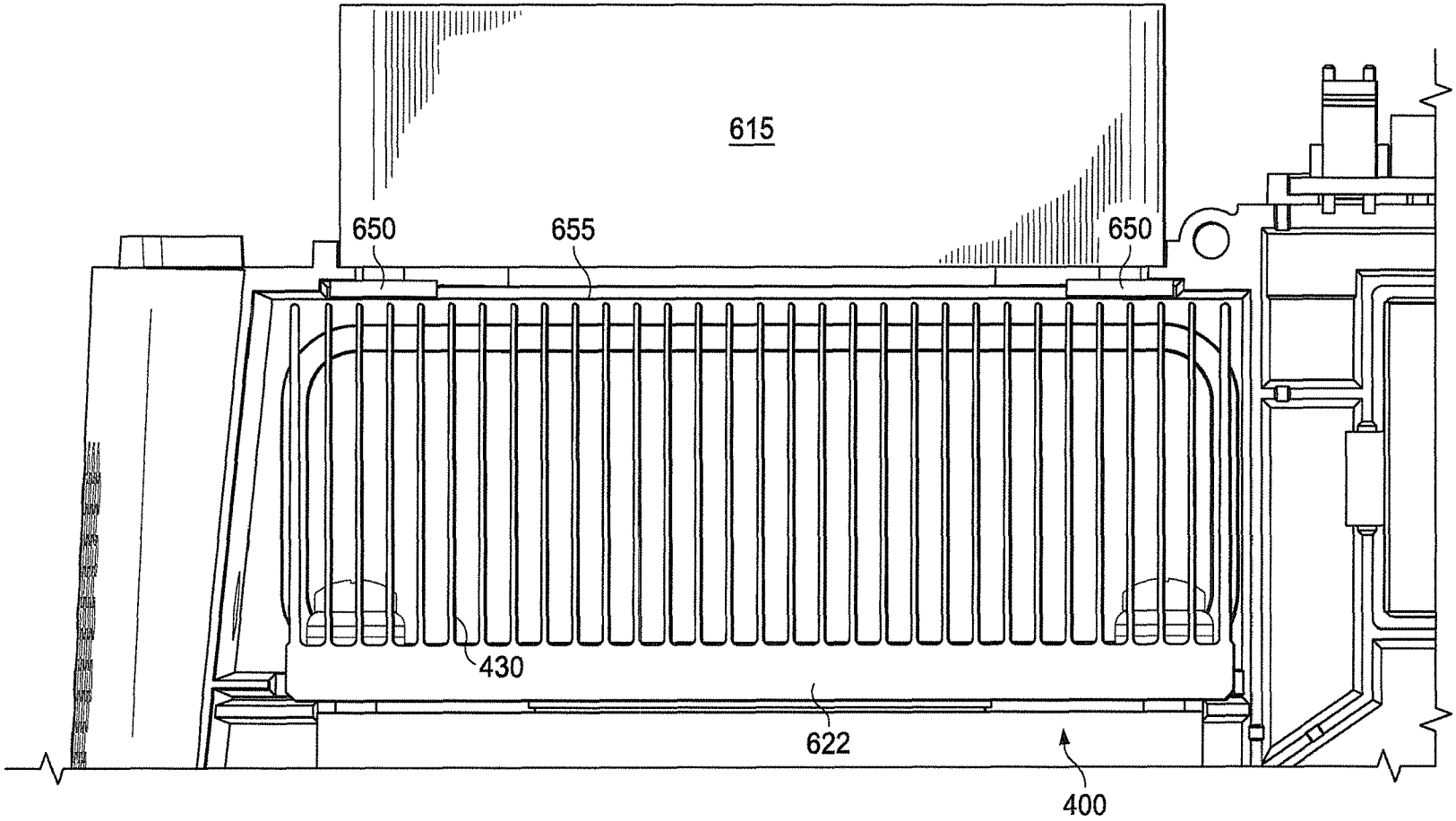
Figure 6G:
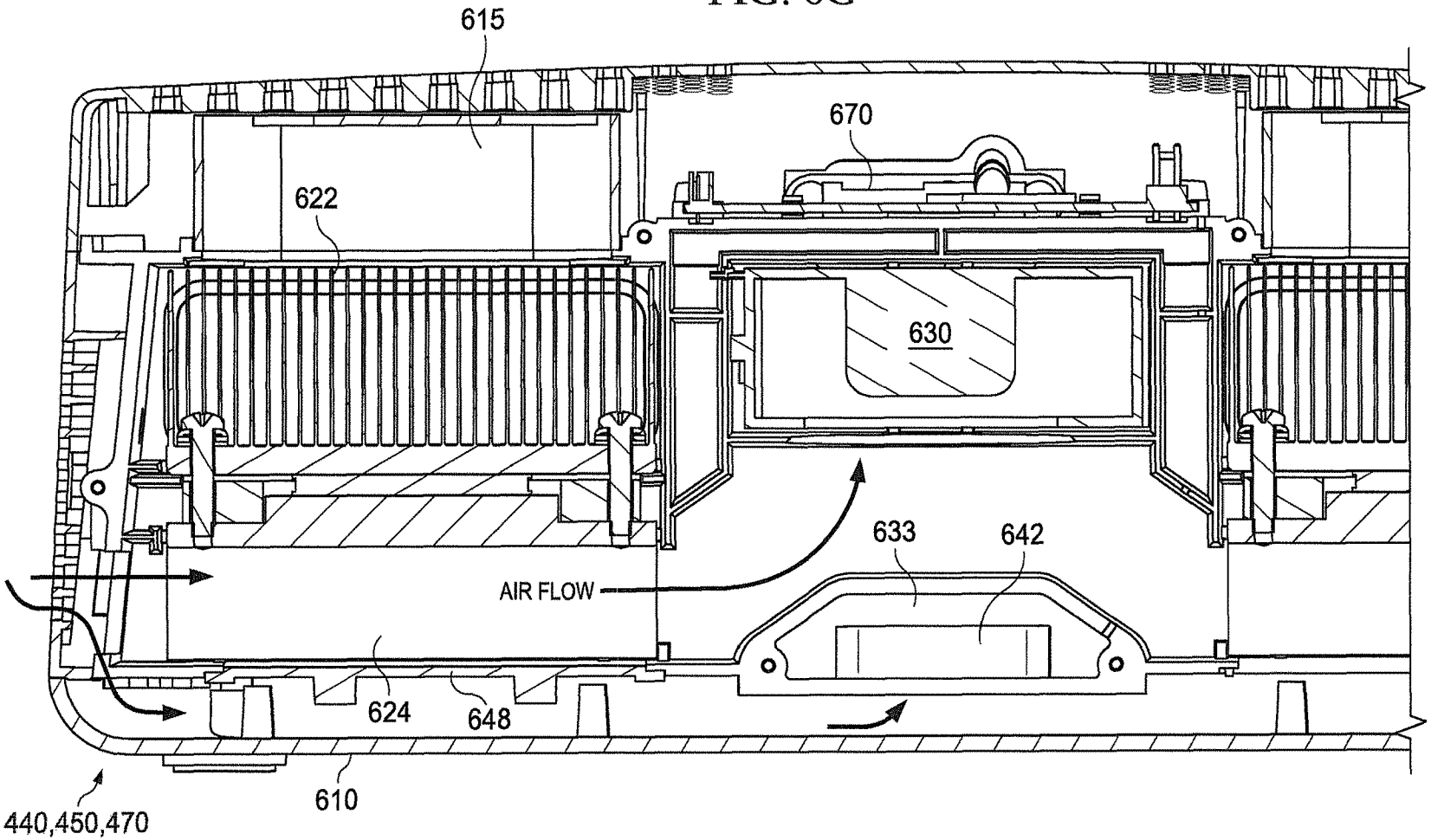
Figure 6H:
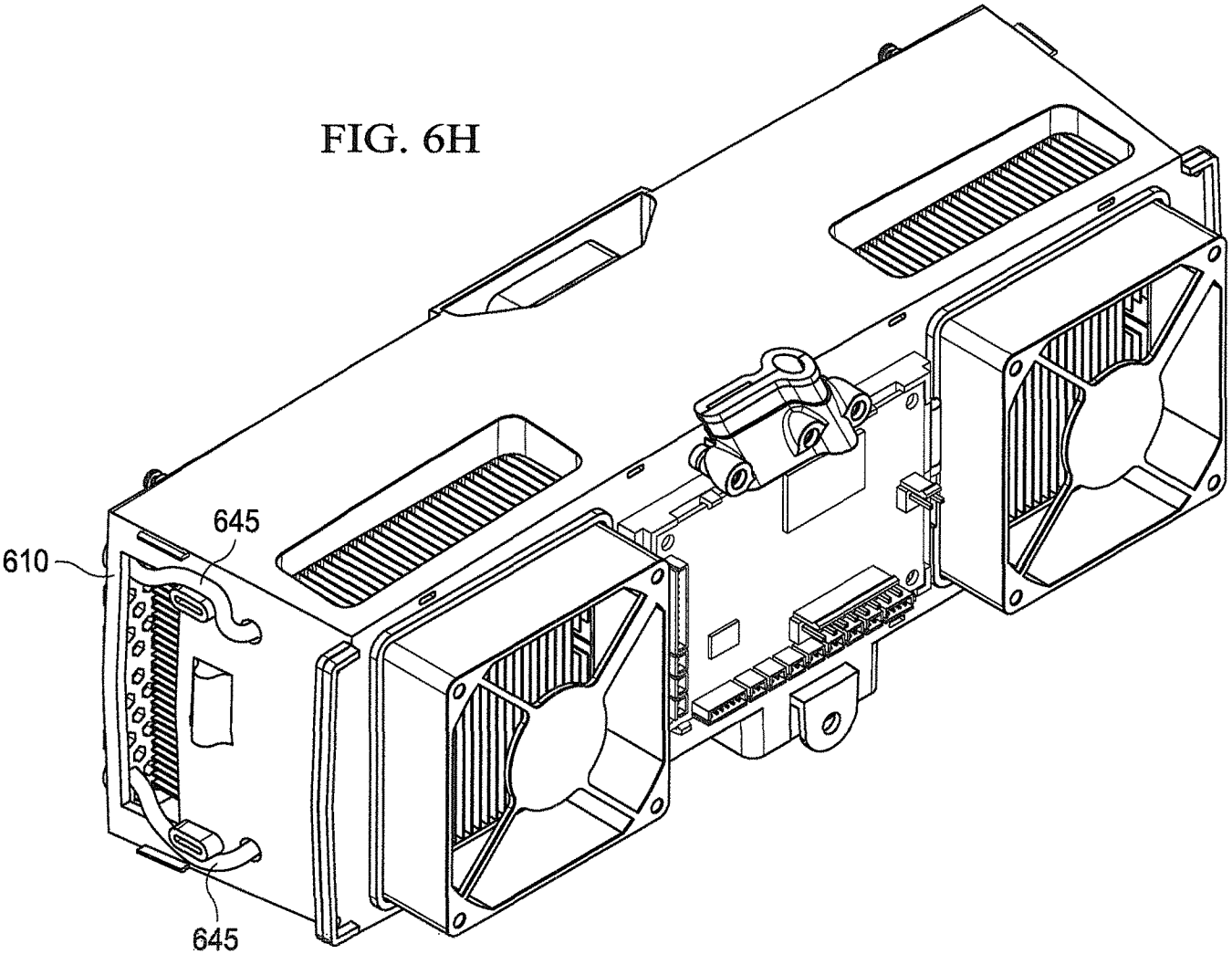
Figure 6I:
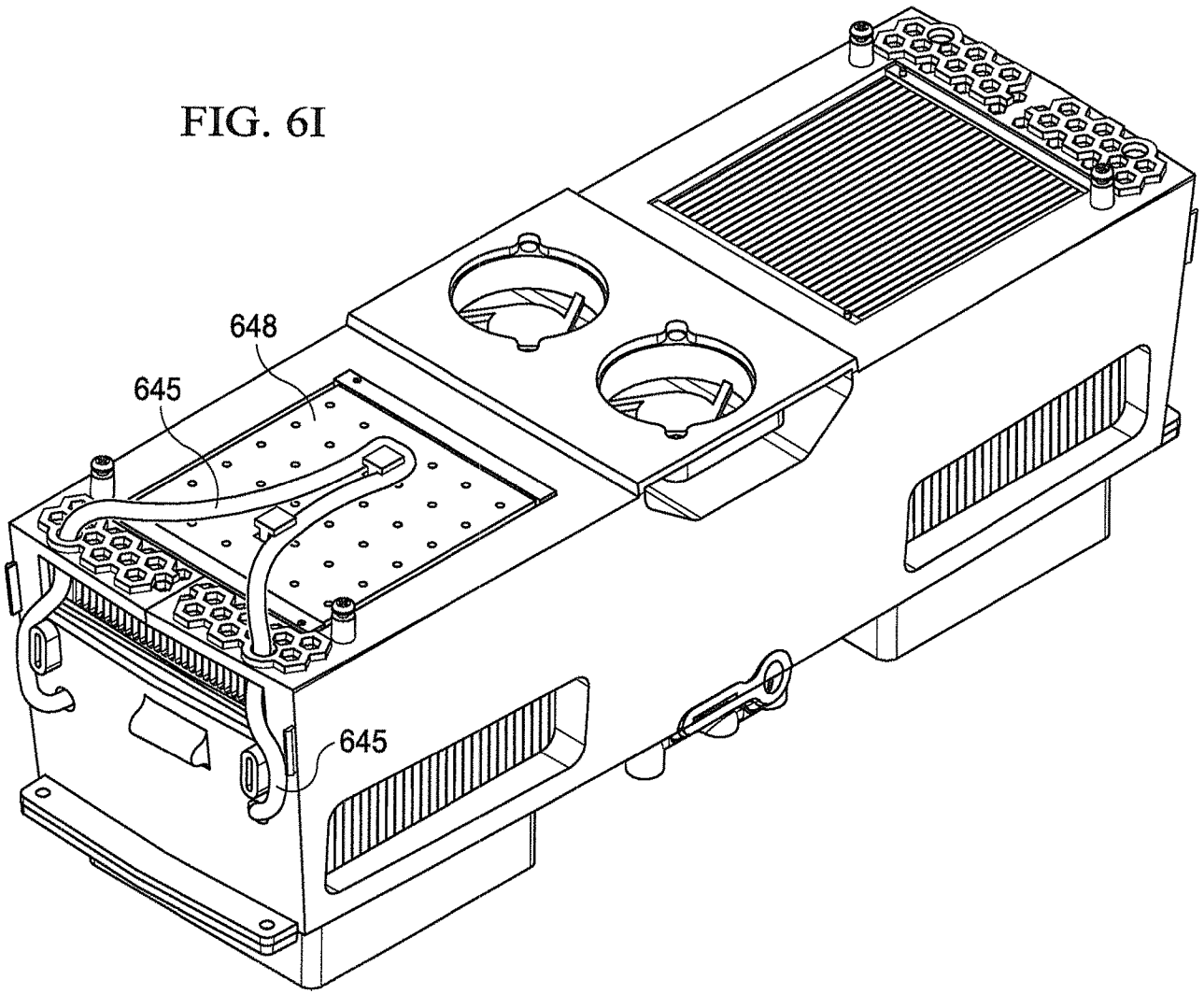
Figure 6J:
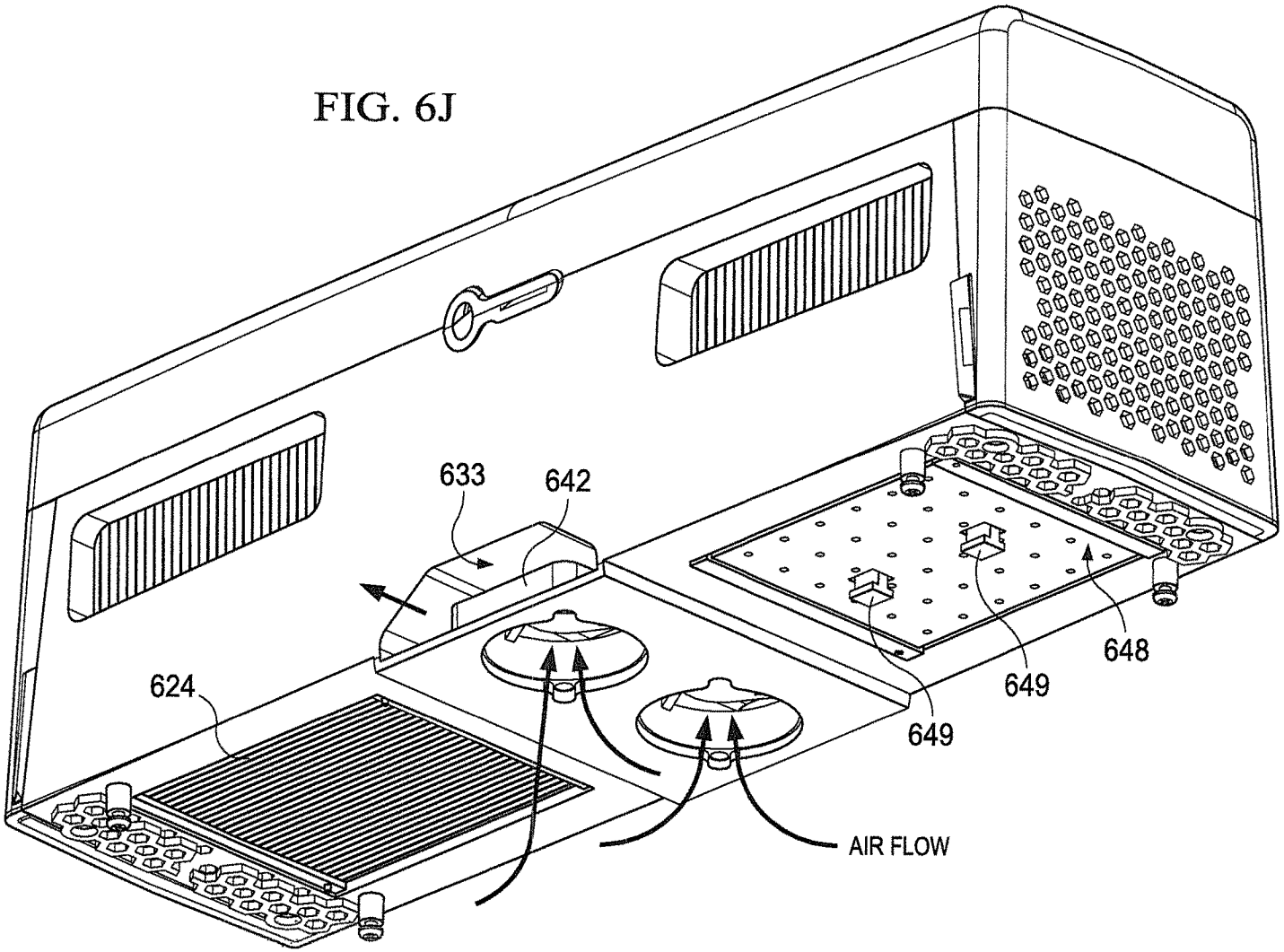

Ambient air is received into the system 600 via the ambient air intakes 625 and through the supply vias 635. While the ambient air drawn through the ambient air intakes 625 is drawn across and through the exhaust heat exchangers 622 and expelled through the exhaust vias 620, the ambient air drawn in through the supply vias 635 has two paths (as shown in FIG. 6G). The internal blower 630 draws ambient air in through a number of supply vias 635 across supply heat exchangers 624 of the heat transfer devices (440, 450, 470). Ambient air is drawn in by the internal blower 630 through end caps 611, 612 past and through the supply heat exchangers 624 (which are disposed proximate to the intake vias 635 in the end caps 611, 612) and expelled by the internal blower 630 via the supply outlet 640. A portion of the ambient air is drawn by one or more small axial fans ("condensate fans") 642 from the supply vias 635 into the bottom tray 610. The air traversing through the bottom tray 610 and, as part of a condensation management system (discussed in further detail herein below with respect to FIGS. 6H through 6J) collects moisture in the bottom tray 610, in wicking cords 645, and in flat wicks 648, is expelled by the condensate fans 642 as humid air via a humid air outlet 633. As will be appreciated, condensate from the heat exchanger(s) drops through openings into the flat wicks 648 and into the wicking cords 64, and any excess condensate falls into the bottom tray.

In some embodiments, end caps 611 and 612 include a filter that removes particles or other impurities from the ambient air after the ambient air is drawn through the supply vias 635. The filter and end caps are removable so that they can be replaced over time as particulate builds up in the filters.

The system 600 may include two condensation management systems, such as a primary condensation management system and a secondary condensation management system. In the examples shown in FIGS. 6H, 6-I and 6J, the primary condensation management system includes the bottom tray 610, the axial fans 615, wicking cords 645, and the flat wicks 648 (coupled to flat wick nodules 649 which hold the flat wicks in place), while the secondary condensation management system includes the small condensate fans 642 which draw air across the bottom tray 610, the flat wicks 648 and a portion of the wicking cords 645.

The bottom tray 610 can be a single solid piece configured to function as a holding tank for condensation. The wicking cords 645 are coupled between exhaust heat exchangers 622 and the bottom tray 610 to wick condensation from the bottom tray 610 area (and from the flat wicks 648) to the fins 430 of the exhaust heat exchangers 622. The axial fans 615 move warm or ambient air across a portion of the wicking cords 645 extending into and around the heat exchangers 622 (see, FIGS. 6H and 6-I showing the cords entering the housing) to remove moisture so that the cords will continuously draw moisture from the bottom tray area. In some embodiments, the wicking cords 645 are directly connected from supply heat exchangers 624 to the exhaust heat exchangers 622. For example, the wicking cords 645 can wick moisture from a cold side sink directly to a hot side sink.

The secondary condensation management system includes the bottom tray 610, the condensate fans 642, the flat wick inserts 648 (and even the wicking cords 645). In the example shown in FIGS. 6-I and 6J, the second condensation management system is illustrated with the bottom tray 610 removed. Ambient air drawn into the bottom tray 610 area by the condensate fan 642 will absorb moisture built up in the tray 610, on the flat wicks 648, and on a portion of the wicking cords, and remove it via the humid air outlet 633. The flat wicks 648 remove condensate build up by direct contact or indirect contact with the supply heat exchangers 624, and wick the moisture to the bottom tray 610 cavity. The flat wicks 648 are composed of a wicking material adapted to wick moisture without absorbing the moisture. Once saturated, gravity will cause the flat wicks 648 to drip condensate into the bottom condensate management systems or both.

In operation, the secondary condensate management system utilizes the condensate fans 642 to draw ambient air in through the base cavity (formed by the bottom tray 610) via the end caps. This air will pick up moisture from the flat wicks, a portion of the wicking cords and from the surface area of any pooled moisture in the bottom tray. The condensate fans 642 can operate substantially continuously in order to remove condensation, or can operate intermittently when any or a significant amount of moisture is detected (such as by a sensor) in the bottom tray 610.

For example, during a cooling mode, the supply heat exchanger 624 might condense moisture from the air, depending on the temperature and humidity. As the moisture reaches the bottom of the supply heat exchanger 624, it contacts the flat wicks 648 which wicks or absorbs the moisture. The moisture migrates to the dryer parts of the wick 648, which will be its bottom sides due to the active condensate management in the bottom tray, and may be transferred to the wicking cords 645. Additionally, if the flat wicks 648 reach saturation, gravity will cause the water to enter the bottom tray 610 cavity through the holes in a plastic plate of the flat wicks 648. At some levels of saturation, the moisture will drip from the flat wicks 648 into the base plate itself. Once the moisture is in the bottom tray 610 cavity, the primary condensate management draws the moisture from the bottom tray 610 cavity. Wicking cords 645 sit on, or otherwise can be in contact with, the bottom tray 610 and the flat wicks 648. The wicking cords 645 can be composed of any suitable wicking material adapted to wick moisture without absorbing the moisture. The moisture migrates to the dryer parts of the wicking cords 645 (the basic concept of how a wick works), which is driven by the exhaust fans 615 pulling dry (and in the cooling mode, warm) air across the other end of these wicking cords 645 near or at the exhaust heat exchangers 624.

Further, when the system 600 is not actively heating or cooling, one or more (or all) of the axial fans 615, 642 can remain running so that the unit will continually dry out. Therefore, as the thermal transfer device(s) in the system 600 are idle, the condensation management system can continue to control moisture in the system and reduce a potential for mold in the bottom tray. Additionally, the wicking cords 645 and flat wicks 648 are removable so that the user can replace them periodically so that the condensate management system remains effective.

The system is adapted to couple to a power supply (not shown). The power supply can be an external power supply or an internal power supply. The power supply is adapted to provide electrical energy to enable operation of the thermal transfer devices (e.g., 440, 450, 470, 480), the axial fans 615, the internal blower 630, the condensate fans 642 and the remaining systems in the system 600.

The system 600 further includes a power supply (not shown) and a control unit 670 operable for controlling the overall operation and functions of the system 600. The control unit 670 is described in further detail herein below with respect to FIG. 13. The control unit 670 can be configured to communicate with one or more external devices or remotes via a Universal Serial Bus (USB) or wireless communication medium (such as Bluetooth®) to transfer or download data to the external devices or to receive commands from the external device. The control unit 670 may include a power switch adapted to interrupt one or more functions of the system 600, such as interrupting a power supply to the blowers/fans. The power supply is adapted to provide electrical energy to enable operation of the heat transfer device(s) 440, 450, 470, 480 (including the TEC 400), the blowers/fans, and remaining electrical components in the system 600. The power supply can operate at an input power between 2 watts (W) and 200 W (or at 0 W in the passive mode). The control unit 670 may be configured to communicate with a second control unit 670 in a second system 600 operating in cooperation with each other.

FIGS. 7A through 7F illustrate another embodiment of the personal air conditioning control system 105. In this embodiment, the system 105 is identified using reference numeral 700.

In the example illustrated in FIGS. 7A-7F, the system 700 includes a housing 705 (generally rectangular in shape) having a plurality of supply vias 715 disposed on multiple sides of the housing 705. The housing 705 also includes a plurality of exhaust vias 730 disposed on an exhaust side 731 of the housing 705. The housing 705 can be dimensioned to fit under most standard beds.

Figure 7A:
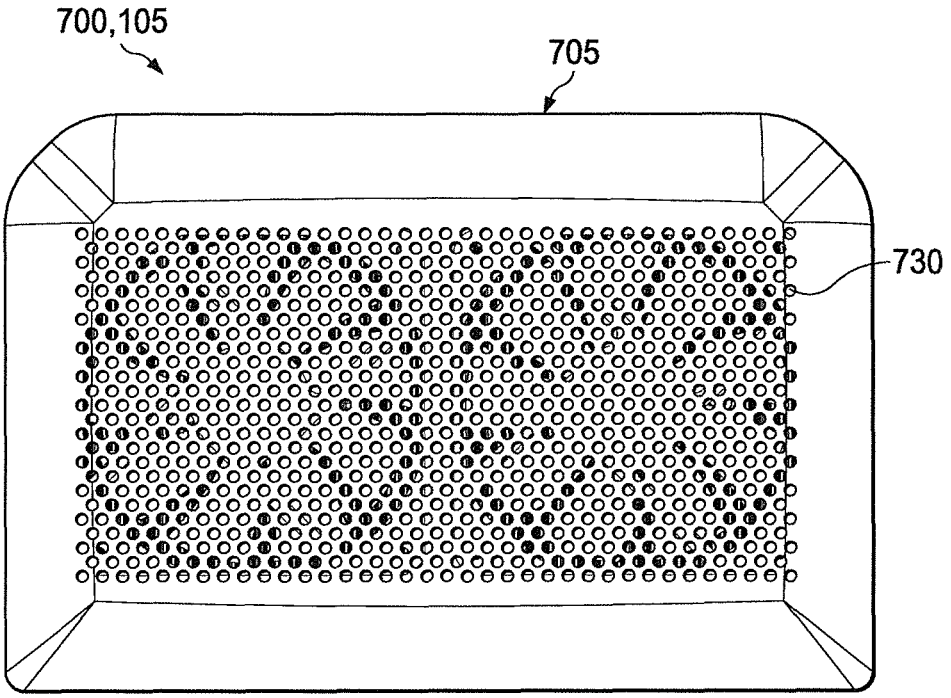
FIGS. 7A through 7F illustrate yet another embodiment of the personal air conditioning control system of the present disclosure.
Figure 7B:
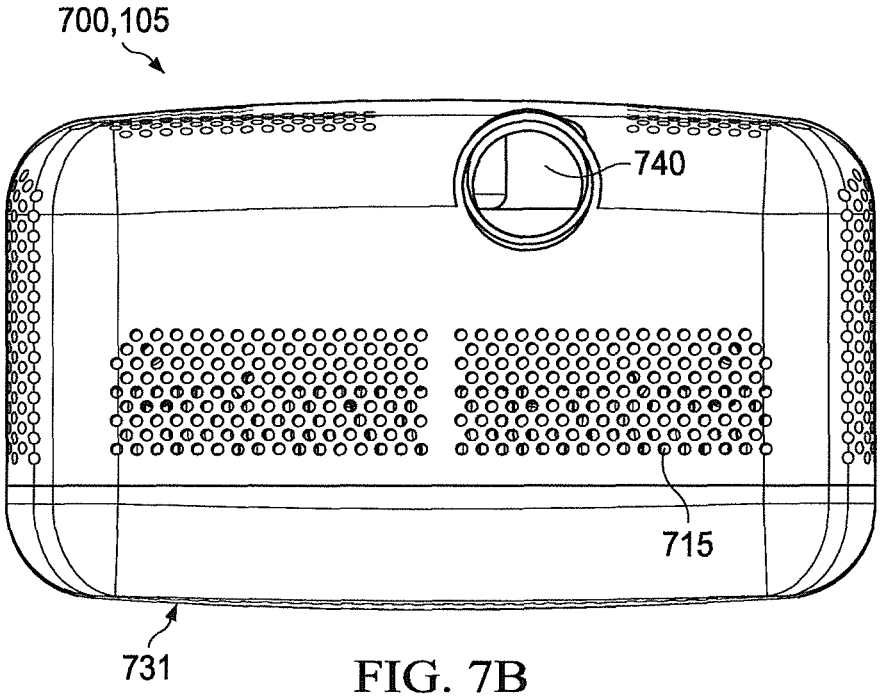
Figure 7C:
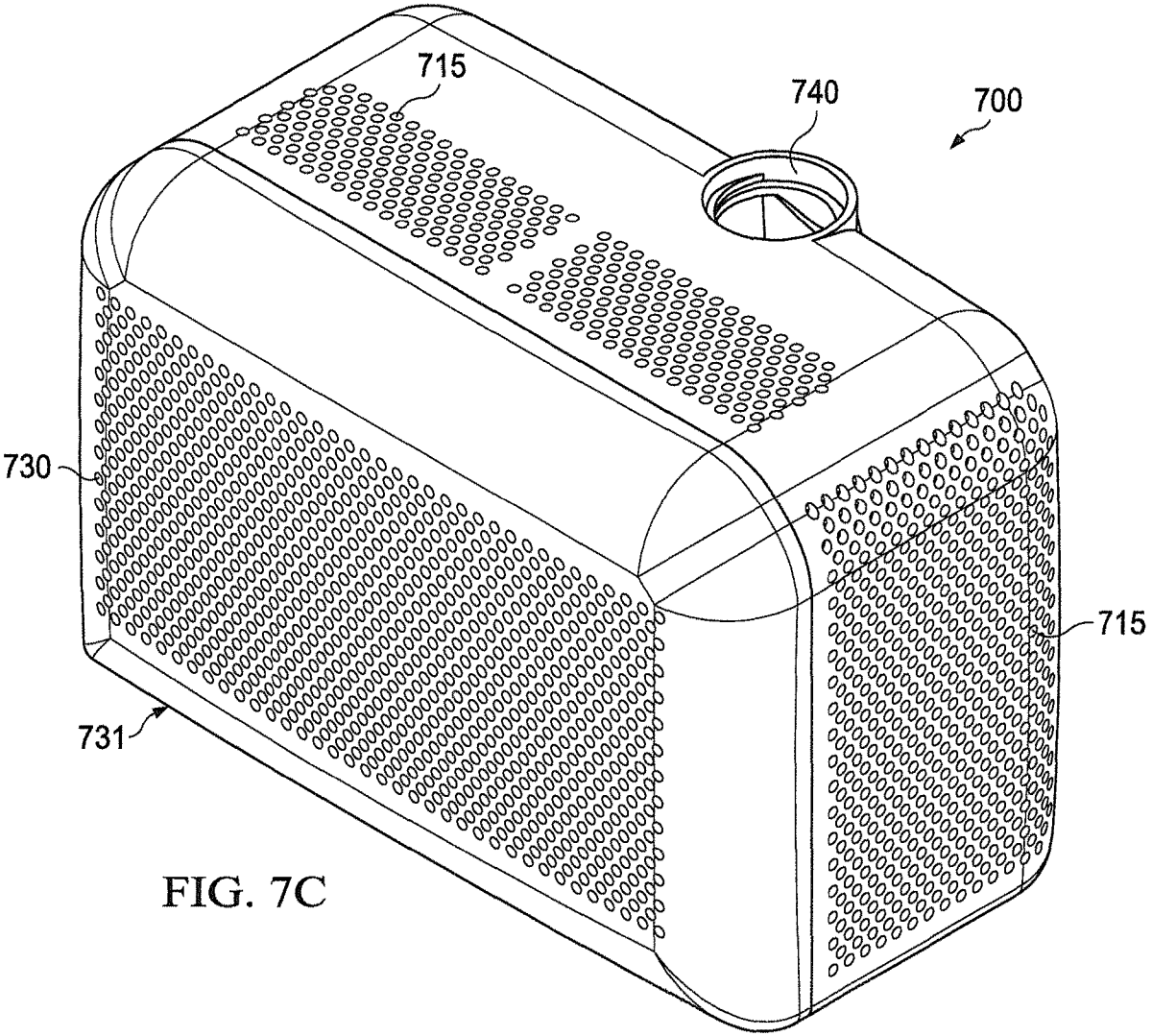
Figure 7D:
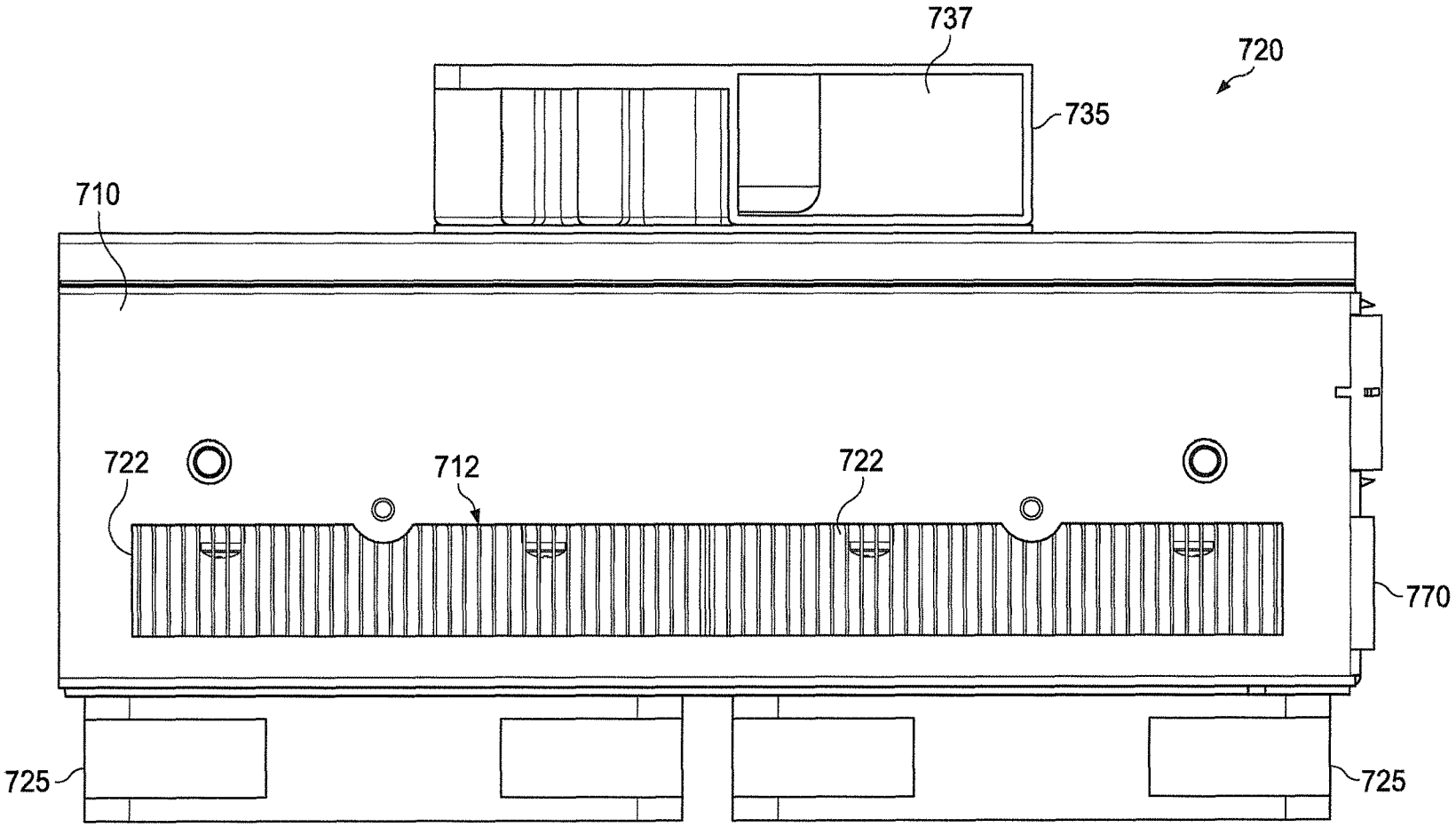

The system 700 includes a thermal transfer device core assembly 720 (as shown in FIG. 7D) which includes two thermal transfer devices (440, 450, 470) coupled together, or may include the thermal transfer device 480 with a single TEC 400, and dual exhaust heat exchangers 722 and a supply heat exchanger 724.

Figure 7E:
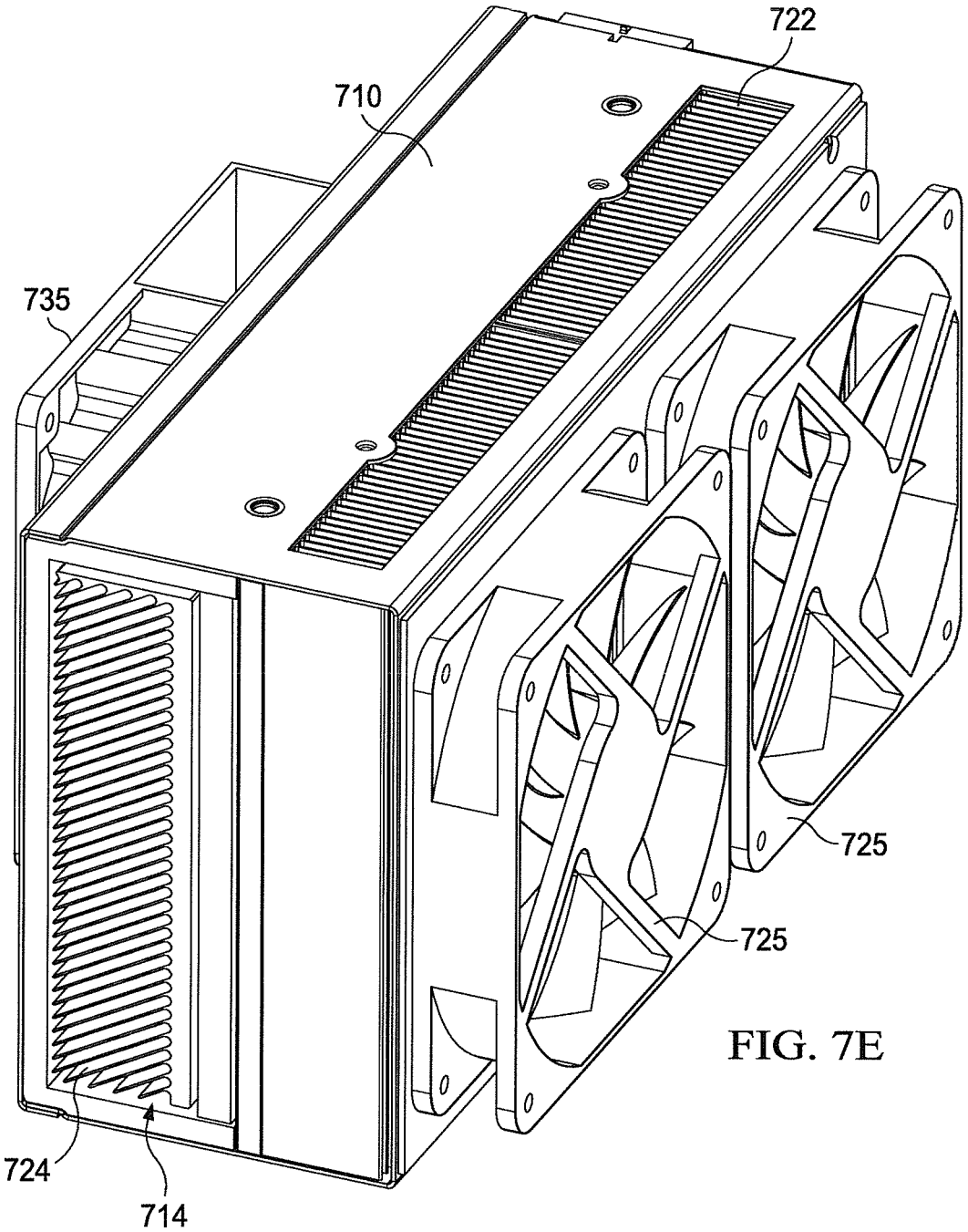
Figure 7F:
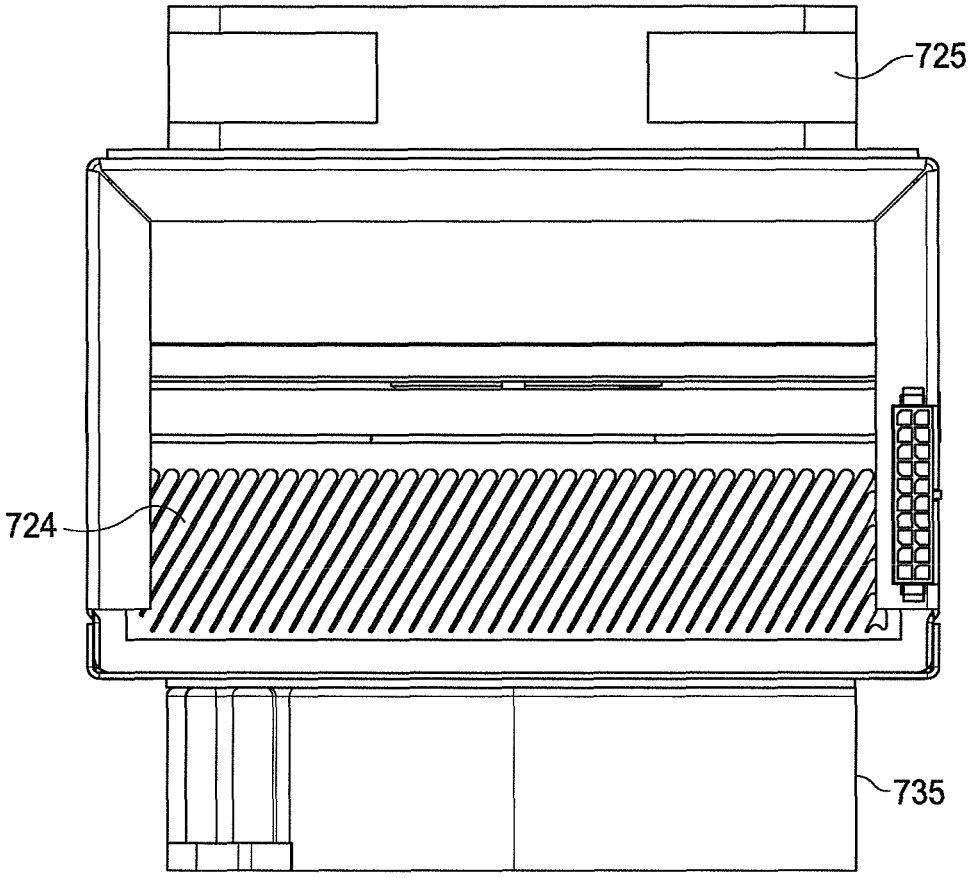

In the example shown in FIGS. 7D through 7F, the housing 705 is shown removed leaving a housing 710 which includes the core assembly 720 therein. The housing 710 can be sheet metal, plastic or the like, and is configured to contain and support the core assembly 720. The housing 710 includes an opening/via 712 proximate the exhaust side heat exchangers 722 and another opening/via 714 proximate to the supply side heat exchangers 724 to allow ambient air to be drawn through and around the exchangers 722, 724.

The system 700 includes a pair of fans 725 configured to draw air across the exhaust side heat exchangers 722. The fans 725 can be ultra silent Noctua® fans, or the like, and are mounted adjacent the exhaust side heat exchangers 722 with rubber mounts and a gasket to reduce vibration. The fans 725 draw air in via the plurality of vias 715 and expel the heated (or cooled in a heating mode) exhaust air out through exhaust vias 730 positioned proximate the fans 725.

Also included is a main fan or blower 735 configured to draw air across the supply side heat exchangers 724. The fan 735 draws ambient air in through the plurality of vias 715 and across the supply side heat exchangers 724 to cool (or heat in a heating mode) the air for delivery to the distribution layer 110 through an outlet 737 leading to a supply outlet 740. The location (placement) of the blower, gasketing and ducting provide additional noise reduction.

The system 700 further includes a power supply (not shown) and a control unit 770 operable for controlling the overall operation and functions of the system 700. The control unit 770 is described in further detail herein below with respect to FIG. 13. The control unit 770 can be configured to communicate with one or more external devices or remotes via a Universal Serial Bus (USB) or wireless communication medium (such as Bluetooth®) to transfer or download data to the external devices or to receive commands from the external device. The control unit 770 may include a power switch adapted to interrupt one or more functions of the system 700, such as interrupting a power supply to the blowers/fans. The power supply is adapted to provide electrical energy to enable operation of the heat transfer device(s) 440, 450, 470, 480 (including the TEC 400), the blowers/fans, and remaining electrical components in the system 700. The power supply can operate at an input power between 2 watts (W) and 200 W (or at 0 W in the passive mode). The control unit 770 may be configured to communicate with a second control unit 770 in a second system 700 operating in cooperation with each other.

Figure 8A:
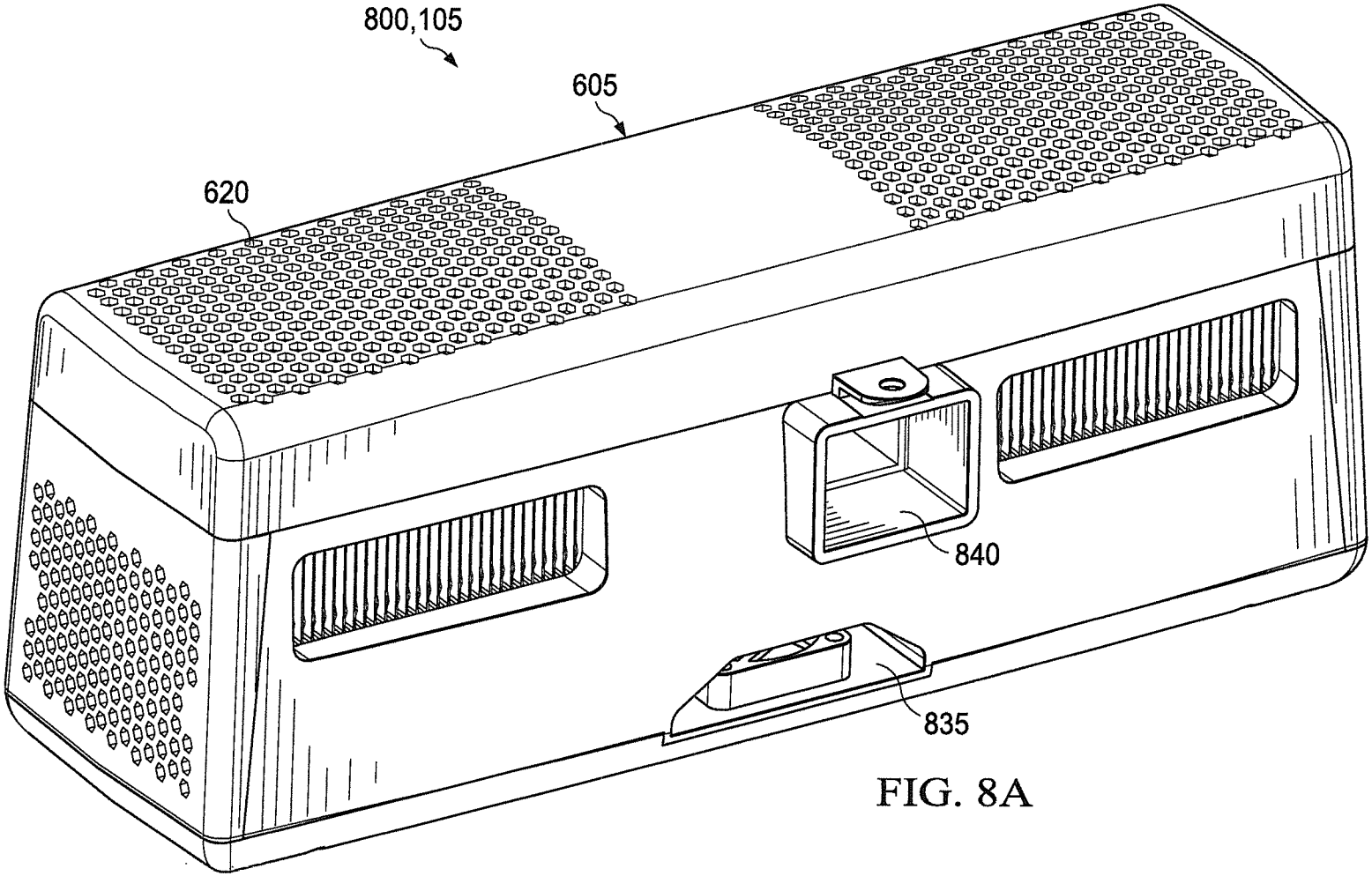
FIGS. 8A and 8B illustrate still yet another embodiment of the personal air conditioning control system that utilizes passive regeneration according to the present disclosure.
Figure 8B:
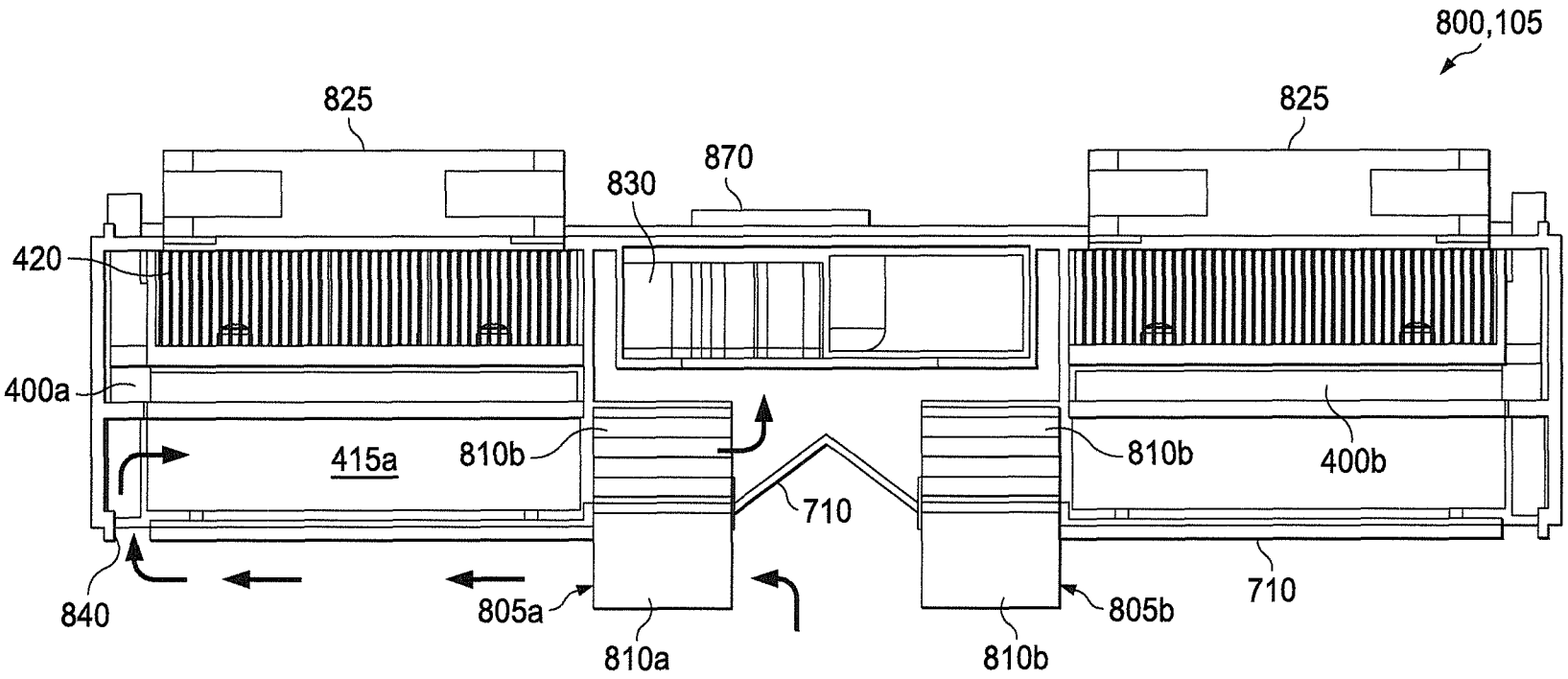

FIGS. 8A and 8B illustrate yet another personal air conditioning system 105 with passive regeneration according to the present disclosure. In this embodiment, the system 105 is identified using reference numeral 800.

As shown in FIG. 8A, the system 800 includes a housing substantially similar to the housing 605 for the system 600. This system 800, however, is adapted or configured to perform passive regeneration.

In passive regeneration, incoming air is pre-cooled by a first sink that has been cooled by conditioned air coming from the supply sink to assist in lowering the relative humidity of the conditioned air. The system 800 is configured similar to the system 700 by including the core assembly 720 which includes two TECs 400*a* and 400*b*. The TECs 400*a*, 400*b* are separated by a pair of displaced sinks (DP sink) 805 disposed in a staggered relationship between the TECs 400*a*, 400*b* such that the DP sinks 805 are offset from the TECs.

As previously noted, core assembly 720 is contained within a housing 710. Each TEC 400*a*, 400*b* is thermally coupled to the exhaust heat exchangers 420 (hot) and the supply heat exchangers 415 (cold). The exhaust sinks 420 with fins 430 transfer heat away from the hot side of the corresponding TEC 400*a*, 400*b* to an air flow. The supply sinks 415 with fins 430 transfer cold energy from the cold side of the corresponding TEC 400*a*, 400*b* to an air flow. As will be appreciated the fins 430 may be configured as set forth in the heat transfer devices 440, 450, 470.

The DP sinks 805 each include a first DP sink 805*a* having a plurality of fins 810 and a second DP sink 805*b* having a plurality of fins 810. The fins 810 can be slanted in multiple orientations to help direct and manage condensate. Due to the staggering of the TECs 400 and the DP sinks 805, a first set of DP sink fins 810*a* extends from, or is otherwise not contained within, the housing 710. In addition, a second set of DP sink fins 810*b* is substantially aligned with the supply sinks 415.

A pair of axial fans 825 are configured to draw air across the hot sinks 420 for each of the TECs 400. The fans 825 can be ultra silent Noctua® fans, or the like, and are mounted, adjacent to the exhaust sinks 420, with rubber mounts and a gasket to reduce vibrations. The fans 825 draw air in through the ambient air intakes 625 (illustrated in FIGS. 6A and 6B) and expel the heated exhaust air out through proximate ones of the exhaust vias 620.

A main cold side fan or blower 830 mounted between the TECs 400 and adjacent to the DP sinks 805 is included to draw air ambient air into the system 800 and across the DP sinks 805 and supply sinks 415 (cold). For example, the fan 830 draws ambient air in through the opening 835 that is proximate to an area between the DP sinks 805. A portion of ambient air is channeled or otherwise flows through the DP sink fins 810*a*. It will be understood that the example shown in FIG. 8B illustrates air flow on one side of the system; however, similar operations occur on the other side. The ambient air is pre-cooled as it passes through the DP sink fins 810*a*. The pre-cooled air then flows through opening 840 in the internal housing 710 and through the supply sink 415*a* where it is cooled further. By pre-cooling the ambient air, the supply sink 415*a* is operable to cool the air to a temperature lower than when pre-cooling is not performed. Then, the cooled air flows over the DP sink fins 810*b*. The DP sink fins 810*b* increase the temperature of the air and reduce the relative humidity of the air. By pre-cooling and cooling, the air is cooled to a lower temperature than by use of a single-stage cooling process. Then the cooled air passes through the main fan 830 and is delivered to the distribution layer 110 through the supply outlet 840. In addition, passive regeneration can employ a similar process to preheat ambient with the DP sinks 805.

As with prior embodiments, the system 800 further includes a power supply (not shown) and a control unit 870 operable for controlling the overall operation and functions of the system 800. The control unit 870 is described in further detail herein below with respect to FIG. 13. The control unit 870 can be configured to communicate with one or more external devices or remotes via a Universal Serial Bus (USB) or wireless communication medium (such as Bluetooth®) to transfer or download data to the external devices or to receive commands from the external device. The control unit 870 may include a power switch adapted to interrupt one or more functions of the system 800, such as interrupting a power supply to the blowers/fans. The power supply is adapted to provide electrical energy to enable operation of the heat transfer device(s) 440, 450, 470, 480 (including the TEC 400), the blowers/fans, and remaining electrical components in the system 800. The power supply can operate at an input power between 2 watts (W) and 200 W (or at 0 W in the passive mode). The control unit 870 may be configured to communicate with a second control unit 870 in a second system 800 operating in cooperation with each other.

Figure 9A:
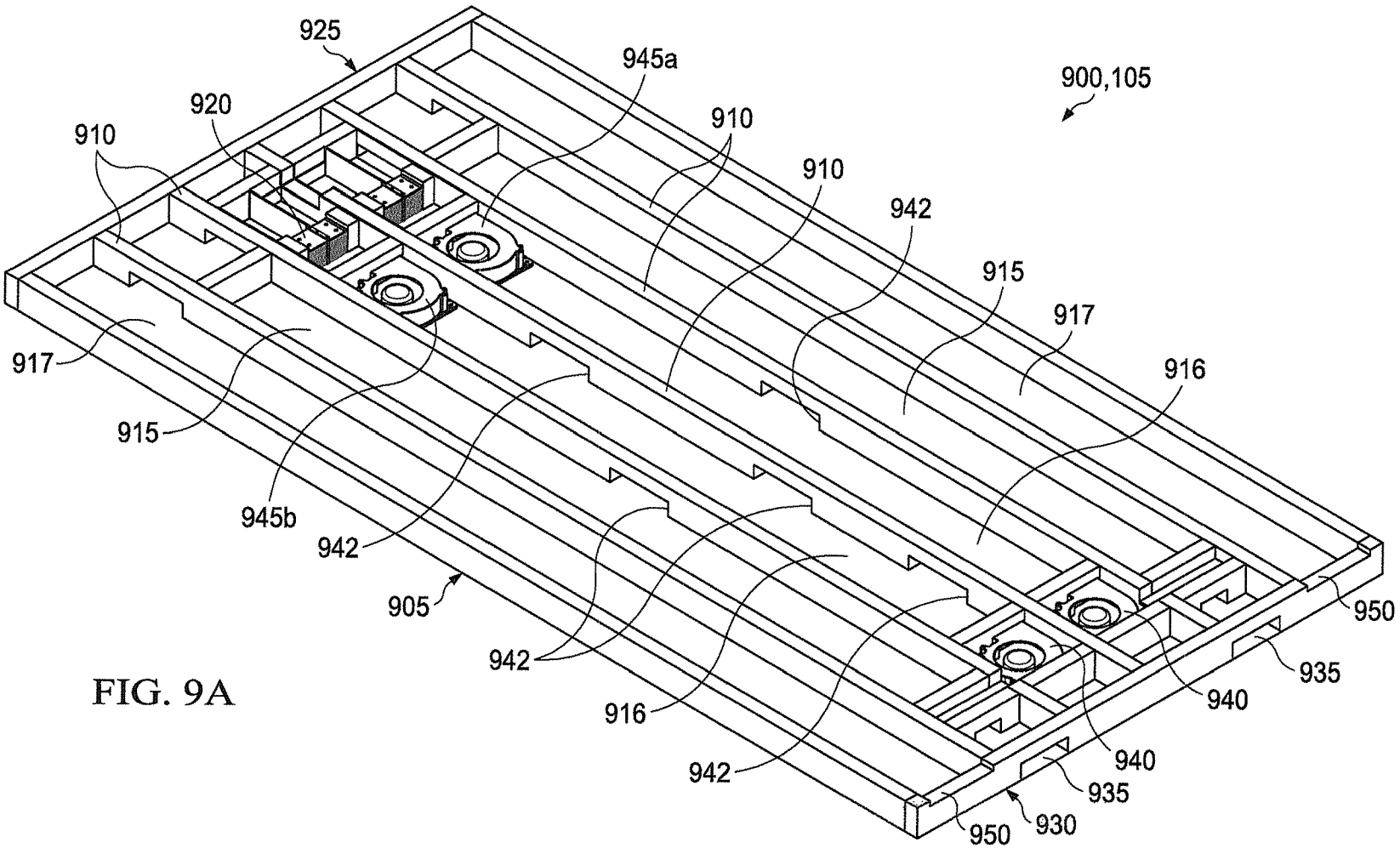
FIGS. 9A through 9C illustrate another embodiment of the personal air conditioning control system for positioning between the mattress and lower supporting foundation according to the present disclosure.
Figure 9B:
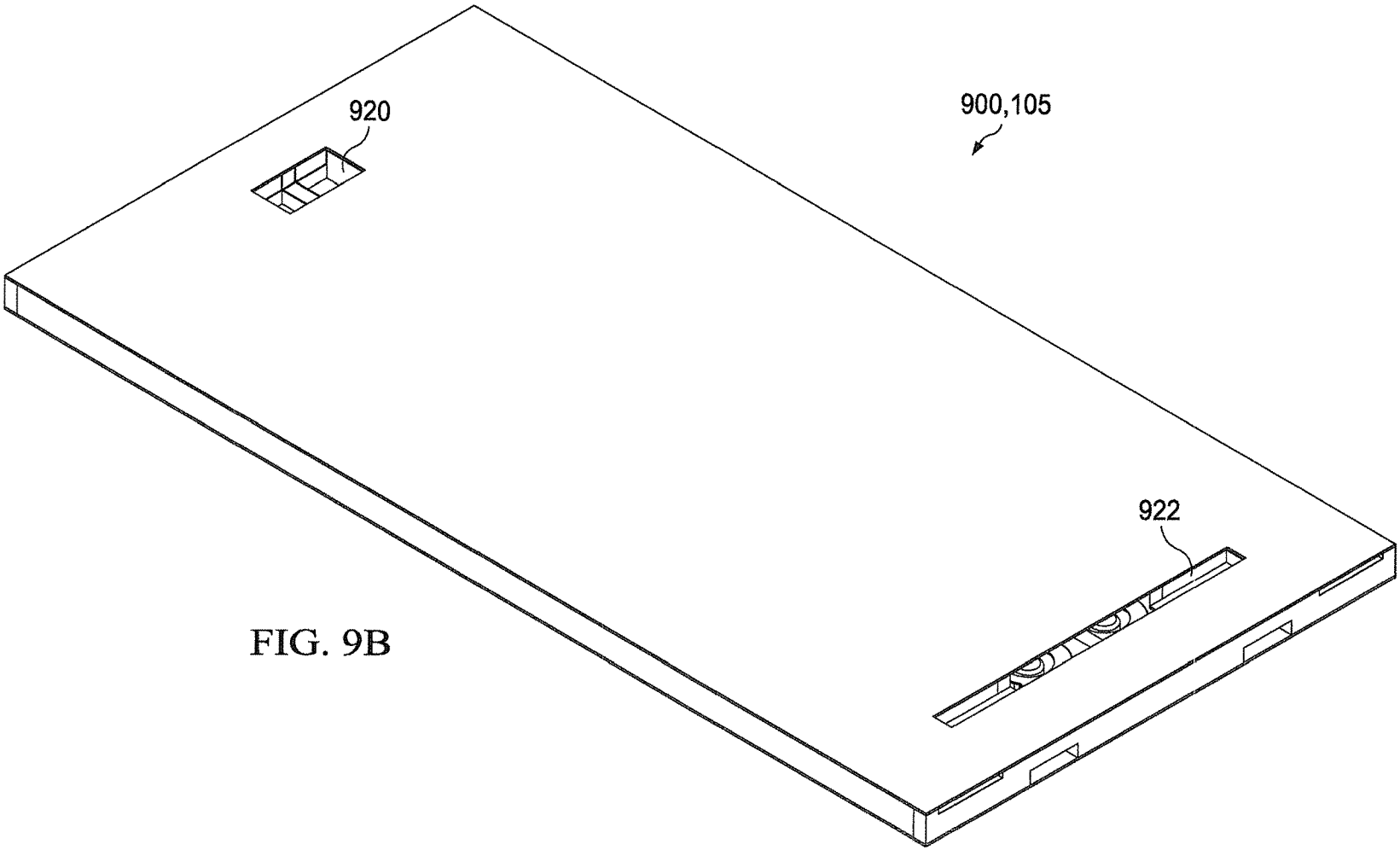
Figure 9C:
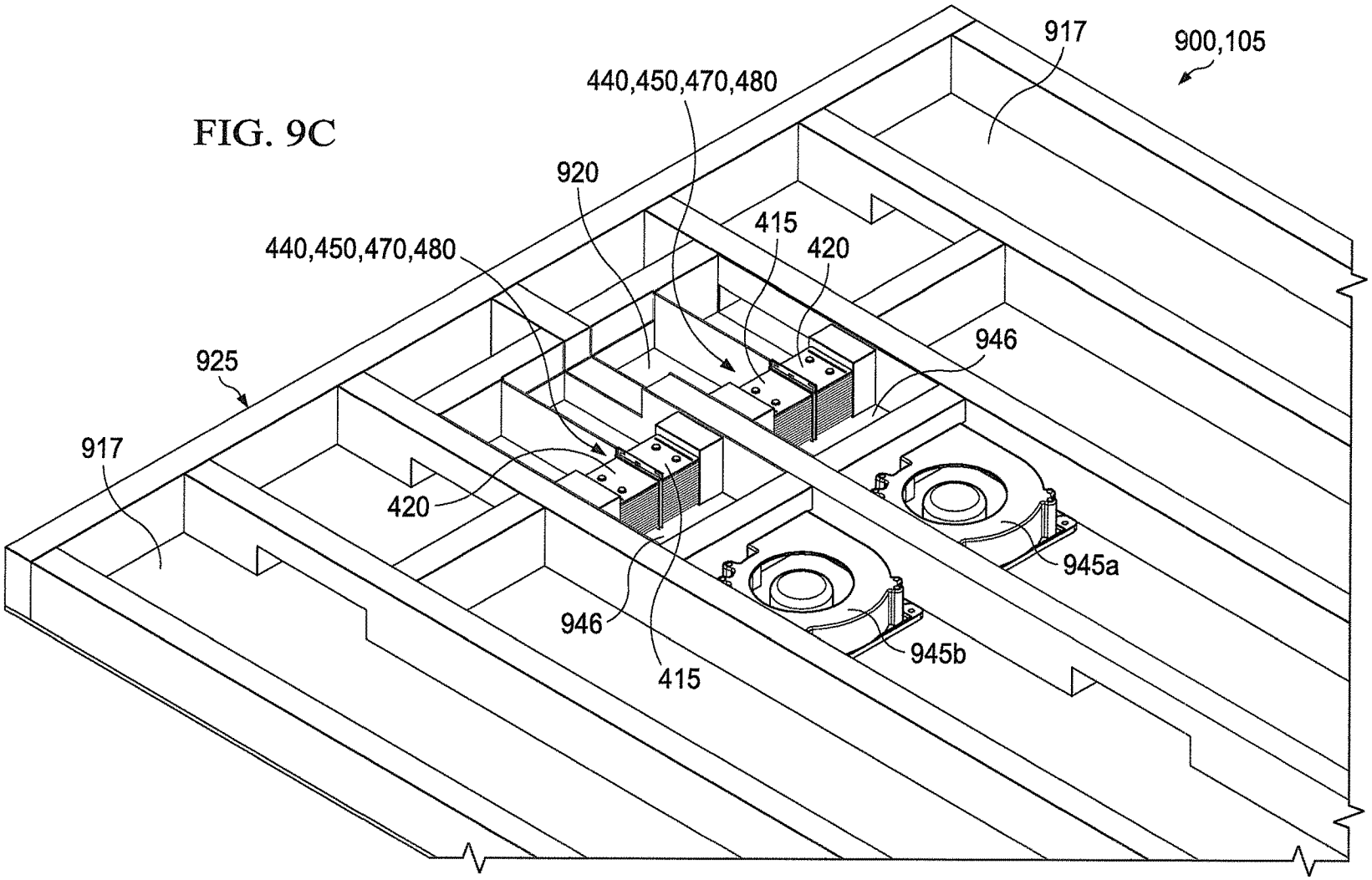

FIGS. 9A through 9C illustrate another embodiment of the personal air conditioning control system 105. In this embodiment, the system 105 is identified using reference numeral 900.

The system 900 may be positioned between the mattress 50 and a box-spring, foundation or floor 55, and is dimensioned to be used with standard bed sheets and linens or bed skirt such that customization of the bed sheets, linens and/or bed skirt is unnecessary or may only require slight modification.

As with the other embodiments, the system 900 may include one or more thermal heat transfer devices 440, 450, 470, 480 which includes at least one TEC 400. A housing 905 composed of wood, plastic, Styrofoam, metal, or the like (or any combination thereof) includes a number of dividers 910 that define a number of air flow channels—including fresh air (ambient) channels 915 and exhaust air channels 917. The system 900 is configured to deliver conditioned air to the distribution layer 110.

Housing 905 includes a supply outlet 920 adapted to couple to an extension from the distribution layer 110 that is similar to the triangular tongue extension region 252. The distribution layer 110 is coupled to the system 900 at a first (supply) end 925, via the extension region 252, wraps around the mattress 50 and is secured at a second end 930, and will likewise re-circulate the air through the supply inlet 922. For example, the distribution layer 110 may be secured at the second end 930 using an additional extension region 252 as seen at the head of the mattress. In some embodiments, the system 900 and the distribution layer 110 include one or more fastening means to couple or otherwise secure the distribution layer 110 to the housing 905 of the system 900.

Channel dividers 910 include a number of openings or passageways 942 (such as vias or through-ways) that allow fresh air from fresh air inlets 935 and conditioned air (recirculated) from the supply inlet 922 towards the thermal transfer device(s) (440, 450, 470, 480). Supply blowers or fans 945*a*, 945*b* push this combined air flow into the airbox region 946.

Substantially equal volumes of air pass over the supply sinks 415 and the exhaust sinks 420 of the thermal transfer devices. A first portion of the air (supply) is actively user-controlled cooled or warmed as it passes through and around the fins 430 connected to the supply sinks 415. The air flows through the supply outlet 920 to the distribution layer 110. A second portion of air (exhaust) is warmed or cooled as it passes through and around the fins 430 connected to the exhaust sinks 420. The exhaust air is directed by the channels 917 towards exhaust outlets 950 at the end 930.

Additional fans 940 assist in pulling the conditioned air through the distribution layer 110 and recirculated again through the thermal transfer devices (and some portion of this air may exit as exhaust). In this configuration, fresh air drawn into the system and at least a portion of recirculated air are passed through the conditioning system.

As with prior embodiments, the system 900 further includes a power supply (not shown) and a control unit 970 operable for controlling the overall operation and functions of the system 900. The control unit 970 is described in further detail herein below with respect to FIG. 13. The control unit 970 can be configured to communicate with one or more external devices or remotes via a Universal Serial Bus (USB) or wireless communication medium (such as) Bluetooth® to transfer or download data to the external devices or to receive commands from the external device. The control unit 970 may include a power switch adapted to interrupt one or more functions of the system 900, such as interrupting a power supply to the blowers/fans. The power supply is adapted to provide electrical energy to enable operation of the heat transfer device(s) 440, 450, 470, 480

(including the TEC 400), the blowers/fans, and remaining electrical components in the system 900. The power supply can operate at an input power between 2 watts (W) and 200 W (or at 0 W in the passive mode). The control unit 970 may be configured to communicate with a second control unit 970 in a second system 900 operating in cooperation with each other.

Figure 10:
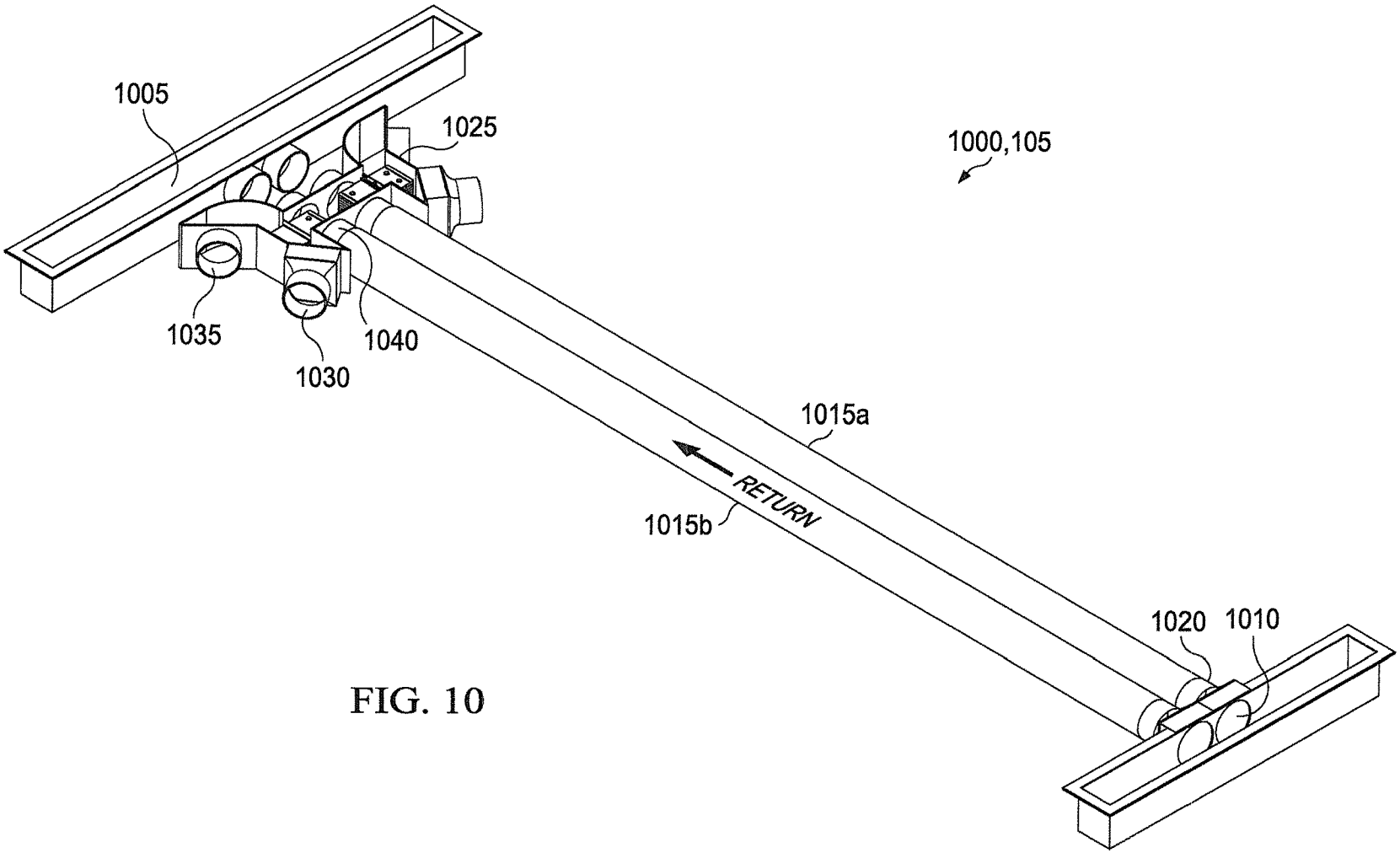
FIG. 10 illustrates another embodiment of the personal air conditioning control system for positioning between the mattress and lower supporting foundation according to the present disclosure.

Now turning to FIG. 10, there is illustrated yet another embodiment of the personal air conditioning control system 105. In this embodiment, the system 105 is identified using reference numeral 1000.

The system 1000 may be positioned between mattress 50 and a box-spring 55 as long as there is additional support structure for the mattress 50. The tubular system 1000 is dimensioned to be used with standard bed sheets and linens or bed skirt such that customization of the bed sheets, linens and/or bed skirt is unnecessary or may only require slight modification.

In another embodiment, it may be positioned inside the mattress 50 or box-spring 55. The system may be contained or otherwise surrounded by a housing structure (not shown), which may be composed of plastic, Styrofoam, metal or the like (or any combination thereof).

As with other embodiments of the system 105, the system 1000 may include one or more thermal heat transfer devices 440, 450, 470, 480 which include at least one TEC 400. In the example shown in FIG. 10, the system functions to re-circulate air through the distribution layer 110. A supply outlet 1005 is adapted to couple to an inlet extension of the distribution layer 110 (e.g., the triangular tongue extension region 252). The distribution layer 110 also includes an outlet extension (similar to the inlet extension) for coupling to a return inlet 1010. As shown, the return inlet 1010 is coupled to return channels 1015*a*, 1015*b* which may be arranged as a pair of tubes or piping. These return channels may be constructed of metal, plastic or the like.

Located adjacent the return inlet 1010 are one or more tube axial fans 1020. These may be positioned within the channels 1015*a*, 1015*b*. In one example, a first tube axial fan 1020 is disposed at the opening of a first return channel 1015*a* and a second tube axial fan 1020 is disposed at the opening of a first return channel 1015*b*. In another example, a single tube axial fan 1020 is disposed at an opening of both return channels 1015. The tube axial fan 1020 draws air from the distribution layer 110 and pushes the air through the return channels 1015 such that each of the return channels 1015 carries a portion of the air received from the distribution layer 110.

Figure 11A:
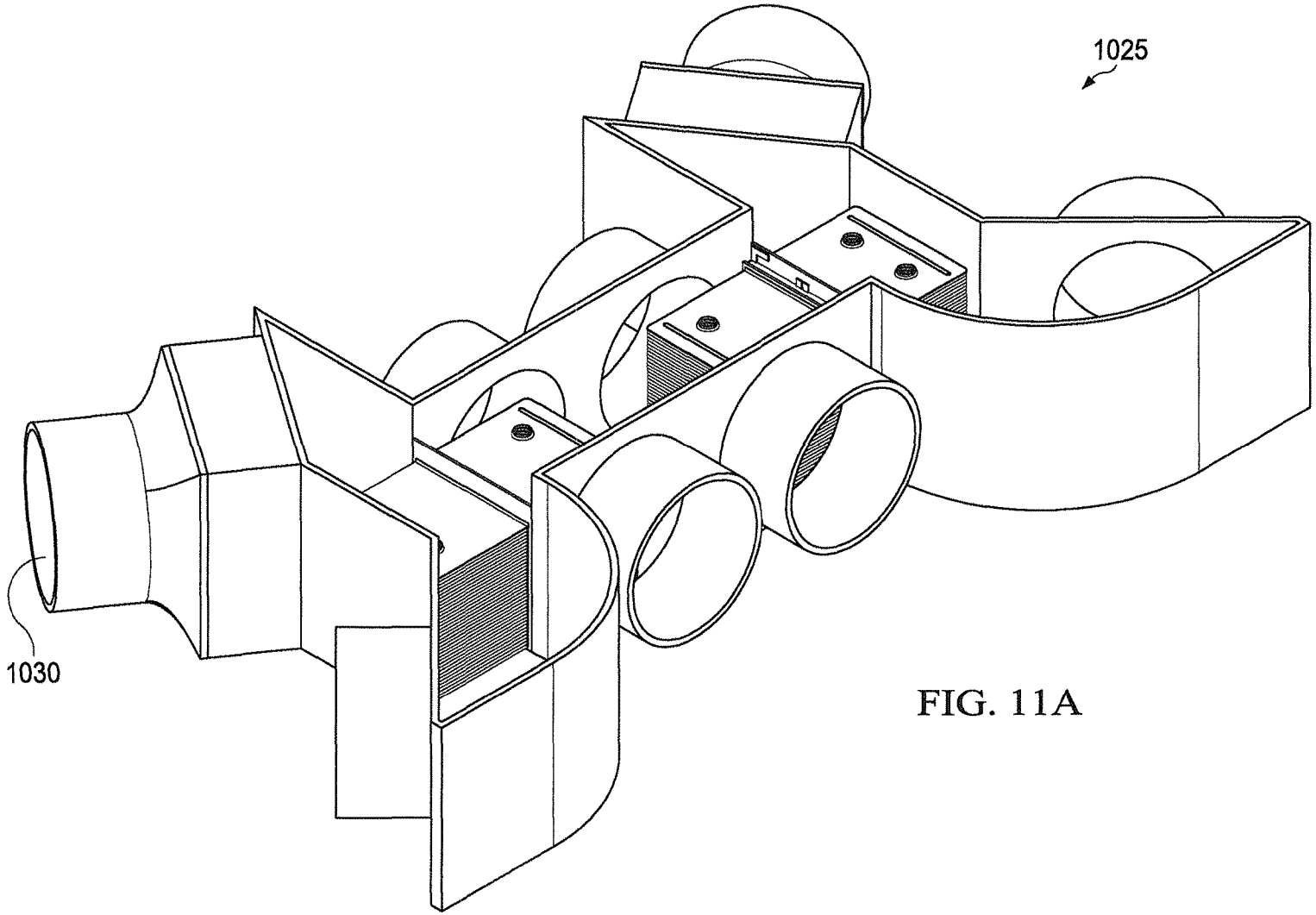
FIGS. 11A through 11C illustrate the heat pump chamber shown in FIG. 10.
Figure 11B:
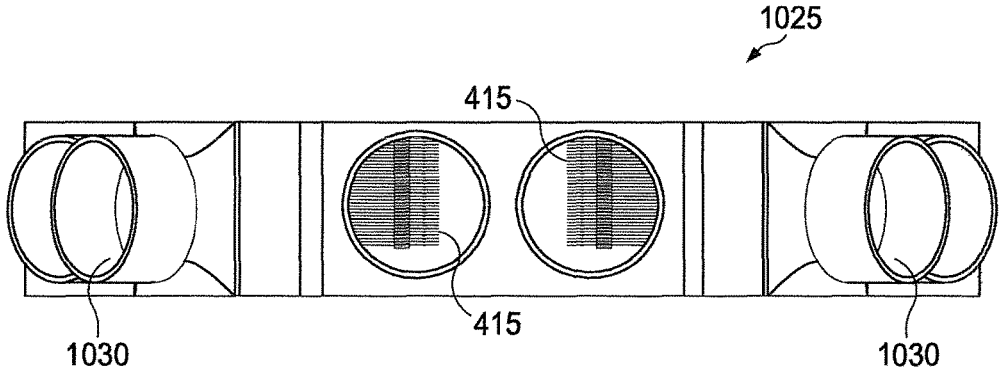
Figure 11C:
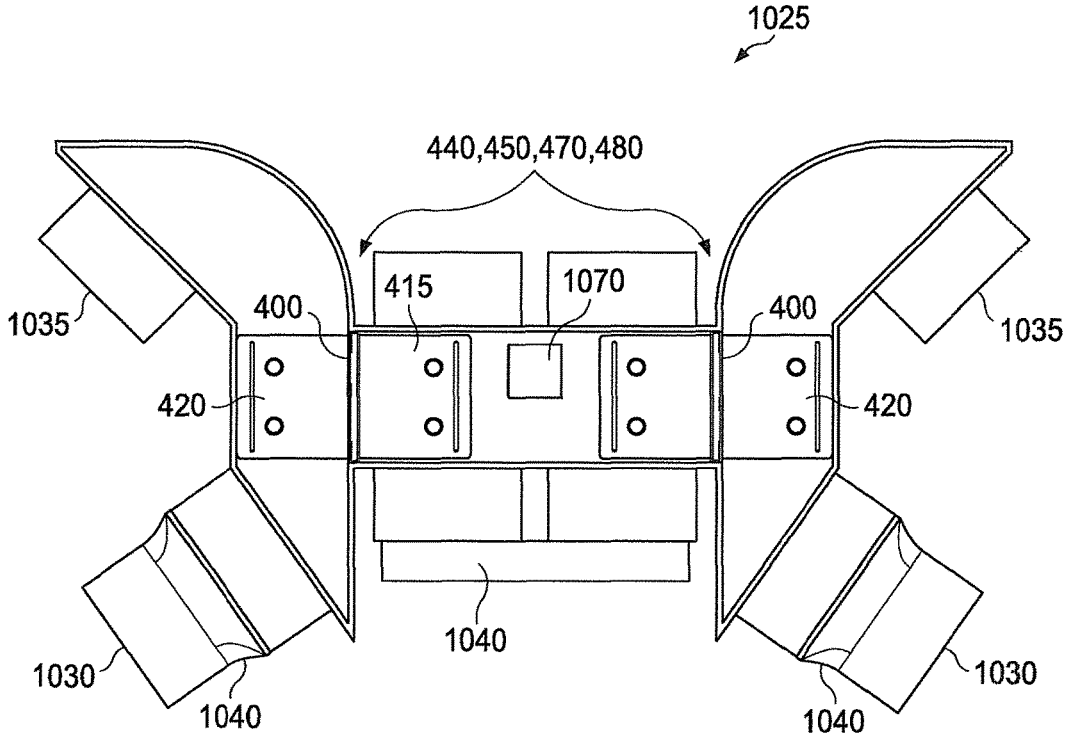
Figure 12A:
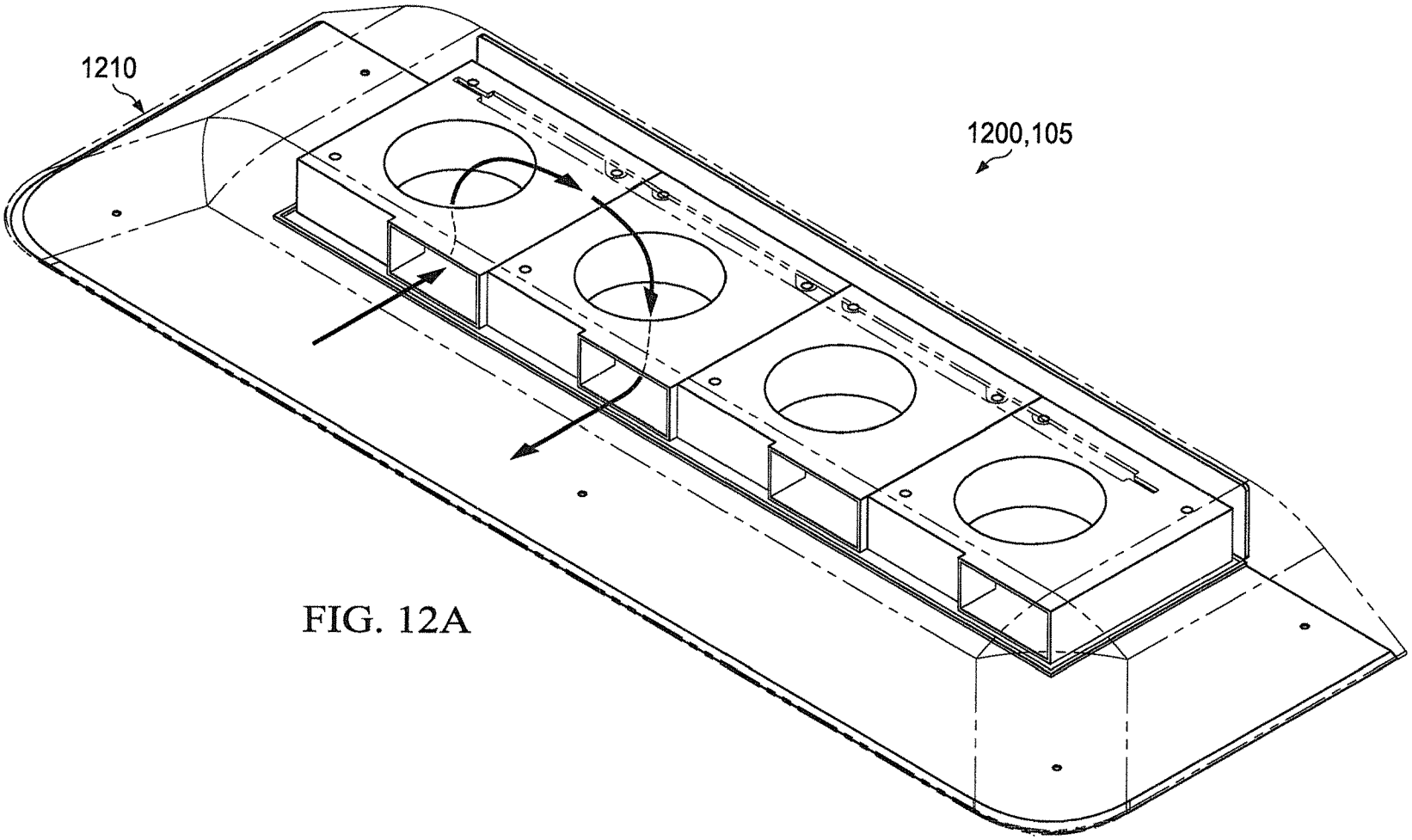
FIGS. 12A through 12I illustrate another embodiment of the personal air conditioning control system for positioning at the ends of the mattress and between the mattress and the lower supporting foundation according to the present disclosure.
Figure 12B:
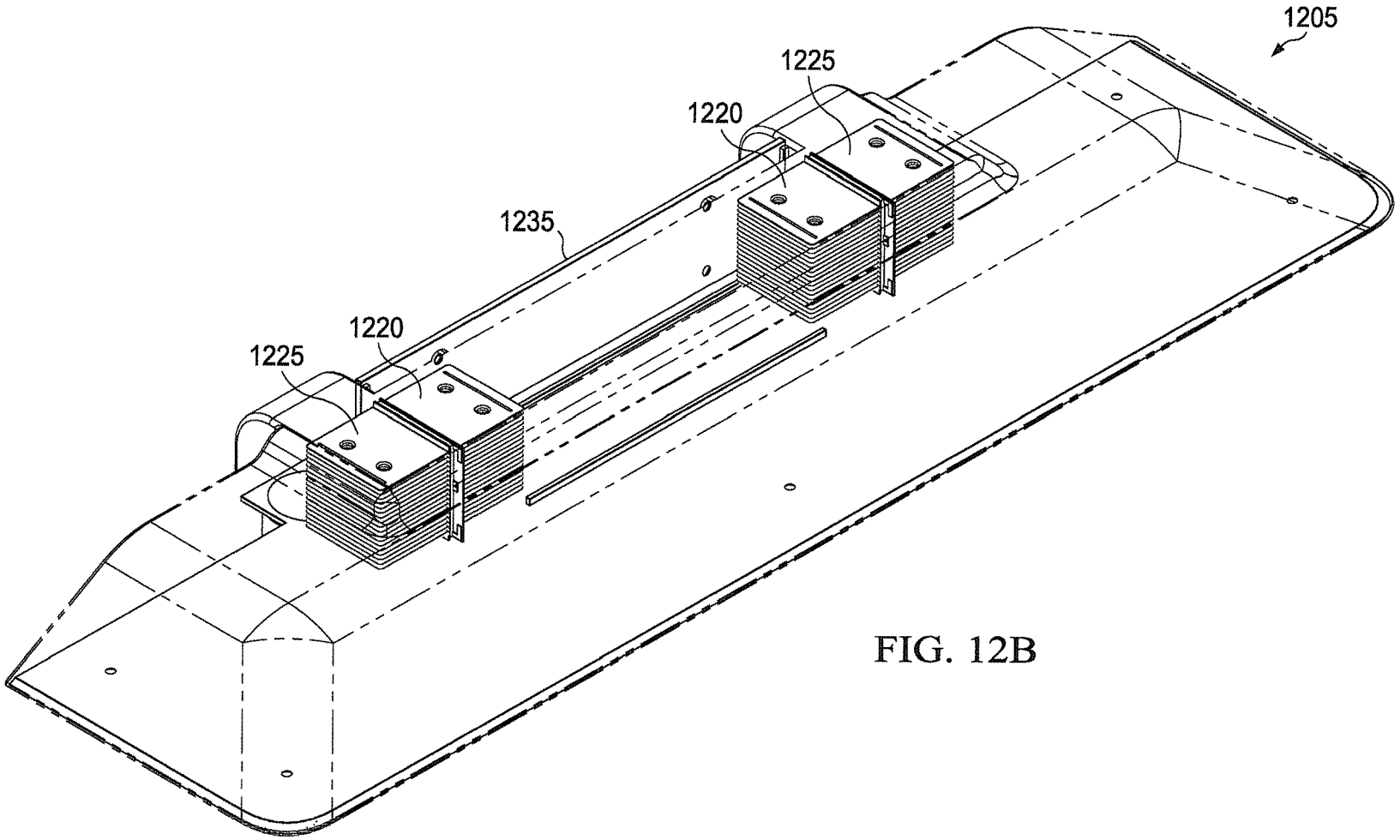
Figure 12C:
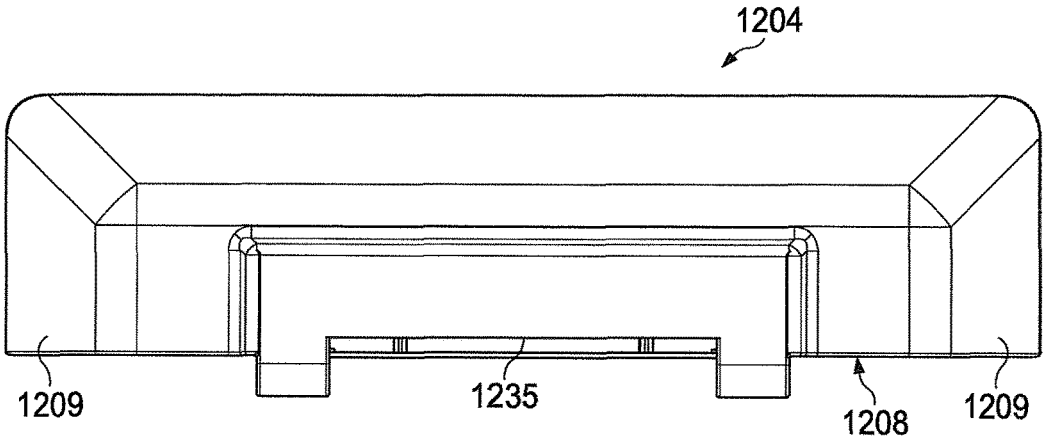
Figure 12D:
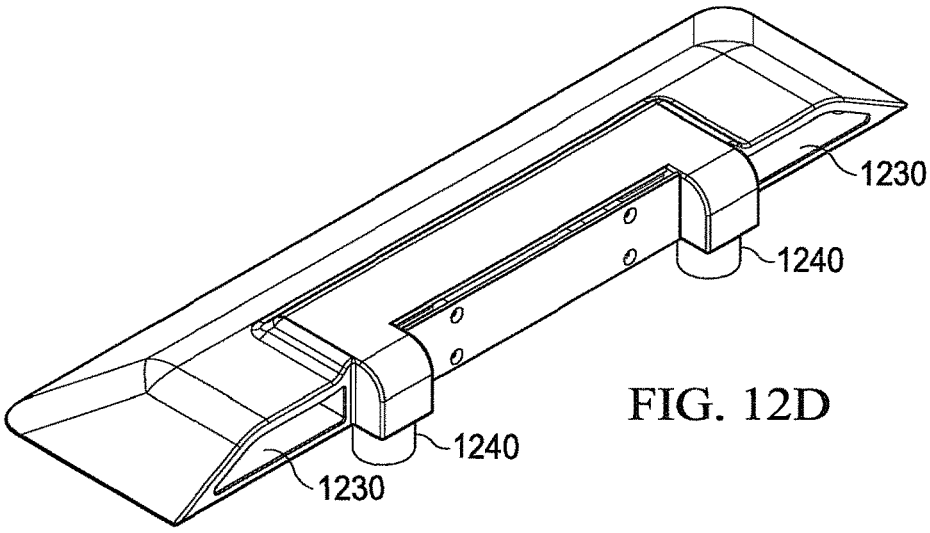
Figure 12E:
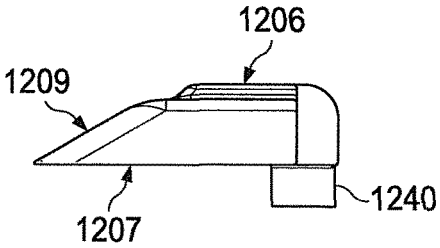
Figure 12F:
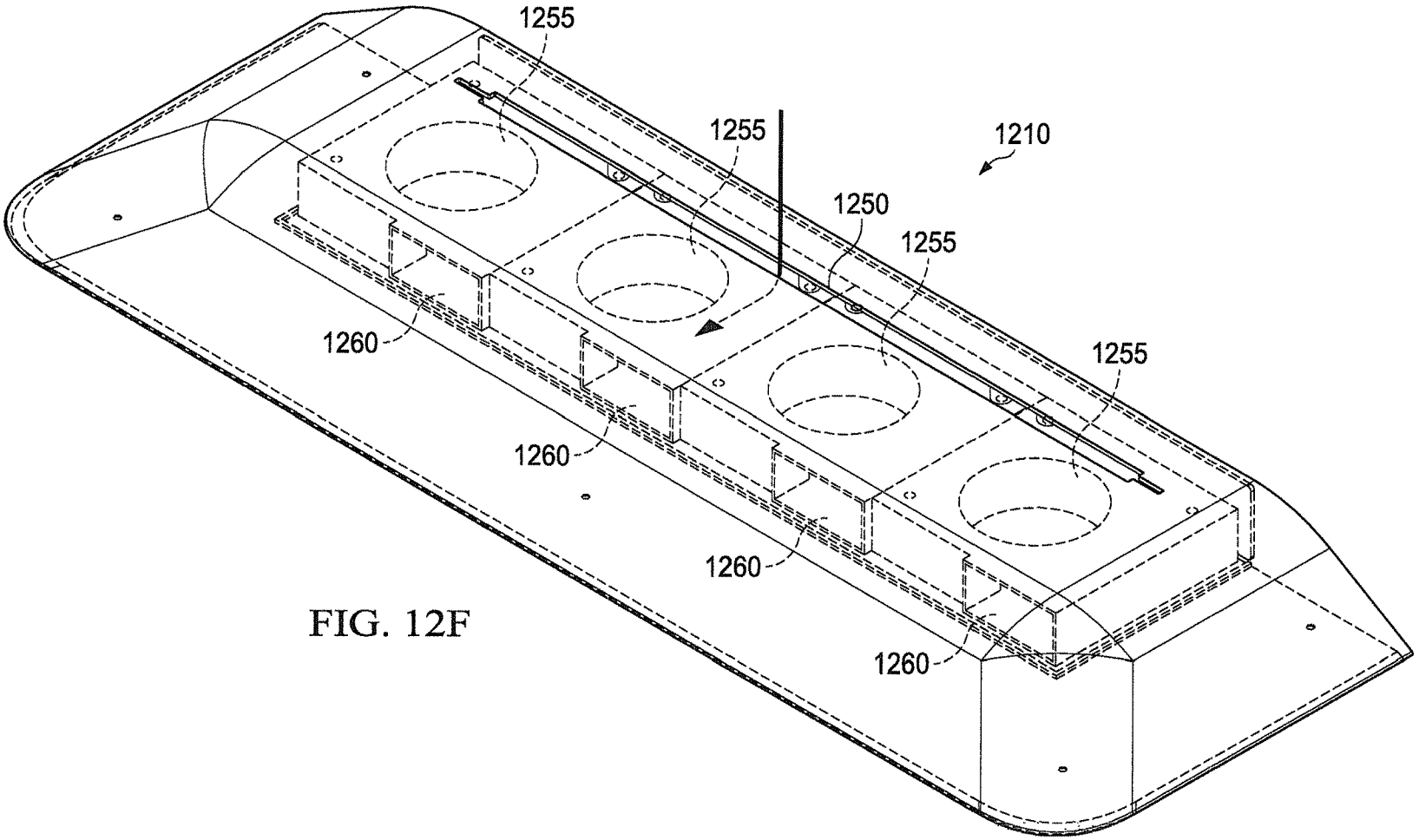
Figure 12G:
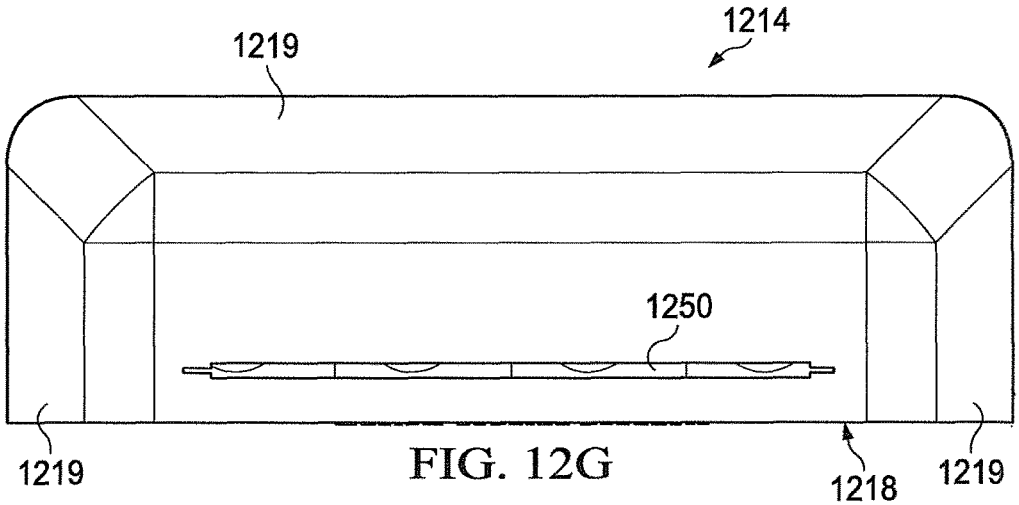
Figure 12H:
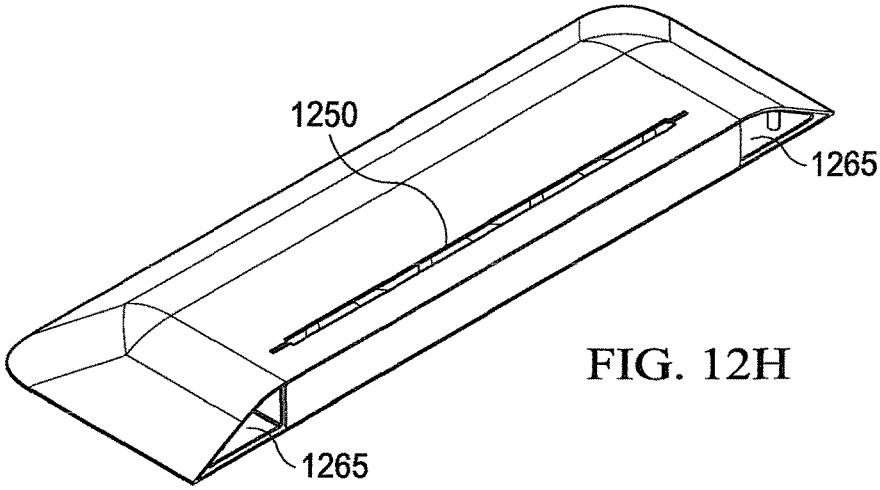
Figure 12I:
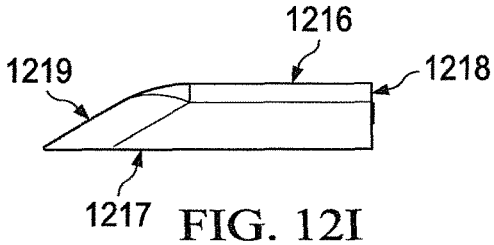

The return channels 1015 are coupled to a heat pump chamber 1025, illustrated in further detail in FIGS. 11A through 11C. The heat pump chamber 1025 is shown with two heat transfer devices (e.g., 440, 450, 470, 480) each with a TEC 400. The heat pump chamber 1025 also includes one or more fresh air inlets 1030 and one or more exhaust outlets 1035. The supply sinks 420 (cold side) can be aligned with the channels 1015 while the exhaust sinks 415 (hot side) can be positioned between the fresh air inlets 1030 and exhaust outlets 1035.

Another pair of supply tube axial fans 1040 draws air in through the fresh air inlets 1030 and over the exhaust sinks 415 to be vented via exhaust outlets 1035. Although the example shown in FIGS. 10 and 11A through 11C illustrate a configuration for providing cooled air to the distribution layer 110, the heat pump chamber 1025 can be configured to provide heated air to the distribution layer as well.

As with the prior embodiments, the system 1000 further includes a power supply (not shown) and a control unit 1070 operable for controlling the overall operation and functions of the system 1000. The control unit 1070 is described in further detail herein below with respect to FIG. 13. The control unit 1070 can be configured to communicate with one or more external devices or remotes via a Universal Serial Bus (USB) or wireless communication medium (such as Bluetooth®) to transfer or download data to the external devices or to receive commands from the external device. The control unit 1070 may include a power switch adapted to interrupt one or more functions of the system 1000, such as interrupting a power supply to the blowers/fans. The power supply is adapted to provide electrical energy to enable operation of the heat transfer device(s) 440, 450, 470, 480 (including the TEC 400), the blowers/fans, and remaining electrical components in the system 1000. The power supply can operate at an input power between 2 watts (W) and 200 W (or at 0 W in the passive mode). The control unit 1070 may be configured to communicate with a second control unit 1070 in a second system 1000 operating in cooperation with each other.

Now turning to FIGS. 12A through 12I, there is illustrated still yet another embodiment of the personal air conditioning control system 105. In this embodiment, the system 105 is identified using reference numeral 1200 and includes two separate units for positioning at different locations between the mattress 50 and a box-spring 55. The two separate units are a headwedge 1205 (FIGS. 12B-12E) and a footwedge 1210 (FIGS. 12F-12I).

The headwedge 1205 includes a housing 1204 (constructed of wood, plastic, Styrofoam, metal, or the like, or any combination thereof) having a top 1206, a bottom 1207, an outside edge 1208 and a number of inside edges 1209. The inside edges 1209 are slanted such that the headwedge 1205 can be "wedged" between the mattress 50 and the box-spring 55.

Similarly, the footwedge 1210 includes a housing 1214 (constructed of wood, plastic, Styrofoam, metal, or the like, or any combination thereof) having a top 1216, a bottom 1217, an outside edge 1218 and a number of inside edges 1219. The inside edges 1219 are slanted such that the footwedge 1210 can be "wedged" between the mattress 50 and the box-spring 55.

The headwedge 1205 includes at least one thermal transfer device (e.g., 440, 450, 470, 480) and a pair of blowers or fans 1225 that draws a first portion of ambient air over the exhaust sinks 420 coupled to the TEC(s) 400 in the headwedge 1205. As will be appreciated, multiple blowers or fans 1255 in the footwedge 1210 draws a second portion of ambient air over the exhaust sinks 420 coupled to the TEC(s) 400 within the headwedge 1205. Ambient air enters via supply inlets 1230.

The first portion of the air is cooled as it passes through and around the fins 430 coupled to the supply sinks 415 (cold) of the TEC(s) 400. The cooled air flows through a supply outlet 1235 to the distribution layer 110 (not shown in these FIGURES). A second portion of the air is heated as it passes through and around the fins 430 coupled to the exhaust sinks 420 (hot) of the TEC(s) 400. The heated air exits through exhaust outlets 1240 for communicating the air into ambient space.

In the example illustrated in FIGS. 12A through 12I, the distribution layer 110 (not shown) includes the inlet 240 and further includes an outlet which may be similar to the inlet. Return inlet 1250 is coupled (e.g., using a hose) to the outlet of the distribution layer 110. A number of radial blowers/fans 1255 pull air through the distribution layer 110 into the return inlet 1250. Therefore, the footwedge 1210 is adapted to pull air over for cooling by the TEC(s) 400 in the headwedge 1205 to be conditioned and distributed through the distribution layer 110.

The radial blowers 1255 also expel the returned air via a number of exhaust outlets 1260. The air expelled through exhaust outlets 1260 flows along inner channels and is vented through external outlets 1265 into ambient space. In some embodiments, the expelled air is vented directly into ambient space from the exhaust outlets 1260.

As with prior embodiments, the system 1200 further includes one or more power supplies (not shown) and a control unit 1270 (a single system or multiple systems 1270) operable for controlling the overall operation and functions of the system 1200. The control unit 1270 is described in further detail herein below with respect to FIG. 13. The control unit 1270 can be configured to communicate with one or more external devices or remotes via a Universal Serial Bus (USB) or wireless communication medium (such as Bluetooth®) to transfer or download data to the external devices or to receive commands from the external device. The control unit 1270 may include a power switch adapted to interrupt one or more functions of the system 1200, such as interrupting a power supply to the blowers/fans. The power supply is adapted to provide electrical energy to enable operation of the heat transfer device(s) 440, 450, 470, 480 (including the TEC 400), the blowers/fans, and remaining electrical components in the system 1200. The power supply can operate at an input power between 2 watts (W) and 200 W (or at 0 W in the passive mode). The control unit 1270 may be configured to communicate with a second control unit 1270 in a second system 1200 operating in cooperation with each other.

As will be appreciated, the several embodiments of the personal air conditioning control system 105 in the personal comfort system 100 can be configured to either push or pull conditioned air through the distribution layer 100. In some embodiments, the personal comfort system 100 may be a closed system and the personal air conditioning control system 105 is configured to re-circulate conditioned air through the distribution layer 100. The airflow may comprise a direct path from a supply side to an outlet side. Additionally and alternatively, the airflow may be configured in a racetrack path from the supply side to the outlet side.

Figure 13:
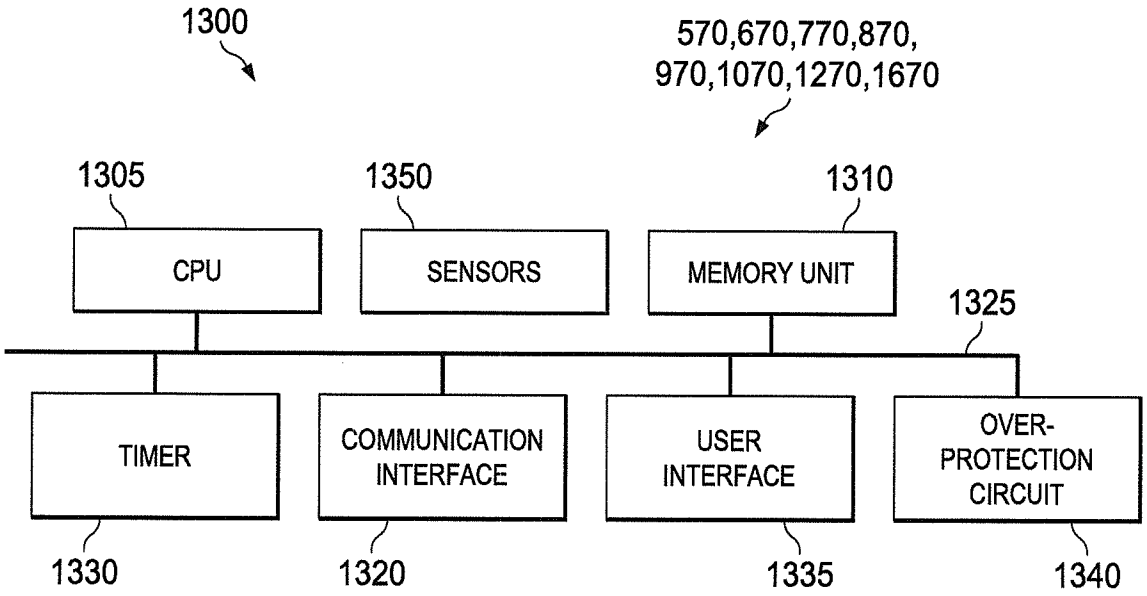
FIG. 13 illustrates a control unit or system according to the present disclosure.

FIG. 13 illustrates the major components of the control unit or system (570, 670, 770, 870, 970, 1070, 1270, 1670, 1770) for use in the different embodiments of the system 105—which will hereinafter be identified and referred to as control unit or system 1300. Other embodiments could be used without departing from the scope of this disclosure.

The control unit 1300 includes a central processing unit ("CPU") 1305, a memory unit 1310, and a user interface 1315 communicatively coupled via one or more one or more communication links 1325 (such as a bus). In some embodiments, the control unit 1300 may also include a communication interface 1320 for external communications.

It will be understood that the control unit 1300 may be differently configured and that each of the listed components may actually represent several different components. For example, the CPU 1305 may actually represent a multiprocessor or a distributed processing system. In addition, the memory unit 1310 may include different levels of cache memory, main memory, hard disks, or can be a computer readable medium, for example, the memory unit can be any electronic, magnetic, electromagnetic, optical, electro-optical, electro-mechanical, and/or other physical device that can contain, store, communicate, propagate, or transmit a computer program, software, firmware, or data for use by the microprocessor or other computer-related system or method.

The user interface 1315 enables the user to manage airflow, cooling, heating, humidity, noise, filtering, and/or condensate. The user interface 1315 can include a keypad and/or knobs/buttons for receiving user inputs. The user interface 1315 also can include a display for informing the user regarding status of operation of the personal comfort system, a temperature setting, a humidity setting, and the like. In some embodiments, the user interface 1315 includes a remote control handset (not shown) coupled to the personal air conditioning control system 105 via a wireline or wireless interface.

The CPU 1305 is responsive to commands received via the user interface 1315 (and/or sensors) to adjust and control operation of the personal comfort system 100. The CPU 1305 executes a plurality of instructions stored in memory unit 1310 to regulate or control temperature, air flow, humidity, noise, filtering and condensate. For example, the CPU 1305 can control the temperature output from the TEC(s) 400 (at the heat exchangers) by varying input power level to the TEC 400. In another example, the CPU 1305 can adjust a duty cycle of the TECs 400 and one or more supply blowers/fans to adjust a temperature, air flow, or both. In addition, the CPU 1305 can adjust one or more valves (dampers) in the supply outlets to mix a portion of the heated air from the exhaust heat exchangers with cooled air from the cold side heat exchangers to regulate a temperature of the conditioned air delivered to the distribution layer 110. The CPU 1305 may also control temperature in response to a humidity feedback and access control settings or instructions stored in the memory unit 1310 to ensure the temperature of the cold sinks do not drop below the dew point. Therefore, the CPU 1305 can regulate humidity and moisture build-up in the mattress, distribution layer 110 and/or system 105.

In some embodiments, sensors 1350 measure and/or assess ambient humidity and temperature. Such sensors may be located in a remote user interface module (not shown) configured as a remote control handset, or remotely located and communicatively coupled to the control unit 1300 via wired or wireless communications. Actual conditions that the user is experiencing are captured as opposed to conventional systems wherein the microclimate created around the thermoelectric engine can skew the optimum control settings. Additionally, one or more environmental sensors 1350 may be placed in or near the distribution layer 110 system to provide feedback of the users heat load or comfort level. The control unit 1300 receives the sensor readings and adjusts one or more parameters or settings to improve the overall comfort level. These sensors may transmits the sensed condition via wire or wirelessly through Bluetooth, RF, home G/N network signals, infrared, or other wireless configurations. The handheld remote user interface 1335 can also use these signals to communicate to the system 105. These signals could also be used to connect to existing Bluetooth devices including personal computers, cell phones, and other sensors including but not limited to temperature, humidity, acceleration, light and sound.

The control unit 1300 may also interface/communicate with an external device (such as a computer or handheld device), such as through USB or wirelessly as described above. The control unit 1300 may be programmed to change temperature set points multiple times throughout the sleep experience, and may be programmable for multiple time periods—similar to a programmable thermostat. Data logging of temperatures and other parametric variables can be performed to monitor and/or analyze sleep patterns and comfort levels. Different control modes or operations may include TEC power level control, temperature set point control, blower/fan speed control, multipoint time change control, humidity limiting control based on ambient humidity sensor readings to minimize condensation production, ambient reflection control where the set point is the ideal state (for example, if ambient is colder than set point the control adds heat and if the ambient is warmer than set point the control adds cooling in such a way that it is inverse proportionally controlled) and other integrated appliance/sensor schemes.

In one embodiment, the control unit 1300 calculates a dew point (assuming a standard pressure) from humidity and temperature measurements received from one or more sensors 1350 located near the system 100. In response to the calculated dew point, the control unit controls the system 105 based on the calculated dew point to prevent or reduce condensate. For example, if the humidity is relatively high, the system 105 may control operation such that a particular operating temperature of the conditioned air (or the thermoelectric device) does not fall below a certain temperature that may cause the system to operate at or below the dew point. As will be appreciated, operation at or below the dew point increases load factor substantially.

In another embodiment (not shown in the FIGURES), when the control unit 1300 may be logically and/or physically divided into a master control unit and a slave control unit (or secondary control unit). The master control unit is configured as set forth above (e.g., processor, communications interface, memory, etc.) and (1) controls a first thermal transfer device associated with a first distribution layer 100 or distribution system 1400 and (2) generates and transmits control signals to the slave control unit enabling control of a second thermal transfer device associated with a second distribution layer 110 or distribution system 1400. For example, the master control unit controls the environment on one side of the bed, while the slave control unit controls the environment on the other side.

In yet another embodiment (not shown in the FIGURES), the system 105 includes two remote control units for generating and transmitting control signals (wired or wirelessly) to the control unit 1300 for independently controlling two different areas (e.g., sides) of the bed. In one embodiment, each remote control unit transmits control signals to the control unit. In a different embodiment, one remote control unit (slave) generates and transmits its control signals to the other remote control unit (master), which in turn, transmits or relays these received slave control signals to the control unit 1300. As will be appreciated, the master remote control unit also generates and transmits its own control signals.

Additional control schemes may be implemented to ramp temperature as an entering sleep or wakeup enhancement. In addition, control schemes may include the ability to pre-cool or pre-heat based on programmed times and durations. Another control scheme can allow for ventilation of the bedding when not in use. The control schemes can integrate existing bedroom appliances to include, but not limited to alarm clock, night lights, white noise generator, light sensors, automated blinds, aroma therapy, and condensation pumps to water plants/pets, and so forth.

In some embodiments, the personal air conditioning control system 105 includes a filter adapted to remove unwanted contaminates, particles or other impurities from the conditioned air. The filter can be removable, such as for cleaning. In some embodiments, the control unit 1300 includes a filter timer 1330 providing a countdown or use function for indicating when the filter should be serviced or changed. Upon expiration of a preset time, such as a specified number of hours operated, the filter timer 1330 can provide a signal to the CPU 1105. In response, the CPU 1305 can provide a warning indicator to the user to service or change the filter. In some embodiments, the warning indicator is included on the user interface 1315, such as on the display.

In some embodiments, the personal air conditioning control system 105 includes an overprotection circuit. The overprotection circuit 1340 can be an inline thermal switch that ceases the personal air conditioning control system 105 operation in the event of TEC or system failure.

In some embodiments, the personal air conditioning control system 105 includes a condensation/humidity management system. In some embodiments, the condensation/humidity management system is passive. In some embodiments, condensation/humidity management system is active.

For example, in a passive condensation/humidity management system, the personal air conditioning control system 105 can include a desiccant at one or more locations therein. The desiccant can be used when the personal comfort system 100 is in operation. The personal comfort system 100 can uses a low watt resistor to recharge the desiccant when in an off-mode. In addition, the personal comfort system 100 can include wicking material in the system 105 and/or the distribution layer 110. The wicking material can be located downstream of the air flow directed into the distribution layer 110. The wicking material can use the exhaust air from the system 105 to draw away and evaporate the condensation.

In an active condensation/humidity management system, the personal comfort system 100 includes a cooling tower arrangement to control condensation that forms on the cold side sinks. The moisture drips off from the cold side sink fins through a perforated plate and onto a layer of wicking material. The lower cavity can employ axial fans to pull ambient air over the wicking material and out through the axial fans, thus allowing for evaporation back into the ambient environment.

This condensate also can be captured and pumped into a container, plant or other vessel to provide water. Therefore, the room humidity is reduced; thereby improving the overall comfort level for the entire room. This feature also improves the efficiency of the unit because the thermoelectric engine is not condensing and evaporating the same water back and forth from vapor to liquid state. When the condensate is captured in a vessel the potential change in delta temperature grows because the dew point is lowered throughout the sleep experience increasing the maximum cooling delta available to improve comfort.

Now turning to FIGS. 14A-14D, there is illustrated a distribution system 1400 (functioning as the distribution layer 110) having two separate components—a mattress overlay envelope layer 1410 (FIGS. 14A-14B) and a spacer fabric panel 1450 (FIGS. 14C-14E). These components are configured to be separate, but with the spacer fabric panel 1450 removably inserted into the envelope layer 1410.

As will be appreciated, the envelope layer 1410 is configured similar to a fitted sheet or mattress pad, which is placed on the mattress 50 and held in place using the sides/corners of the mattress. The envelope layer 1410 further includes an internal volume or space (compartment) 1412 adapted and sized to receive therein the spacer fabric panel 1450.

In the embodiment shown in the FIGS. 14A and 14B, the envelope layer 1410 is dimensioned for a queen or king mattress (for two persons) and has two identical sides, but can be dimensioned and configured for single person mattresses. The envelope layer 1410 includes a top layer 1414, a middle layer 1416, an intermediate bottom layer 1418 and a bottom layer 1420 (See, FIG. 14B illustrating a cross-section of the layer 1410). In this embodiment, all of these layers extend the width and length of the mattress. Upon placement of the envelope layer 1410 on the mattress, the bottom layer 1420 contacts the outer surface of the underlying mattress. As will be appreciated, the internal volume 1412 is created and bounded between the intermediate bottom layer 1418 and the bottom layer 1420 with the stitch lines 1422 forming the outer lateral boundaries. Between these two layers (within volume 142) is where the spacer fabric panel 1450 is disposed.

The top layer 1414 may be formed of a fabric material that is semi-permeable, while the middle layer 1416 functions as an insulation layer. The intermediate bottom layer 1418 may be formed from fabric functioning as a liner or support material, such as tricot fabric. The bottom layer 1420 may be either semi-permeable or permeable.

Positioned at one end of the envelope layer 1410 are openings 1424*a* (disposed between layers 1418 and 1420) and which provide access to the interior volumes 1412. Prior to operation of the system, the spacer fabric panel 1450 is inserted through the opening 1424*a* into the volume 1412. In another embodiment, the other end of the envelope layer 1410 may also include openings 1424*b*. In various embodiments, the openings 1424*a* have a length L1 that can range from about 2 inches to the entire length (width) of the envelope layer 1410. In other embodiments, this length can be from about 2 to 15 inches, about 6 to 10 inches or about 8 inches. The openings 1424*b* can have the same or different lengths, and in one embodiment they have a length shorter than the length of the openings 1424*a*.

Now turning to FIGS. 14C-14F, there is provided a top view, bottom view, end view and a side view, respectively, of the spacer fabric panel 1450. The spacer fabric panel 1450 includes two end sections 1452 (but may only have one) and a middle section 1454. The panel 1450 includes the spacer structure 230 (see FIGS. 2A-3C and accompanying description), a bottom layer 1456 and a partial top layer 1458. The partial top layer 1458 is formed of impermeable fabric material and coincides with the end sections 1452 (and not the middle section 1454). The bottom layer 1456 is formed of impermeable fabric material, and the bottom layer 1456 and spacer structure 230 coincide with the entire area of the panel 1450 (as illustrated in FIGS. 14C, 14F). At one end of the panel 1450, a rectangular passageway or opening 1460 is formed between the bottom layer 1456 and the partial top layer 1458. The opening 1460 functions as an inlet for receiving conditioned air from the personal air conditioning systems 105. In various embodiments, the opening 1460 has a length L2 that can range from about 2 inches to the entire length (width) of the panel 1450. In other embodiments, this length can be from about 2 to 15 inches, about 6 to 10 inches or about 8 inches. Though not shown, the other end of the panel 1450 may also include a similar passageway for outletting air flowing into the panel 1450.

The exterior periphery (except at the opening 1460) of the panel 1450 is bound, such as by tri-dimensional binding tape, to hold the three layers (1456, 230, 1458) together and form the panel 1450. Other suitable binding structures or mechanisms may be utilized.

Now turning to FIG. 15A, there is shown an air inlet duct structure 1510 for interfacing with, and supplying conditioned air, to the spacer fabric panel 1450 which is shown disposed within the envelope layer 1410 (not visible). The air inlet duct structure 1510 includes a hose portion 1520, a first inlet extension 1530 and an internal inlet extension 1540 (not visible in FIG. 15A). It will be understood that the inlet duct structure 1510 may also be utilized with distribution layer 110 instead of the ducting structures shown in FIG. 2C.

The hose portion 1520 typically will include an air hose of necessary length for coupling to a supply outlet of the personal air conditioning systems 105. Coupled to the hose portion 1520 is the first inlet extension 1530 which has, in this embodiment, a rectangular cross-sectional shape. Now turning to FIG. 15B, there is illustrated a cross-section view of the first inlet extension 1530 and the internal inlet extension 1540, as well as the junction/interface with the spacer fabric panel 1450.

The first inlet extension 1530 and the internal inlet extension 1540 include an impermeably layer of material 1542 surrounding a spacer structure 1550. The spacer structure 1550 can be of the same or similar construction as the spacing structure material 230. This forms a conduit for the conditioned air to flow through while maintaining a partially rigid support structure. This allows the duct structure 1510 to hang down from the mattress and form natural ninety degree angle. This ninety degree transition interface reduces noise and vibration transmitted from the system 105. The noise and/or vibration may originate from the fans, blower and/or air movement. With the use of the duct structure 1510 as shown, no rigid plastic materials in the form of a elbow angle is required. Such plastic and rigid materials may produce unwanted noise as the air flows into the spacer fabric panel 1450.

The outer layer 1542 extends the length of the first inlet portion 1530 and the length of the internal inlet portion 1540 and is coupled to the bottom and top layers 1456, 1458 of the panel 1450 by a coupling mechanism 1560 to enable all (or almost all) of the conditioned air to flow into the panel 1450. Any suitable attachment or coupling mechanisms, structures or methods may be utilized, including velcro, buttons, or the like. Around the junction, the spacer structure 1550 is split and is wrapped or sandwiched around the spacer structure 230 within the panel 1450. This provides a cross-sectional area that allows conditioned air to flow into the panel 1450. The thickness dimension of the two split ends of the spacer structure 1550 may be the same or different than the thickness dimension of the spacer structure 230 within the panel 1450.

Similarly, at the junction of the first inlet extension 1530 and the internal inlet extension 1540 there is a suitable attachment or coupling mechanism, structure or method of attachment.

As will be appreciated, the spacer structure 1540 within the first inlet extension 1530 maintains a cross-sectional area sufficient to maintain air flow when the extension 1530 is bent at the 90 degree bend or angle (as shown). Further, the material of spacer structure 1550 allows such a bending/angle. In one embodiment, the spacer structure 1550 within the first inlet extension 1530 and internal inlet extension 1540 is formed of single piece of spacer structure material that is folded back upon itself to form the split ends at one end. Other suitable configurations may be utilized.

Figure 16A:
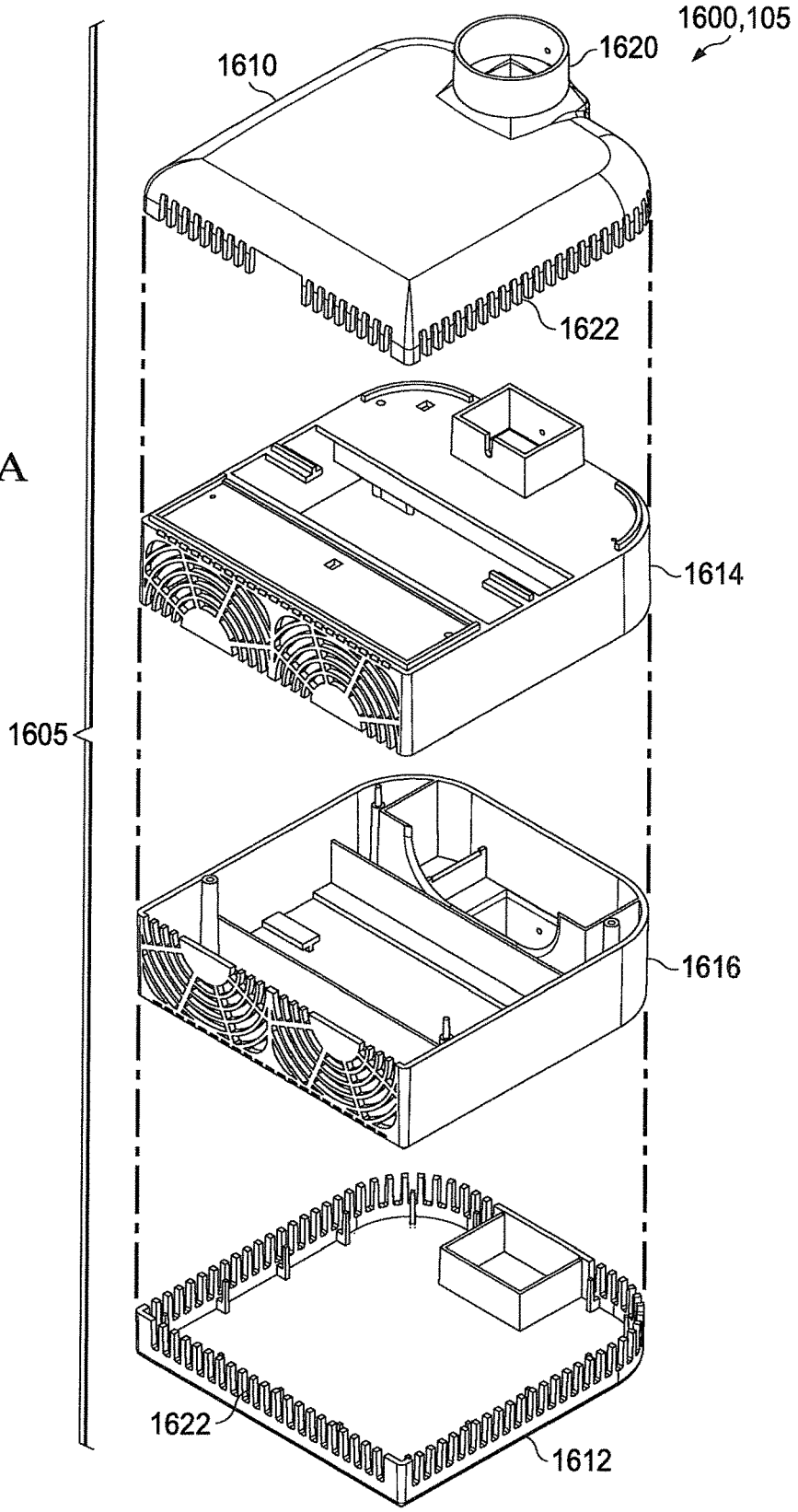
FIGS. 16A-16C illustrate another embodiment of the personal air conditioning control system according to the present disclosure.
Figure 16B:
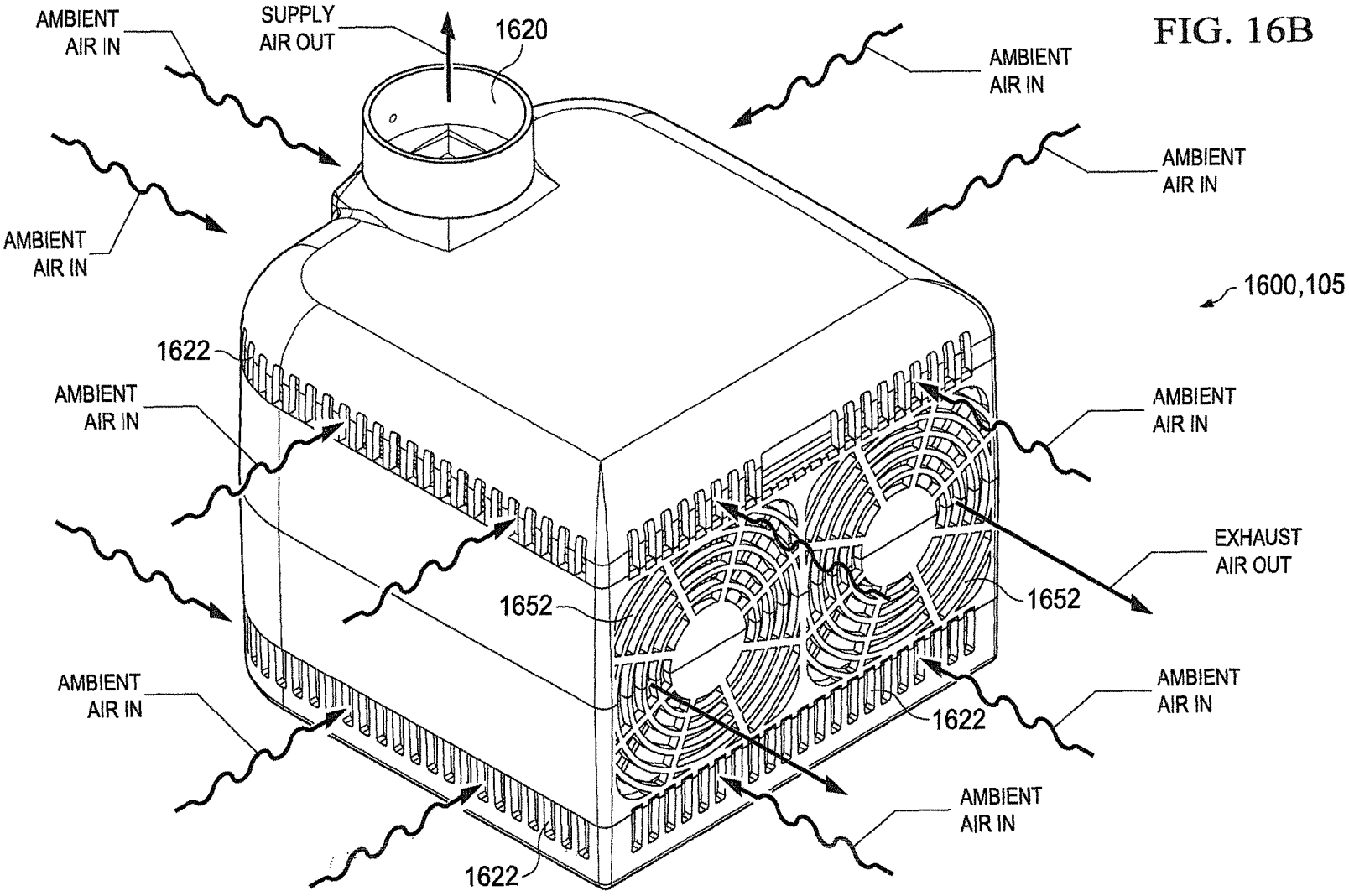
Figure 16C:
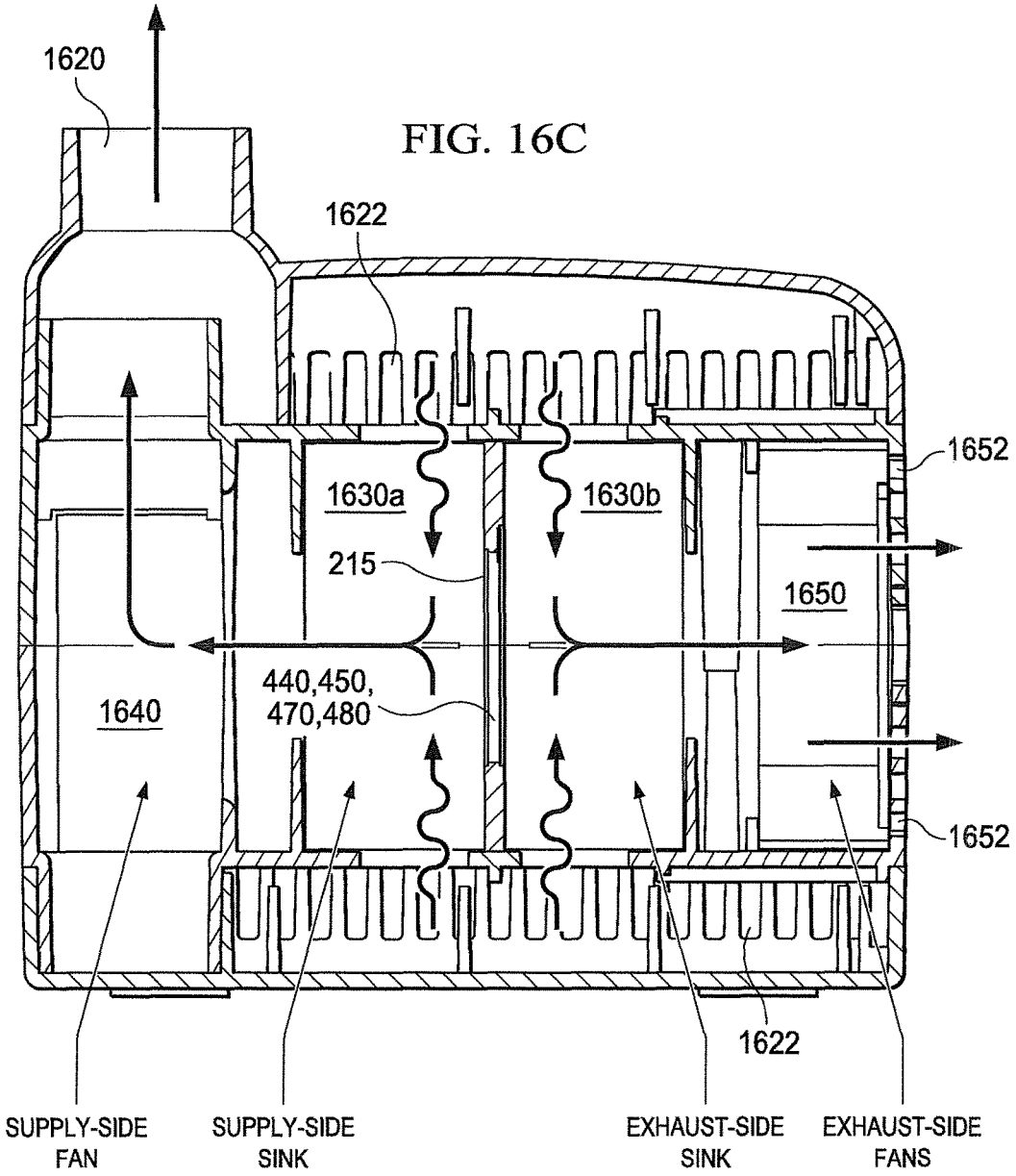

Now turning to FIGS. 16A-16C, there is illustrated another embodiment of the personal air conditioning control system 105. In this embodiment, the system 105 is identified using reference numeral 1600 and includes one or more thermal transfer devices (440, 450, 470, 480).

As with other embodiments of the system 105, the system 1600 is configured to deliver conditioned air to the distribution layer 110 (or the distribution system 1400). In another embodiment, two or more of these systems 1600 may be coupled to the distribution layer 110.

As shown in FIGS. 16A-16C, the system 1600 includes a housing 1605 (that is generally rectangular in shape) formed of multiple components, including a top cover 1610, a bottom tray 1612, a first center section 1614 and a second center section 1616. These four components are designed to be easily assembled or mated to form the housing 1605, such as a clamshell-type design. In this embodiment, the two center sections 1614 and 1616 are identical.

The top cover 1610 includes a supply outlet 1620 for supplying conditioned air to the distribution layer 110 (or the distribution system 1400). Multiple ambient air inlets 1622 positioned along the peripheries of the top cover 1610 and the bottom tray 1612 (as shown in FIG. 16B) allow ambient air to enter an internal chamber 1630 that is divided into a supply side chamber 1630*a* and an exhaust side chamber 1630*b* (as shown in FIG. 16C). Within the chamber 1630 is positioned the one or more thermal heat transfer devices (e.g., 440, 450, 470, 480).

One or more supply side fans 1640 function to draw air through the inlets 1622 and into the supply side chamber 1630*a* where the air is cooled by the supply side sink 415 (cold side) and force the cooled conditioned air through supply outlet 1620. Similarly, one or more exhaust side fans 1650 function to draw air through the inlets 1622 and into the exhaust side chamber 1630*b* where the air is heated by the exhaust side sink 420 (hot side) and force the heated air out into the ambient through exhaust vents 1652.

The embodiment of the system 1600 may be more beneficial due to its reduced size and decreased assembly complexity. In this embodiment, the two center sections 1614 and 1616 are identical and have integrated fan guards. Though not shown, the system 1600 typically will include one or more filters positioned therein to filter particles or other impurities from the air flowing into the inlets 1622. By dividing the intake air from both the top and bottom, the pressure drop to the respect fans is reduced and reduces noise.

By drawing air near, through or over the bottom tray 1612, any condensate that forms and collects within a condensate collection tray (not shown) located in the bottom tray 1612 can be evaporated by the intake air flow. In this embodiment, no wicking material may be necessary, though it may optionally be included therein.

As with the other embodiments, the system 1600 further includes a power supply (not shown) and a control unit 1670 operable for controlling the overall operation and functions of the system 1600. The control unit 1670 is described in detail herein above with respect to FIG. 13. The control unit 1670 can be configured to communicate with one or more external devices or remotes via a Universal Serial Bus (USB) or wireless communication medium (such as Bluetooth®) to transfer or download data to the external devices or to receive commands from the external device. The control unit 1670 may include a power switch adapted to interrupt one or more functions of the system 1600, such as interrupting a power supply to the blowers/fans. The power supply is adapted to provide electrical energy to enable operation of the heat transfer device(s) 440, 450, 470, 480 (including the TEC 400), the blowers/fans, and remaining electrical components in the system 1600. The power supply can operate at an input power between 2 watts (W) and 200 W (or at 0 W in the passive mode). The control unit 1670 may be configured to communicate with a second control unit 1670 in a second system 1600 operating in cooperation with each other.

Now turning to FIGS. 17A-17D, there is illustrated another embodiment of the personal air conditioning control system 105. In this embodiment, the system 105 is identified using reference numeral 1700 and includes one or more thermal transfer devices (440, 450, 470, 480).

As with other embodiments of the system 105, the system 1700 is configured to deliver conditioned air to the distribution layer 110 (or the distribution system 1400). In another embodiment, two or more of these systems 1700 may be coupled to the distribution layer 110.

As shown in FIGS. 17A-17D, the system 1700 includes a housing 1705 (that is generally rectangular in shape) formed of multiple components, including a top cover 1710, a bottom tray 1712, a first removable air filter assembly 1714*a* and a second removable air filter assembly 1714*b*. These components are designed and configured to be easily assembled or mated to form the housing 1705.

The top cover 1710 includes a supply outlet 1720 for supplying conditioned air to the distribution layer 110 (or the distribution system 1400). Multiple ambient air inlets 1722*a*, 1722*b*, 1722*c* are positioned along the bottom periphery within the removable air filter assembly 1714 of the bottom tray 1712 (as shown in FIGS. 17A-17D) and allow ambient air to enter a supply side internal chamber. In addition, ambient air also enters via ambient air inlet 1722*d*. Within the chamber is positioned the one or more thermal heat transfer devices (e.g., 440, 450, 470, 480).

One or more supply side fans (not shown) function to draw/move air through one or more of the inlets 1722*a*, 1722*b*, 1722*c* and 1722*d* into the supply side chamber where the air is cooled by the heat transfer device and force/move the cooled conditioned air through the supply outlet 1720. Similarly, one or more exhaust side fans (not shown) function to draw/move air through one or more of the inlets 1722*a*, 1722*b*, 1722*b* and 1722*d* and into an exhaust side chamber (not shown) where the air is heated by the heat transfer device and force/move the heated air out into the ambient through exhaust vents 1752.

The embodiment of the system 1700 may be more beneficial due to its reduced size and decreased assembly complexity. In this embodiment, the system 1700 is shown with two air filter assemblies 1714*a*, 1714*b* configured for use at the air inlets 1722*a*, 1722*b*, 1722*c* (1714*a*) and 1722*d* (1714*b*), respectively. Each air filter assembly 1714*a*, 1714*b* includes one or more air filters positioned therein to filter particles or other impurities from the air flowing into the inlets 1722*a*, 1722*b*, 1722*c*, 1722*d*. By dividing and intaking air from both the top and bottom, the pressure drop to the respective fans is reduced and which also reduces noise.

By drawing air near, through or over the bottom tray 1712, any condensate that forms and collects within a condensate collection tray (not shown) located in the bottom tray 1712 can be evaporated by the intake air flow. In this embodiment, no wicking material may be necessary, though it may optionally be included therein.

Now turning to FIGS. 17E-17H, the air filter assembly 1714*a* includes a housing 1715*a* configured for receiving air filter material 1716*a*, and is further configured to mate with the bottom tray 1712 and extend its perimeter no further outward than the top cover 1710. The assembly 1714*a* is rendered removable with the use of a removable attachment means or structure(s). Any removable attachment structure may be used, including velcro, screws, bolts, pins, and the like. In one embodiment, one or more magnets (or magnetic material) 1780 are utilized to attach the filter assembly 1714*a* to the housing 1705 (to the bottom 1712, the cover 1710, or both), thus rendering it easily removable without the need for a hand tool. In this embodiment, the housing 1715*a* of the assembly 1715*a* is constructed of magnetic material (steel, metal alloy, etc.). In another embodiment, one or more portions of the housing 1715*a* include magnetic material (or magnets) disposed on or within the housing 1715*a* at locations that correspond to the locations of the magnets 1780. Alternatively, magnetic material may be disposed at one or more locations on or in the housing 1705 and the magnets 1780 may be located at corresponding locations on or within the housing 1715*a*.

Figure 17A:
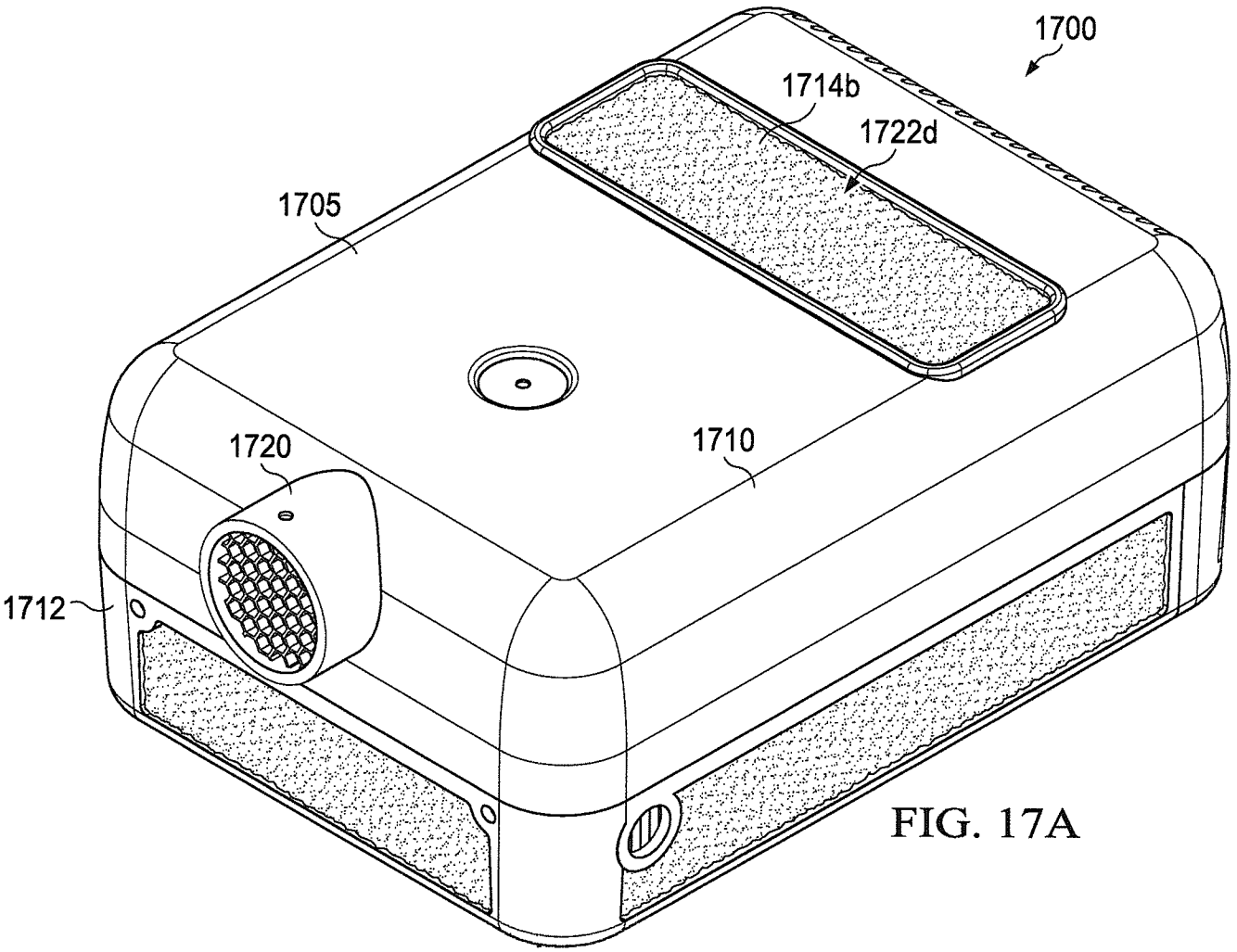
FIGS. 17A-17H illustrate another embodiment of the personal air conditioning control system according to the present disclosure.

Though not specifically shown in the FIGURES, the housing 1715*a* of the air filter assembly 1714*b* is configured for receiving air filter material 1716*b* (one or more distinct pieces), and is further configured to mate with the top cover 1710 (see FIG. 17A). A groove 1785 may be formed in the housing 1715*a* (see FIG. 17H).

The assembly 1714*b* is rendered removable with the use of a removable attachment means or structure (not shown). Any removable attachment structure may be used, including velcro, screws, bolts, pins, and the like. In one embodiment, one or more magnets (or magnetic material) (not shown) may be utilized to attach the filter assembly 1714*b* to the top cover 1710, thus rendering it easily removable without the need for a hand tool. In another embodiment, the filter assembly 1714*b* is insertable/removable into/from the top cover 1710 using a form fit (with no attachment structure).

Though not shown in FIGS. 17E-17H, the housing 1705 around the bottom tray 1712 may include a flange or lip to position the housing 1715*a* above the horizontal lower plane of the bottom of housing 1715. This would assist in installing and removing the housing 1715*a* and provide clearance or separation between the bottom of the housing 1715*a* and the surface on which the entire unit may be positioned.

Figure 17B:
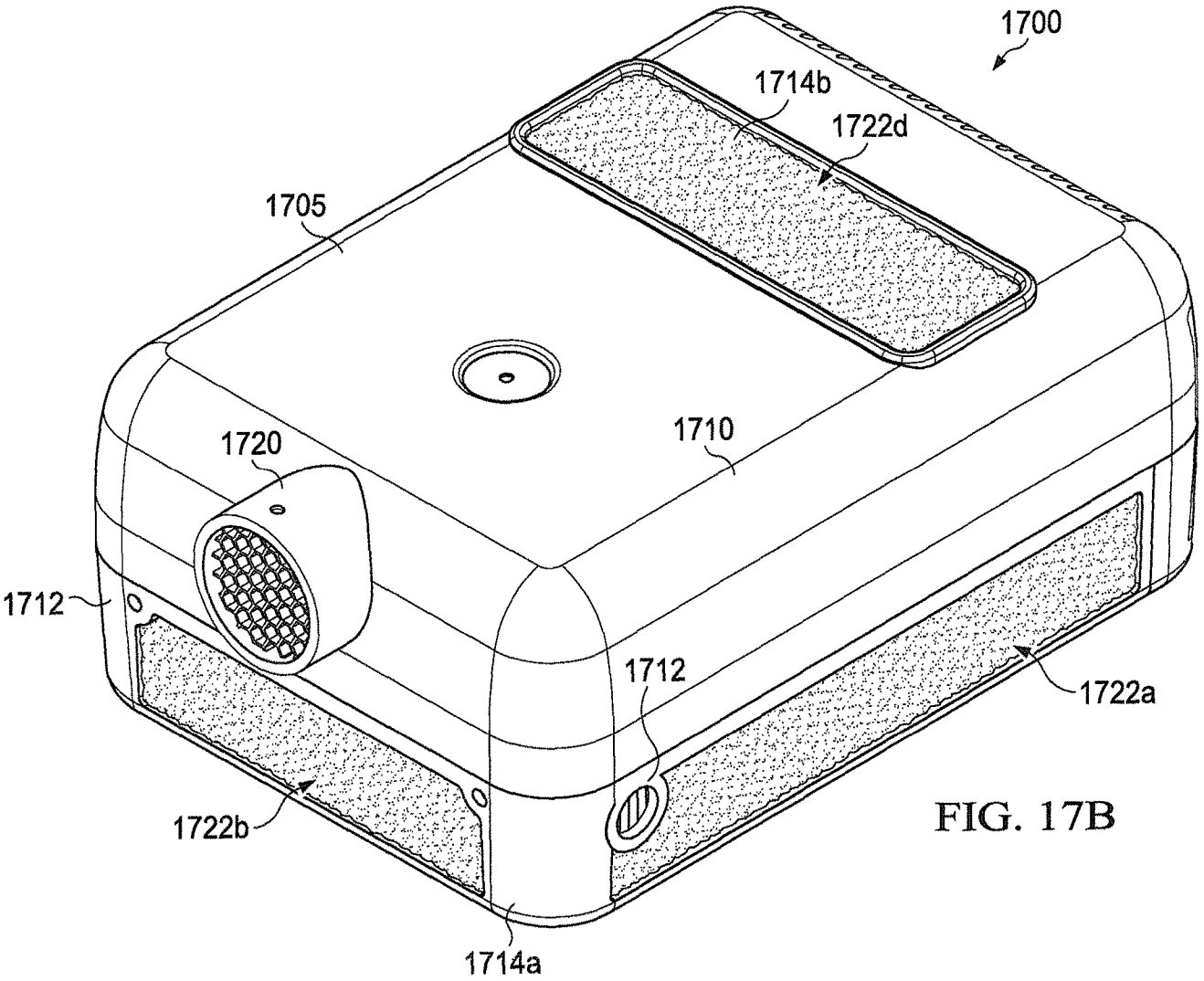
Figure 17C:
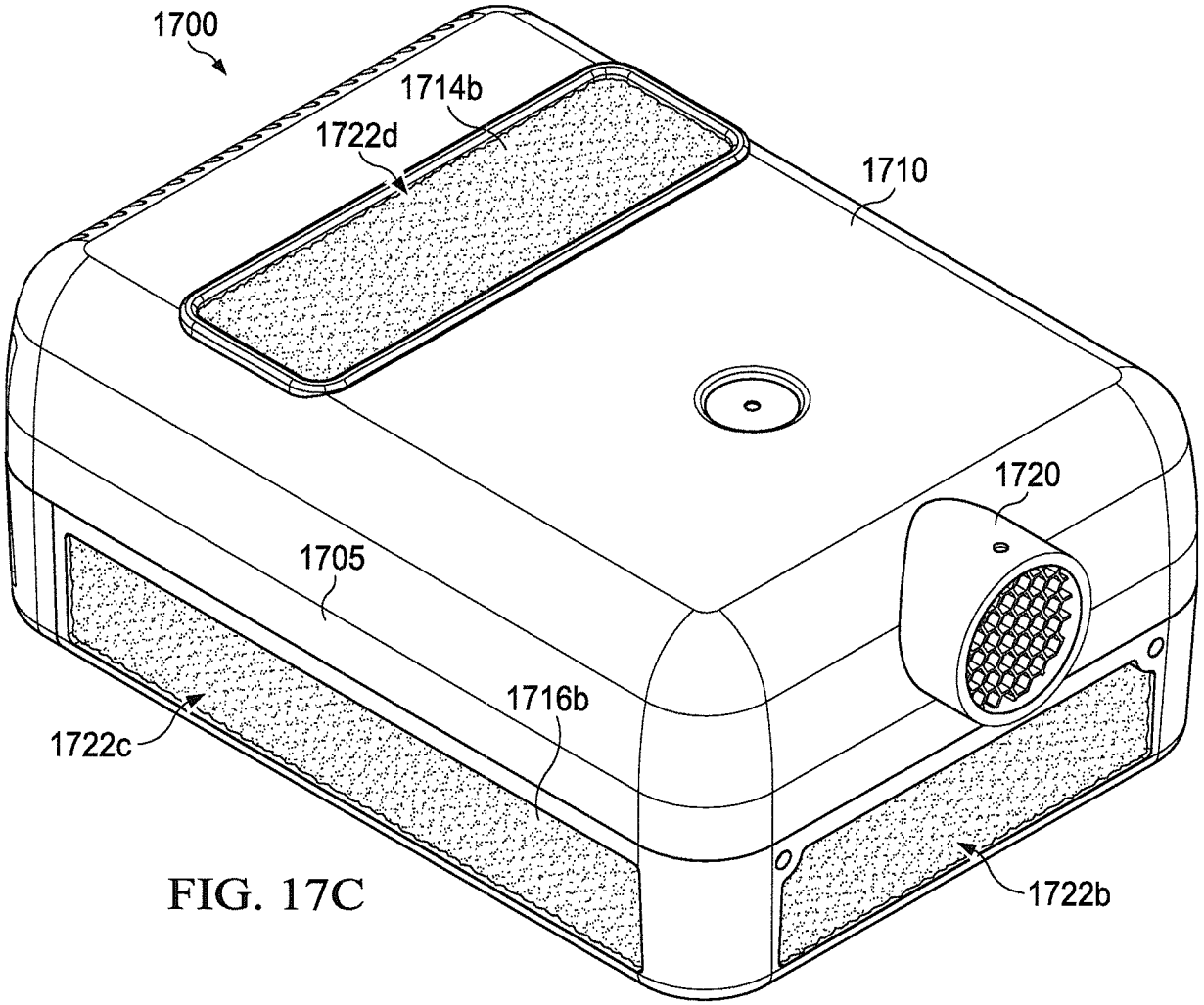
Figure 17D:
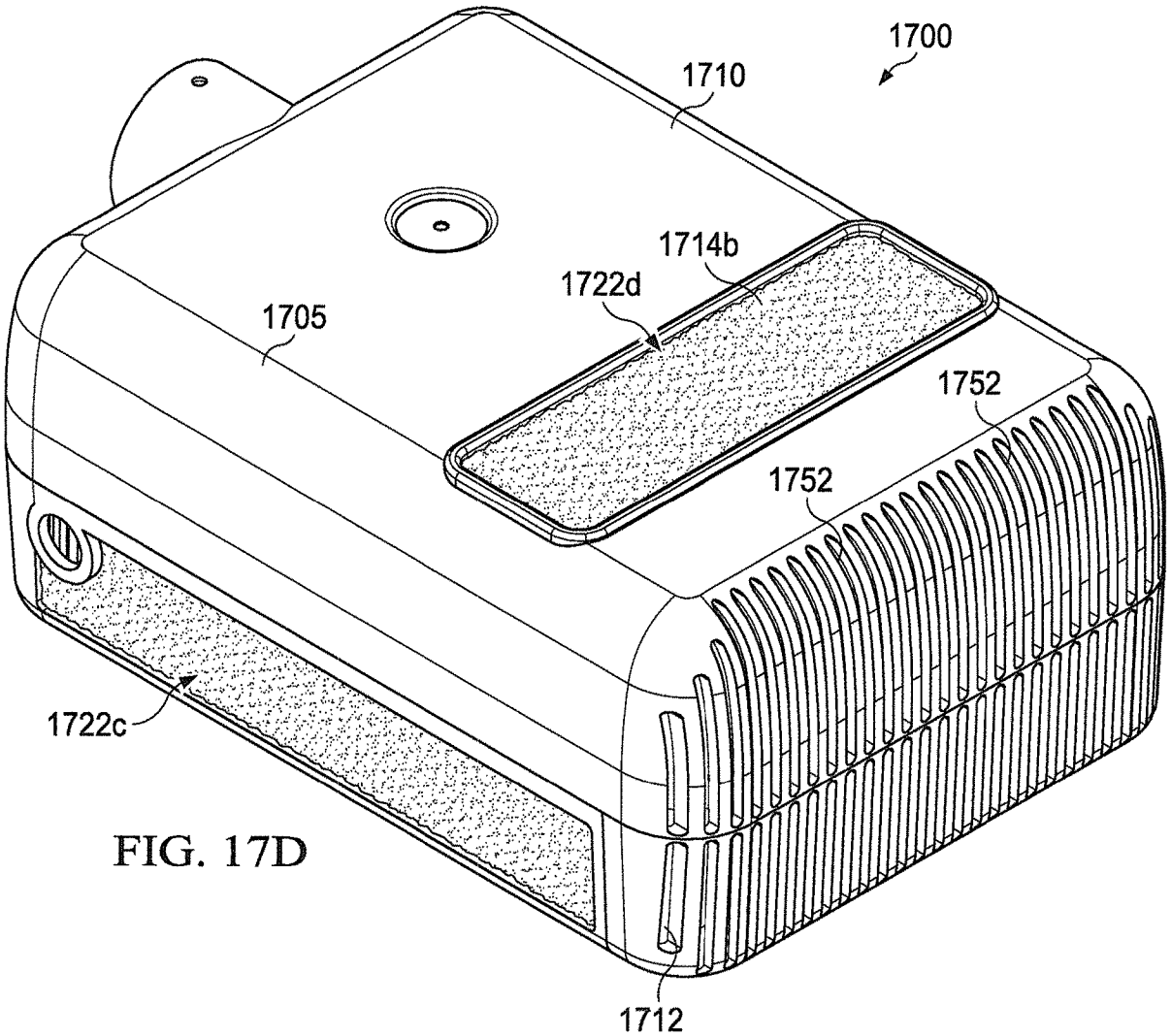
Figure 17E:
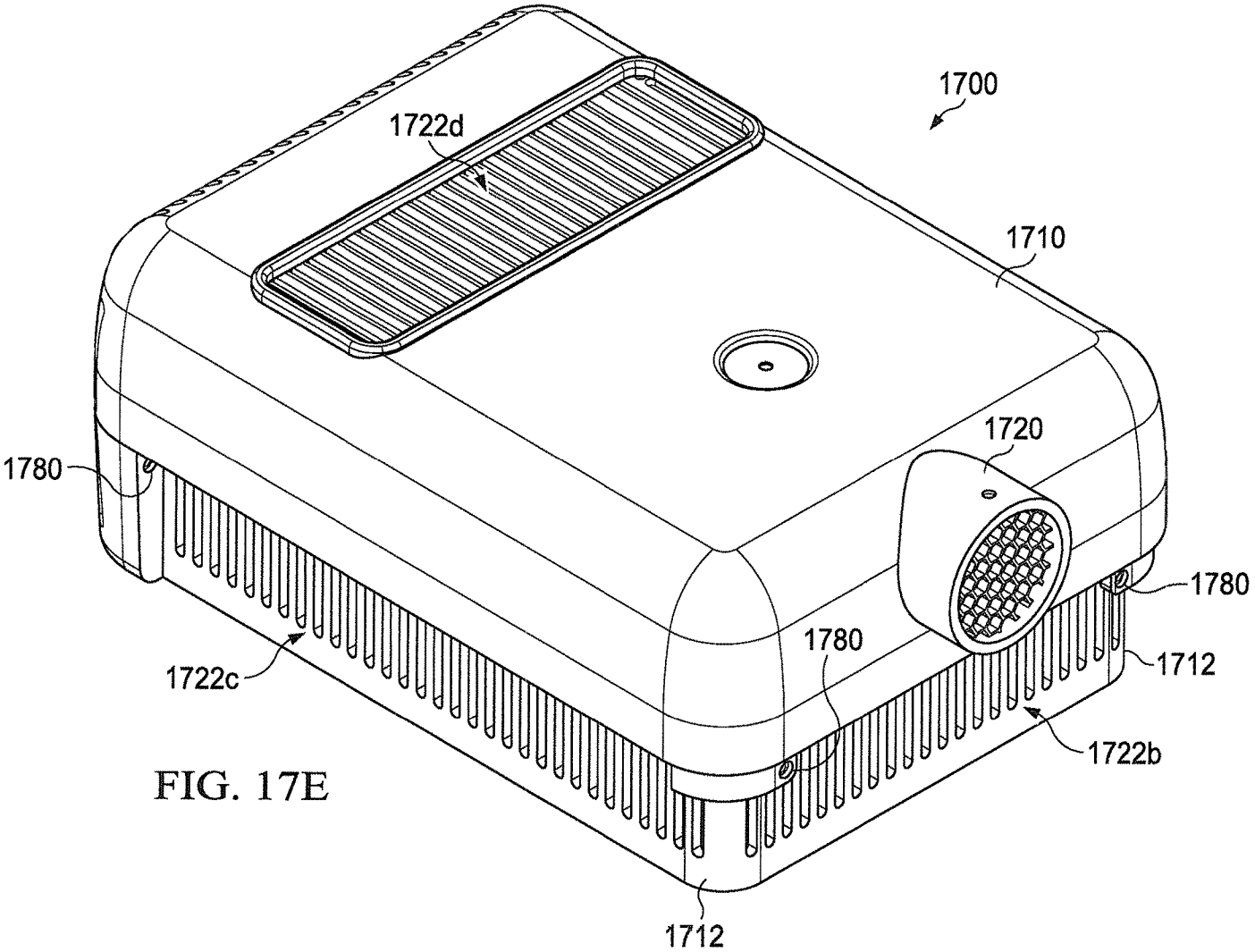
Figure 17F:
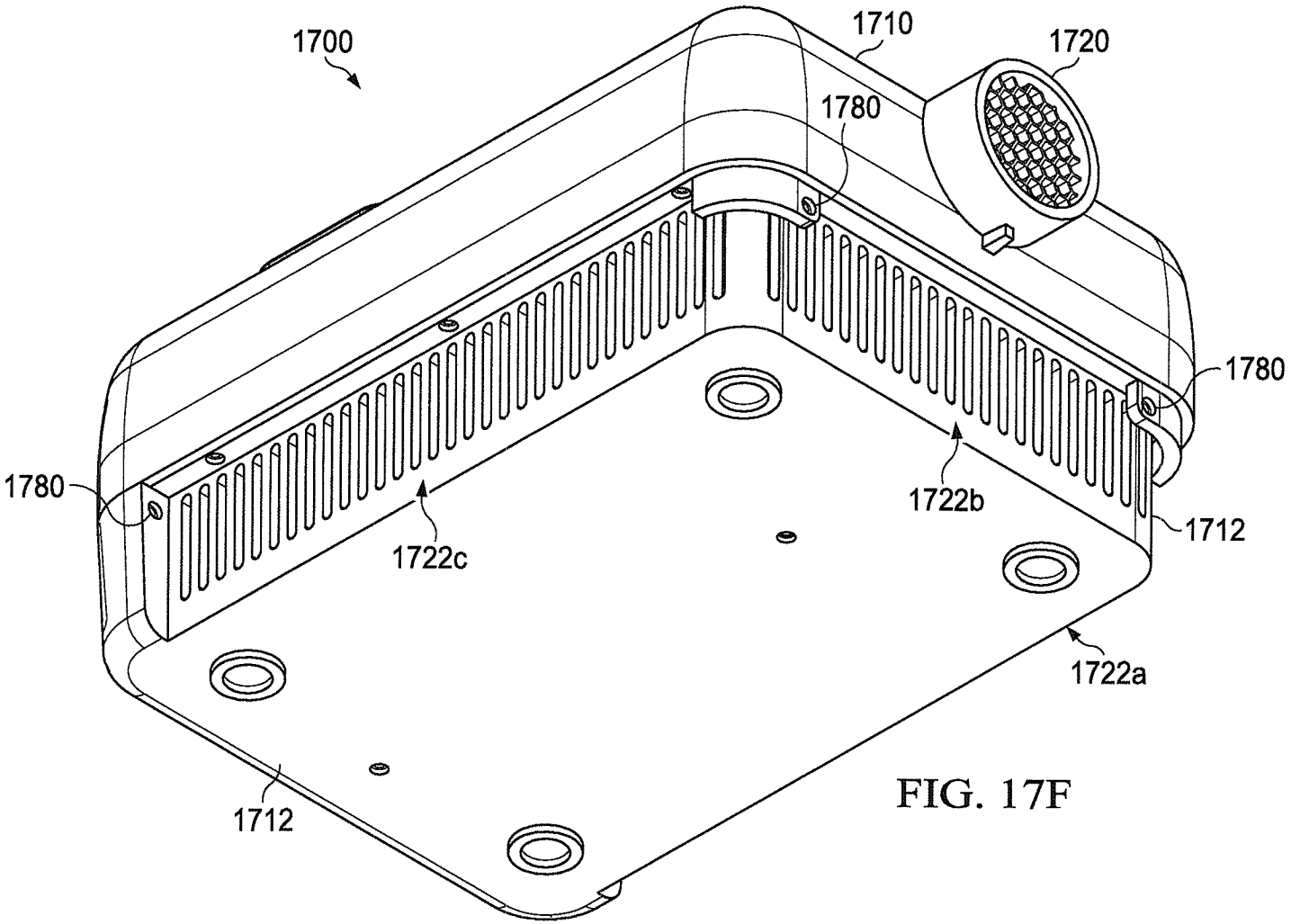
Figure 17G:
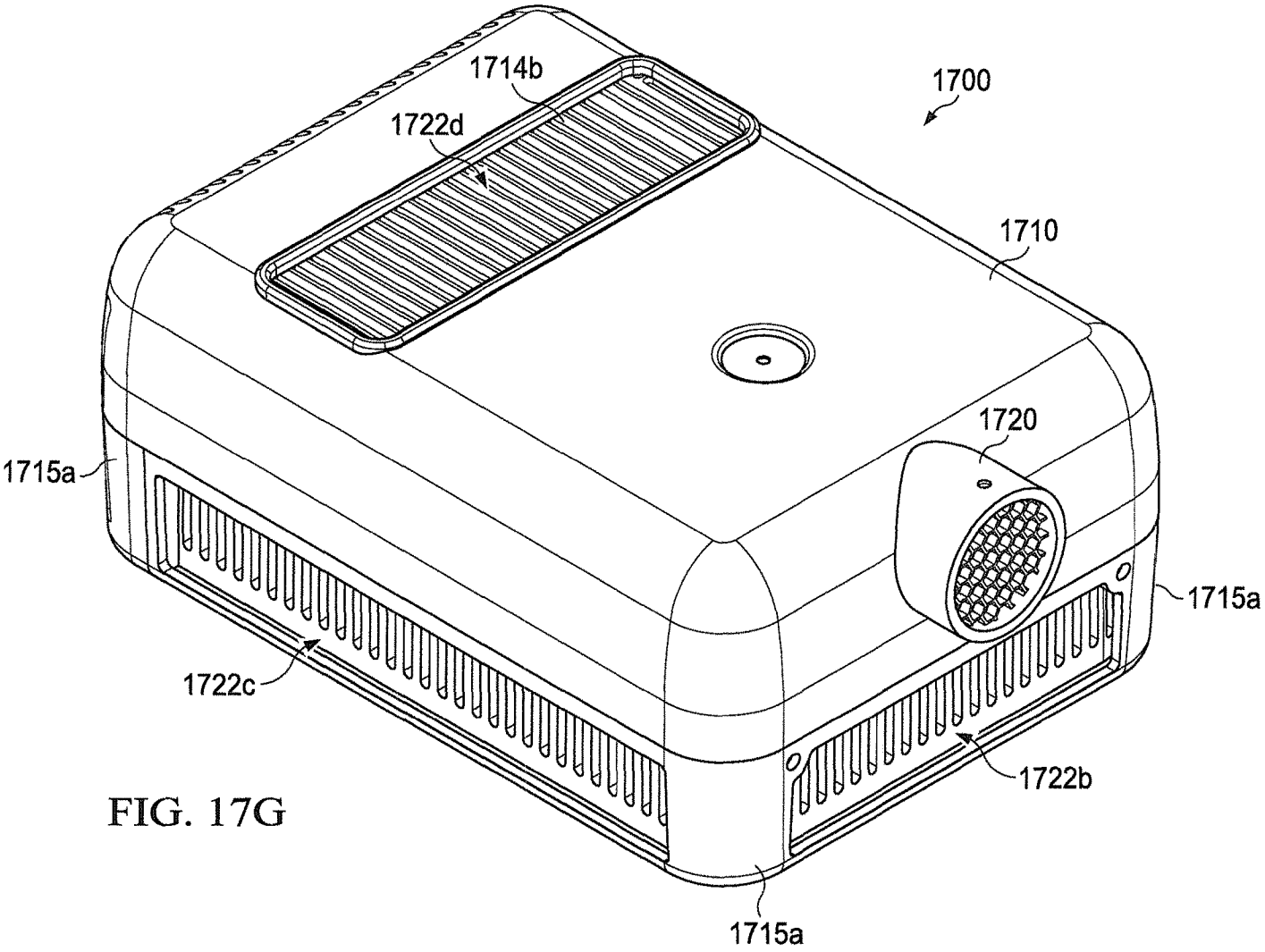
Figure 17H:
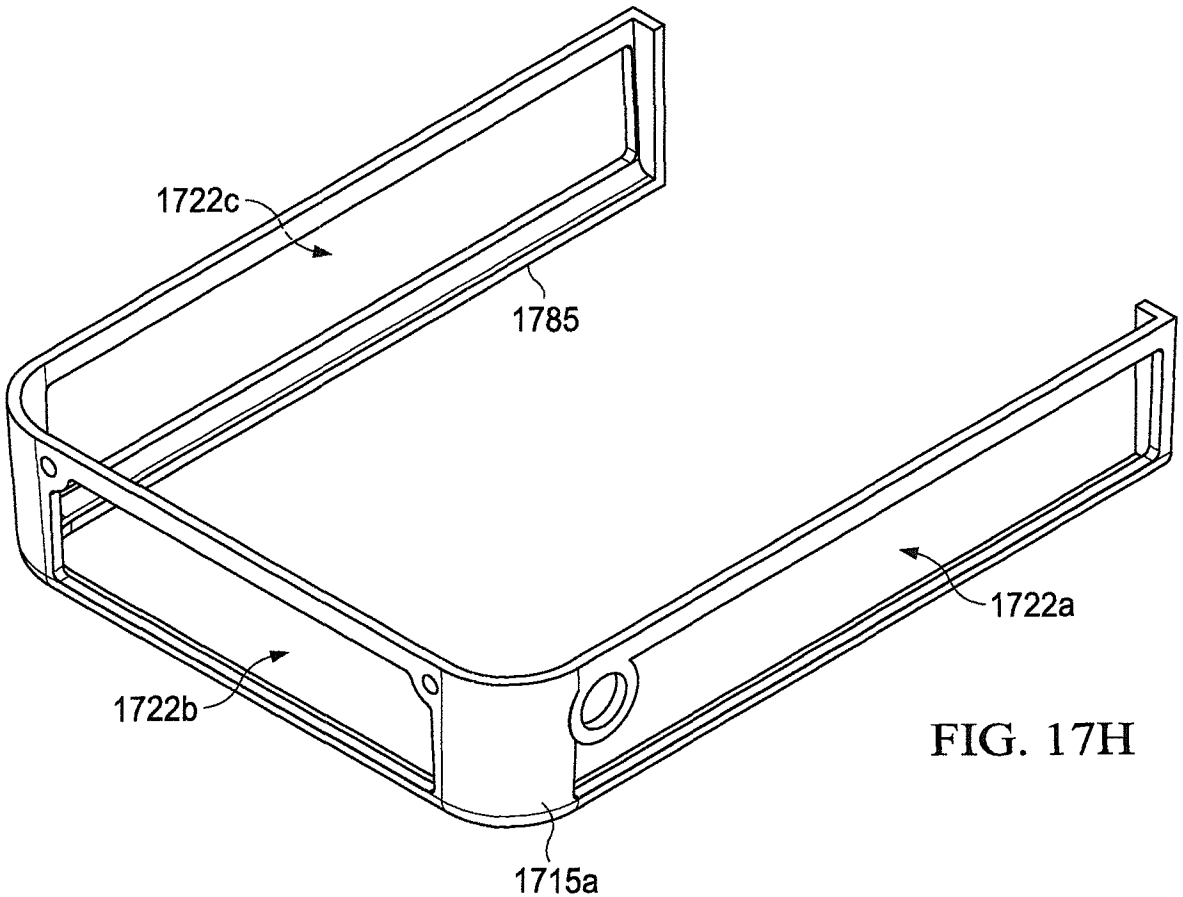

Referring now back to FIGS. 17B and 17C, the supply outlet 1720 is shown including an air dividing structure 1720*a* disposed within the orifice. The structure 1720*a* provides better air flow from the outlet 1720. In one embodiment, the structure includes a plurality of parallel air chambers (which can be characterized as honey-comb shaped).

As with the other embodiments, the system 1700 further includes a power supply (not shown) and a control unit 1770 (not shown) operable for controlling the overall operation and functions of the system 1700. The control unit 1770 is described in detail herein above with respect to FIG. 13. The control unit 1770 can be configured to communicate with one or more external devices or remotes via a Universal Serial Bus (USB) or wireless communication medium (such as) Bluetooth® to transfer or download data to the external devices or to receive commands from the external device. The control unit 1770 may include a power switch adapted to interrupt one or more functions of the system 1700, such as interrupting a power supply to the blowers/fans. The power supply is adapted to provide electrical energy to enable operation of the heat transfer device(s) 440, 450, 470, 480 (including the TEC 400), the blowers/fans, and remaining electrical components in the system 1700. The power supply can operate at an input power between 2 watts (W) and 200 W (or at 0 W in the passive mode). The control unit 1770 may be configured to communicate with a second control unit 1770 in a second system 1700 operating in cooperation with each other.

As will be appreciated, all of the embodiments of the personal air conditioning system 105 described herein can be utilized to supply an air flow to the distribution layer 110 or the distribution system 1400.

Turning now to FIG. 18A, there is shown a flow diagram of a method or process 1800 for controlling operation of the personal air conditioning control system 105 (including all of the variants described herein) to effectuate climate control (cooling/heating) for a bed/mattress/seat, etc. This process 1800 includes inputs from a humidity sensor and temperature sensor which measure humidity and temperature of the ambient air in which the system operates. In another embodiment, not shown, a liquid level (one or multilevel) sensor is disposed at a suitable location within the condensate reservoir to detect one or more levels of liquid in the reservoir.

The control scheme utilizes one or more of the following inputs to control operation of the TEC devices, fans, etc. within the system to control condensate build-up in the condensate reservoir: ambient air temperature, ambient air humidity, threshold run-time (time period of operation during the current operation cycle), and/or current run-time (time period left to operate during the current operation cycle). In most scenarios, ambient air humidity and the run-times may be sufficient for inputs to the system for controlling condensate build-up.

As will be understood, the personal air conditioning system(s) described herein may operate in accordance with two main processes: an operation cycle/mode and a drying cycle/mode (and inherently an "off" cycle/mode). The operation cycle is defined generally as the time period during which active cooling/heating is performed by the system. This usually coincides with the time period selected by a user for active operation. In contrast, the drying cycle occurs after the operation cycle and its main function is to "dry out" condensate that may be present in the condensation reservoir. In one embodiment, the drying cycle operates continuously when the operation cycle is off.

In general terms, operation of the system is initially controlled based on user input (e.g., operate for 8 hours at a predetermined temperature). However, during the operation cycle, ambient conditions may result in significant condensation which, if not controlled, would result in overflow. Condensate overflow is undesirable. During an operation cycle, a controller receives continuously or periodically measurements of ambient air humidity and/or temperature, and monitors threshold run-time and current run-time. Based on this information, the system controls or adjusts operation of the TEC device(s) to control the generation of condensation.

Now turning to FIG. 18B, there are shown two tables having a list of relative humidity ranges. Table 1.0 corresponds to the operation cycle, while Table 1.1 corresponds to the drying cycle.

For example, if the relative humidity is measured at 68% and the TEC device(s) are currently operating at any level that is greater than 85%, the process adjusts the TEC device(s) downward to operate at 80%. Similarly, if the TEC device(s) are currently operating at 90% and the measured humidity is 75%, the process adjusts operation of the TEC device(s) down to 70%.

As will be appreciated, during the drying cycle the TEC device(s) are not operating. As shown, the higher the relative humidity, the higher the air flow needed through the condensate reservoir (to dry out the condensate). This table assumes a set time period of operation for the drying cycle. Thus, air flow is controlled or adjusted depending on the measured relative humidity. In another embodiment (not shown), air flow is constant and the time period for fan operation is controlled or adjusted. For example, if the higher the relative humidity, the longer the fan should run to eliminate the condensate. Based on humidity measurements, the system controls or adjusts the drying cycle operation by controlling or adjusting the amount of air flow and/or the time period for air flow.

In other embodiments, measurement(s) from a liquid level sensor or float switch (that provide an indication of the level of condensate in the condensate reservoir) may be utilized to, at least partially, control or adjust operation of the TEC device(s) and/or fans.

In another embodiment, a multi-level (2 or more levels) liquid/float sensor is included in the condensate reservoir. For example, if the condensate level reaches a first level, the TEC device(s) may be controlled to eliminate (or reduce) the formation of condensate. And, after the level reaches a second lower level, the TEC device(s) may be adjusted to increase operation.

Now turning back to FIG. 18A, the process 1800 illustrated therein is now described textually in conjunction with the Figure. The unit is powered in response to user input (block 1802), the system is initialized (block 1804) and variables are initialized (block 1806).

Once initialized, a communication I/O line is checked to determine that a communication card/module is present and operating within the unit (block 1810). If not present or inoperable, the process 1800 enters into a sleep mode and waits to receive a proper signal (block 1811). If present, the process waits to receive communications from an external device (e.g., user input transmitted via wire or wireless from an external user controller device). When a communication is received, an interrupt is generated and it is determined whether the received communication is a command (CMD) (block 1812). If not, it is determined whether the received communication is a timer update request (block 1813), and if not, the process continues waiting for a new command or a timer update request.

If a new CMD is received, a CMD buffer is checked to determine whether it is full (block 1814). If not, then the process continues waiting for the new command to be fully received. When a new command is received and the CMD buffer is full (i.e., a full command has been received), the process determines whether the received command is an application (operational) mode command (block 1815) or some other type of command, such as a test or debug mode demand.

In the event the command is a test or debug mode command, then various other functions (block 1816) may be performed as desired, for testing and debugging of the process 1800, etc. As will be appreciated, no further description of block 1816 and any further process at this point is necessary or relevant for an understanding of the present disclosure.

When the command is an application mode command, it is checked whether the application mode command is a new bedstate command (block 1820), a bedstate operation command (block 1821) or a bedstate dry mode command (block 1822).

When a new bedstate command, the process 1800 determines whether the operate time (in the command) is zero (block 1830). If zero, then the unit remains off (if already off) or turns off (the blower, TEC devices and axial exhaust fans are deactivated), and the set temperature parameter in the command is ignored (block 1831). If greater than zero, the process 1800 updates the state of the process to bedstate operate (block 1832), and the PID (proportional, integral, differential control algorithm) is updated (block 1833). Once the PID is updated, operation of the TEC devices in the unit is adjusted (e.g., pulse width modulation) based on the measured relative humidity in accordance with Table 1.0 shown in FIG. 18B, if necessary (block 1834). As will be appreciated, the relative humidity is continually or periodically measured and available to the process 1800. Thus, the process 1800 at this point dynamically adjusts operation of the TEC devices based on the measured relative humidity. The process 1800 also branches back to block 1812 to wait for any new communications.

When the command is a bedstate operate command, the process 1800 determines whether the operation run time has expired (block 1840). If not, the process 1800 branches back to block 1812 to wait for any new communications, and the operation run time is also continuously monitored (not shown) until it expires. When expired, the process 1800 updates the bedstate to dry mode and enters a dry mode/operation (block 1841). Next, it is determined whether the temperature of the supply/cold side air (entering the unit) is less than or equal to the calculated dew point (block 1842). If greater than the dew point, the bedstate system is turned off (blower and TEC devices turned off) and the axial exhaust fan(s) are turned off (block 1831).

If the air temperature is less than or equal to the dew point, the blower and TEC devices are deactivated (block 1843) and axial fan(s) operate in a drying mode for a predetermined period of time (block 1844). In various embodiments, the period of time may range from a few hours to up to 14 hours. In one embodiment, during the drying mode operation, operation of the axial fan(s) is adjusted according to Table 1.1 shown in FIG. 18B. Humidity is measured periodically (the RH term in column 1 of Table 1.1) and operation of the axial fan(s) is adjusted (e.g., pulse width modulation) accordingly. In another embodiment, a fixed humidity measurement (A) is made at the end of the operating cycle (or beginning of the drying mode), humidity (H) is measured periodically, and a calculation is performed periodically using the equation: RH (adjusted)=A+H/2. Operation of the axial fan(s) is then adjusted (e.g., pulse width modulation) periodically according to Table 1.1 shown in FIG. 18B, if necessary.

When the command is a bedstate dry mode command, the process 1800 determines whether the dry mode run time has expired (block 1850 of FIG. 18A-2). If not, the process 1800 branches back to block 1812 to wait for any new communications, and the operation run time is also continuously monitored (not shown) until it expires. If time has expired, the bedstate system is turned off (blower and TEC devices turned off) and the axial exhaust fan(s) are turned off (block 1831).

Turning back to block 1813, if the received communication is a timer update request, it is determined whether it is a timer decrement (block 1850 of FIG. 18A-1). If a decrement, then the operation run time or dry mode run time is updated accordingly (block 1851). Once updated, or if not a timer decrement request, the process continues to block 1820.

Although the present disclosure has been described with an exemplary embodiment, various changes and modifications may be suggested to one skilled in the art. It is intended that the present disclosure encompass such changes and modifications as fall within the scope of the appended claims.

What is claimed is:

1. A method for operating an air conditioning system configured to deliver conditioned air to a supporting apparatus, the method comprising:

generating an air flow for delivery to a bed or mattress using at least one fan;

guiding the air flow from the at least one fan through at least one channel containing at least one thermoelectric device using a plurality of channels;

conditioning the air flow using the at least one thermoelectric device;

measuring a relative humidity of ambient air using an ambient air humidity sensor;

receiving a user input;

operating the air conditioning system according to an operation cycle in response to the user input;

receiving, during the operation cycle, a first relative humidity measurement of ambient air in which the air conditioning system is disposed;

adjusting, during the operation cycle, operation of at least one thermoelectric device within the air conditioning system in response to the received first relative humidity measurement to control condensation generation within the air conditioning system;

deactivating the at least one thermoelectric device after a duration of the operation cycle while the at least one fan remains operating for a drying cycle;

receiving a second relative humidity measurement after the at least one thermoelectric device have been deactivated; and when the second relative humidity measurement is above a predetermined threshold, adjusting, during the drying cycle, at least one of an air flow rate across a condensate reservoir or a duration of air flow across the condensate reservoir of the air conditioning system, wherein the at least one thermoelectric device are deactivated during the drying cycle.

2. The method in accordance with claim 1, wherein adjusting operation of the at least one thermoelectric device comprises:

adjusting downward a rate of operation of the at least one thermoelectric device when the received relative humidity measurement is above a predetermined threshold.

3. The method in accordance with claim 1, wherein adjusting operation of the at least one thermoelectric device comprises:

adjusting downward a rate of operation of the at least one thermoelectric device when the received relative humidity measurement is above a predetermined humidity threshold and a current rate of operation of the at least one thermoelectric device is above a predetermined rate of operation threshold.

4. The method in accordance with claim 1, further comprising:

monitoring a current run time compared to a threshold run time during the operation cycle; and wherein adjusting operation of the at least one thermoelectric device comprises adjusting operation of the at least one thermoelectric device in response to the received relative humidity measurement, the threshold run time and the current run time.

5. The method in accordance with claim 1, further comprising:

after completion of the operation cycle, operating the air conditioning system in accordance with a drying cycle, wherein, during the drying cycle, conditioned air is not generated for delivery to the supporting apparatus;

measuring, during the drying cycle, the relative humidity of the ambient air in which the air conditioning system is disposed.

6. The method in accordance with claim 1, further comprising:

after completion of the operation cycle, operating the air conditioning system in accordance with a drying cycle, wherein, during the drying cycle, conditioned air is not generated for delivery to the supporting apparatus;

measuring, during the drying cycle, the relative humidity of the ambient air in which the air conditioning system is disposed; and controlling operation of the drying cycle by controlling at least one of an air flow rate across the condensate reservoir or the duration of air flow across the condensate reservoir.

7. The method in accordance with claim 1, further comprising:

measuring a first humidity after completion of the operation cycle;

performing humidity measurements periodically after completion of the operation cycle;

calculating an adjusted humidity based on the measured first humidity and at least one of the periodic humidity measurements; and adjusting operation of the drying cycle based on the calculated adjusted humidity by controlling at least one of an air flow rate across the condensate reservoir or the duration of air flow across the condensate reservoir.

8. A thermoelectric-based air conditioning system for use with a bed or mattress, the system comprising:

at least one fan configured to generate an air flow for delivery to the bed or mattress;

at least one thermoelectric device configured to condition the air flow;

a plurality of channels configured to guide the air flow from the at least one fan through at least one channel containing the at least one thermoelectric device;

an ambient air humidity sensor configured to measure a relative humidity of ambient air; and a controller coupled to the at least one fan, the at least one thermoelectric device, and the ambient air humidity sensor, the controller configured to:

receive a user input, control operation of the air conditioning system in accordance with an operation cycle in response to the user input, receive a first relative humidity measurement from the ambient air humidity sensor during the operation cycle, adjust operation of the at least one thermoelectric device in response to the received first relative humidity measurement to control condensate generated by operation of the at least one thermoelectric device, deactivate the at least one thermoelectric device after a duration of the operation cycle while the at least one fan remains perating for a drying cycle, receive a second relative humidity measurement after the at least one thermoelectric device have been deactivated, and when the second relative humidity measurement is above a predetermined threshold, adjust, during the drying cycle, at least one of an air flow rate across a condensate reservoir or a duration of air flow across the condensate reservoir of the air conditioning system, wherein the at least one thermoelectric device are deactivated during the drying cycle.

9. The air conditioning system in accordance with claim 8, wherein the controller is further configured to adjust downward a rate of operation of the at least one thermoelectric device when the relative humidity measurement is above a predetermined threshold.

10. The air conditioning system in accordance with claim 8, wherein the controller is further configured to adjust downward a rate of operation of the at least one thermoelectric device when the relative humidity measurement is above a predetermined humidity threshold and a current rate of operation of the at least one thermoelectric device is above a predetermined rate of operation threshold.

11. The air conditioning system in accordance with claim 8, wherein the controller is further configured to:

monitor a current run time compared to a threshold run time during the operation cycle; and adjust operation of the at least one thermoelectric device in response to the relative humidity measurement, the threshold run time and the current run time.

12. The air conditioning system in accordance with claim 8, wherein after completion of the operation cycle, the controller is configured to:

operate the air conditioning system in accordance with the drying cycle, wherein, during the drying cycle, conditioned air is not generated for delivery to a supporting apparatus; and measure, during the drying cycle, the relative humidity of the ambient air in which the air conditioning system is disposed.

13. The air conditioning system in accordance with claim 8, wherein after completion of the operation cycle, the controller is further configured to:

operate the air conditioning system in accordance with a drying cycle, wherein, during the drying cycle, conditioned air is not generated for delivery to a supporting apparatus;

measure, during the drying cycle, the relative humidity of the ambient air in which the air conditioning system is disposed; and control operation of the drying cycle by controlling at least one of an air flow rate across the condensate reservoir or the duration of air flow across the condensate reservoir.

14. The air conditioning system in accordance with claim 8, wherein the controller is further configured to:

measure a first humidity after completion of the operation cycle;

perform humidity measurements periodically after completion of the operation cycle;

calculate an adjusted humidity based on the measured first humidity and at least one of the periodic humidity measurements; and adjust operation of the drying cycle based on the calculated adjusted humidity by controlling at least one of an air flow rate across the condensate reservoir or the duration of air flow across the condensate reservoir.

15. The air conditioning system in accordance with claim 8, wherein the controller is further configured to determine an amount of time for the duration based on the humidity.

16. The air conditioning system in accordance with claim 8, wherein the at least one fan comprises:

a blower configured to operate in the operation cycle and to generate the air flow for delivery to the bed or mattress; and an axial fan configured to operate in drying mode and remove condensate from the air conditioning system.

17. The air conditioning system in accordance with claim 8, further comprising a liquid level or a float switch configured to provide an indication of a level of condensate in the condensate reservoir.

18. An air conditioning system for conditioning air for use with a seat or bed, the system comprising:

a housing having a thermoelectric device disposed therein;

at least one supply side fan for moving air through at least one air inlet within the housing into a supply side chamber where the air is conditioned by the thermoelectric device and for moving the conditioned air through an air supply outlet within the housing;

at least one exhaust side fan for moving air through the at least one air inlet and into an exhaust side chamber where the air is conditioned by the thermoelectric device and moving the conditioned air through at least one exhaust vent within the housing;

a removable air filter assembly coupled to the housing and configured for filtering air flow into the at least one air inlet, the removable air filter assembly comprising, an air filter housing, and air filter material;

an attachment structure configured to removably attach the air filter housing to the housing, wherein the thermoelectric device is configured to condition the air flow;

an ambient air humidity sensor configured to sense humidity of ambient air; and a controller coupled to the at least one supply side fan, the exhaust side fan, the at least one thermoelectric device, and the ambient air humidity sensor, the controller configured to:

receive a user input, control operation of the air conditioning system in accordance with an operation cycle in response to the user input, receive a first relative humidity measurement from the ambient air humidity sensor during the operation cycle, adjust operation of the thermoelectric device in response to the received first relative humidity measurement to control condensate generated by operation of the thermoelectric device;

deactivate the thermoelectric device after a duration of the operation cycle while the one or more fans remain operating for a drying cycle;

receive a second relative humidity measurement after the thermoelectric device have been deactivated; and when the second relative humidity measurement is above a predetermined threshold, adjusting, during the drying cycle, at least one of an air flow rate across a condensate reservoir or a duration of air flow across the condensate reservoir of the air conditioning system, wherein the thermoelectric device are deactivated during the drying cycle.

19. The air conditioning system in accordance with claim 18, wherein the attachment structure comprises magnetic material.

20. The air conditioning system in accordance with claim 18, further comprising:

a bottom tray configured to collect condensate; and wherein the at least one air inlet comprises a first air inlet positioned on a first side of the housing and a second air inlet positioned on a second side of the housing, and both the first and second air inlets are disposed in position such that air flowing through at least one of the first and second air inlets is drawn near, through or over the bottom tray.

* * * * *